United States Patent [19]

Hayashi et al.

[11] Patent Number: 5,015,561

[45] Date of Patent: May 14, 1991

[54] METHOD FOR FORMING A DIRECT POSITIVE IMAGE

[75] Inventors: Kazunori Hayashi; Nobuaki Inoue; Shingo Nishiyama, all of Kanagawa, Japan

[73] Assignee: Fuji Photo Film Co., Ltd., Kanagawa, Japan

[21] Appl. No.: 319,378

[22] Filed: Mar. 6, 1989

[30] Foreign Application Priority Data

Mar. 4, 1988 [JP] Japan ..... 63-51287
Apr. 4, 1988 [JP] Japan ..... 63-82543

[51] Int. Cl.[5] ..... G03C 5/305

[52] U.S. Cl. ..... 430/487; 430/584; 430/593; 430/598; 430/940

[58] Field of Search ..... 430/264, 598, 487, 584, 430/593, 940

[56] References Cited

U.S. PATENT DOCUMENTS

| | | | |
|---|---|---|---|
| 3,501,309 | 3/1970 | Gilman et al. | 430/584 |
| 3,822,135 | 7/1974 | Sakai et al. | 430/591 |
| 3,915,715 | 10/1975 | Millikan et al. | 430/584 |
| 4,481,285 | 11/1984 | Takagi et al. | 430/410 |
| 4,741,996 | 5/1988 | Aotsuka et al. | 430/559 |
| 4,801,520 | 1/1989 | Inoue et al. | 430/378 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A method of forming a direct positive image comprising:

(a) imagewise exposing a direct positive silver halide photographic material composed of a support having thereon at least one light-sensitive silver halide emulsion layer containing non-prefogged internal latent image silver halide grains, at least one hydrophilic colloidal layer of the material containing a nucleating agent, and at least one sensitizing dye represented by formulae (I), (Ia), (Ia'), or (Ib):

(I)

wherein Z and $Z_1$ each represents a non-metallic atomic group necessary for forming a 5-membered or 6-membered nitrogen-containing heterocyclic ring; R and $R_1$ each represents a substituted or unsubstituted alkyl group or an aryl group; Q and $Q_1$ represent a non-metallic atomic group necessary for forming together a 4-thiazolidinone group, a 5-thiazolidinone group or a 4-imidazolidinone group; L, $L_1$ and $L_2$ each represents a methine group or a substituted methine group; $n_1$ and $n_2$ each is 0 or 1; X represents an anion; and m is 0 or 1;

(Ia)

(Ia')

wherein $R_{21}$ and $R_{22}$ each represents a substituted or unsubstituted alkyl group; $R_{20}$ represents hydrogen, a methyl group, a methoxy group or an ethoxy group; $R_{23}$ and $R_{24}$ each represents hydrogen, a lower alkyl group, a phenyl group or a benzyl group; $R_{25}$ represents hydrogen, a lower alkyl group, a lower alkoxy group, a phenyl group, a benzyl group or wherein $W_1$ and $W_2$ each represents a substituted or unsubstituted alkyl group or a substituted or unsubstituted aryl group, and $W_1$ and $W_2$ may be linked to form a 5-membered or 6-membered nitrogen-containing heterocyclic ring; $D_{20}$ represents a substituted or unsubstituted group containing at least one ethylene bond; $D_{21}$ and $D_{22}$ each represents hydrogen or a group containing an ethylene bond, when $D_{21}$ and $D_{22}$ are linked to form a ring; $Z_{20}$ and $Z_{21}$ each represents a non-metallic atomic group necessary for forming a 5- membered or 6-membered nitrogen-containing heterocyclic ring; X' represents an acid anion; and n' is 1 or 2;

(Ib)

(Abstract continued on next page.)

-continued

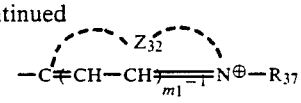

wherein $R_{36}$ and $R_{37}$ each has the same definition as $R_{21}$; $R_{38}$ has the same definition as $R_{23}$; V represents hydrogen, a lower alkyl group, an alkoxy group, a halogen atom, or a substituted alkyl group; $Z_{32}$ has the same definition as $R_{20}$; $X_1$ has the same definition as X; and $m_1$, $n_1$ and p is each 1 or 2 and (b) developing said exposed material in the presence of a nucleation accelerator to form a positive image.

18 Claims, No Drawings

METHOD FOR FORMING A DIRECT POSITIVE IMAGE

FIELD OF THE INVENTION

This invention relates to a process of quickly forming direct positive images by processing a silver halide photographic material with a processing solution having a high stability, and more particularly to a direct positive image forming process using a photographic light-sensitive material for computer output (light-sensitive film for COM).

BACKGROUND OF THE INVENTION

The rapid progress of computors and information industries requires various methods for printing out a huge amount of recorded information.

As one recording material in this field, a silver halide photographic material having reversal processing aptitude is used. In the step of the reversal development process, the silver halide photographic material imagewise exposed is subjected to a first development to form negative images and, without being fixed, is bleached to remove reduced silver in the images. Then, the photographic material containing undeveloped remaining silver halide is exposed to light and subjected to a second development to form positive images. In the process, the finishing speed of film is slow since the processing step is complicated and also the maximum density (Dmax) and the minimum density (Dmin) are variable. Furthermore, in the process, it is necessary to use a strong oxidizing agent such as potassium bichromate, for bleaching, which causes a problem of environmental pollution.

As a process capable of solving such a problem, a photographic process of obtaining direct positive images without need of the reversal processing step or a negative film is well known.

Processes of forming positive images using a direct positive silver halide photographic material can be mainly classified into the following two types from the viewpoint of practical usefulness.

In one type, previously fogged silver halide emulsions are used and after development, direct positive images are obtained by destroying fogged nuclei (latent images) at exposed portions by utilizing a solarization or Herschel effect.

In another type, unfogged internal latent image type silver halide emulsions are used and direct positive images are obtained by applying surface development after or while applying fogging treatment after image exposure.

The internal latent image type silver halide photographic emulsion is a silver halide photographic emulsion of a type having the sensitive specks mainly in the inside of the silver halide grain and forming latent images mainly in the inside of the silver halide grain by light exposure.

The latter process has generally high sensitivity as compared with the former process and is suitable for uses requiring high sensitivity. The present invention relates to the latter process.

Various techniques are known in the field of the art and are mainly described, e.g., in U.S. Pat. Nos. 2,592,250, 2,466,957, 2,497,875, 2,588,982, 3,317,322, 3,761,266, 3,761,276, 3,708,298, 3,37,322, 3,206,313 and 3,796,577, British Patents 1,150,553, 1,151,363, and 1,011,062.

By using these known processes, direct positive type photographic light-sensitive materials having relatively high sensitivity can be prepared.

Details of the mechanism of direct positive image formation are described in T. H. James, *The Theory of the Photographic Process,* 4th Edition, Chapter 7, pages 182–193 and U.S. Pat. No. 3,761,276.

It is believed that fogged nuclei are selectively formed at the surfaces only of silver halide grains at the unexposed portions by surface desensitizing action based on the internal latent images formed in the inside of the silver halide grains by an initial imagewise exposure, and then an ordinary surface development process is applied to form photographic images (direct positive images) at the unexposed portions.

As described above, as a means for selectively forming fogged nuclei, a "light fogging method" of applying a second light exposure on the whole surface of the light-sensitive material (e.g., British Patent 1,151,363) and a "chemical fogging method" using a nucleating agent are known. The latter method is described, e.g., in *Research Disclosure,* Vol. 151, No. 15162 (November, 1976), pages 72–87.

The conventional chemical fogging method has the following faults. In the method, the nucleating agent used shows the effect as a nucleating agent at a high pH of at least 12 and hence under such high pH conditions, the developing agent is liable to be deteriorated by air oxidation, which results in greatly reducing the development activity. Also, a long time is required for processing due to the slow development rate, and if a developer of low pH is used, the processing time is further prolonged. Furthermore, even when the pH of the developer is higher than 12, it takes a long time for finishing the development.

On the other hand, the light fogging method does not require a high pH condition and is relatively advantageous for practical use. However, for various purposes in a wide field of photography, there are various technical problems in this method. Since the light fogging method is based on the formation of fogged nuclei by the photodecomposition of silver halide, the proper exposure illuminance and the proper exposure amount in the method differ according to the kind and the characteristics of the silver halide being used. Thus, it is difficult to obtain constant performance in the method. Furthermore, the development apparatus is complicated and expensive. Still further, a long time is required for the development.

As described above, it is difficult to stably obtain good direct positive images by conventional fogging methods. For solving these problems, compounds showing nucleating action even below pH 12 are proposed in JP-A-52-69613 (the term "JP-A" as used herein means an "unexamined published Japanese patent application"), and U.S. Pat. Nos. 3,615,615 and 3,850,638. However, these nucleating agents have the fault that the nucleating agents act with silver halide or decompose during the storage of the photographic light-sensitive materials containing them before processing, which results in reducing the maximum image density after processing.

U.S. Pat. No. 3,227,552 discloses that the development rate for an intermediate density is increased by using a hydroquinone derivative. However, even in the case of the hydroquinone derivative, the development rate is not sufficiently high and in particular, when the pH of the developer is below 12, the development rate is insufficient.

Also, JP-A-60-170843 discloses that the maximum image density is increased by adding a mercapto compound having a carboxylic acid group or a sulfonic acid group. However, the effect obtained by the addition of the compound is limited.

JP-A-55-134848 discloses that the minimum image density is reduced by processing with a processing solution (pH 12.0) containing a tetraazaindene series compound in the presence of a nucleating agent to prevent the formation of re-reversed negative images. However, in the method, the maximum image density is not increased and also the development rate is not increased.

Also, JP-B-45-12709 (the term "JP-B" as used herein means an "examined published Japanese patent application") corresponding to U.S. Pat. No. 3,708,298 discloses that a triazoline-thione series compound or a tetrazoline-thione series compound is added to a light-sensitive material for forming direct positive images by a light fogging method. However, even by this method, it is difficult to obtain high maximum image density and a high development rate.

As described above, a technique of obtaining direct positive images having high maximum image density and low minimum image density in a short period of time is not known.

Also, there is generally a problem that as the sensitivity of a direct positive silver halide emulsion increases, the formation of re-reversed negative images in a high illuminance exposure increases. In particular, in a light-sensitive film for COM, a high sensitivity in a short light exposure time is required and the prevention of the formation of the re-reversed negative images under a high illuminance exposure is important.

On the other hand, as the light source for a light-sensitive film for COM, a cathode ray tube (CRT) has been used but for improving image quality, light-sensitive materials using a laser light source (in particular, He-Ne laser source of 633 nm) have been developed.

It is well known that laser light gives a high image quality owing to its coherency, and a direct positive silver halide photographic material having a high sensitivity for use with laser light has been strongly desired.

In the field of the art, a He-Ne gas laser has been widely used from the point of reliability, but is insufficient since the device for the laser is large, its life is short, and its cost is high. On the other hand, a semiconductor laser is small and low in cost, and the laser light can be easily modulated and its life is longer than the He-Ne gas laser. Also, since the semiconductor laser emits infrared light, a bright safelight can be used for light-sensitive materials and the use of the semiconductor laser has advantage that the handling and working properties of light-sensitive materials are improved.

Thus, it has been strongly desired to develop a direct positive silver halide photographic material having a high sensitivity in the infrared region and having an excellent storage stability.

SUMMARY OF THE INVENTION

A first object of this invention is to provide a process of quickly and stably forming direct positive images having high Dmax and low Dmin by processing a previously unfogged internal latent image type silver halide photographic material in the presence of a nucleating agent.

A second object of this invention is to provide a direct positive silver halide photographic material for a He-Ne laser light source by utilizing an internal latent image type silver halide emulsion and reversibility by a nucleating agent.

A third object of this invention is to provide a process of quickly and stably forming direct positive images having high Dmax and low Dmin by processing a previously unfogged internal latent image type silver halide photographic material for a semiconductor laser light source by processing it in the presence of a nucleating agent.

A fourth object of this invention is to provide a direct positive silver halide photographic material with reduced formation of re-reversed negative images in high illuminance exposure.

A fifth object of this invention is to provide a process for forming direct positive images with reduced variation in Dmax and Dmin, even when the pH of the developer is varied.

A sixth object of this invention is to provide a direct positive silver halide photographic material with reduced variation of Dmax and Dmin when the photographic material is stored for a long period of time.

It has now been discovered that these and other objects of the present invention are obtained by a method for forming a direct positive image comprising:

(a) imagewise exposing a direct positive silver halide photographic material composed of a support having thereon at least one light-sensitive silver halide emulsion layer containing non-prefogged internal latent image silver halide grains, at least one hydrophilic colloidal layer of the material containing a nucleating agent, and at least one sensitizing dye represented by formula (I), (Ia), (Ia') or (Ib):

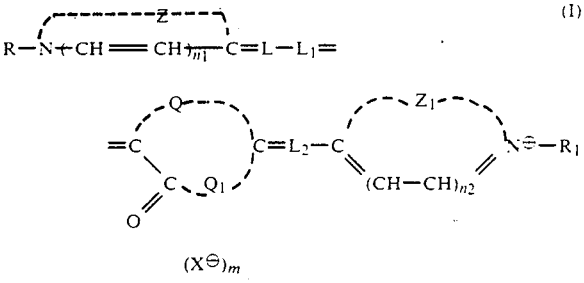

(I)

wherein Z and $Z_1$ each represents a non-metallic atomic group necessary for forming a 5-membered or 6-membered nitrogen-containing heterocyclic ring; R and $R_1$ each represents a substituted or unsubstituted alkyl group or an aryl group; Q and $Q_1$ represent a non-metallic atomic group necessary for forming together a 4-thiazolidinone group, a 5-thiazolidinone group or a 4-imidazolidinone group; L, $L_1$ and $L_2$ each represents a methine group or a substituted methine group; $n_1$ and $n_2$ each is 0 or 1; X represents an anion; and m is 0 or 1;

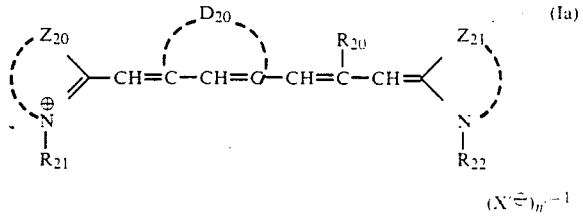

(Ia)

-continued

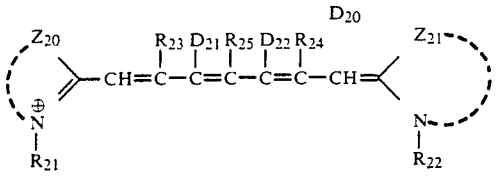

(Ia')

wherein $R_{21}$ and $R_{22}$ each represents a substituted or unsubstituted alkyl group: $R_{20}$ represents hydrogen, a methyl group, a methoxy group or an ethoxy group $R_{23}$ and $R_{24}$ each represents hydrogen, a lower alkyl group, a phenyl group or a benzyl group; $R_{25}$ represents hydrogen, a lower alkyl group, a lower alkoxy group, a phenyl group, a benzyl group, or

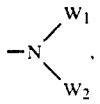

wherein $W_1$ and $W_2$ each represents a substituted or unsubstituted alkyl group or a substituted or unsubstituted aryl group, and $W_1$ and $W_2$ may be linked to form a 5-membered or 6-membered nitrogen-containing heterocyclic ring; $D_{21}$ represents a substituted or unsubstituted group containing at least one ethylene bond; $D_{21}$ and $D_{22}$ each represents hydrogen, or a group containing an ethylene bond when $D_{21}$ and $D_{22}$ are linked to form a ring; $Z_{20}$ and $Z_{21}$ each represents a non-metallic atomic group necessary for forming a 5-membered or 6-membered nitrogen-containing heterocyclic ring; X' represents an acid anion; and n' is 1 or 2;

(Ib)

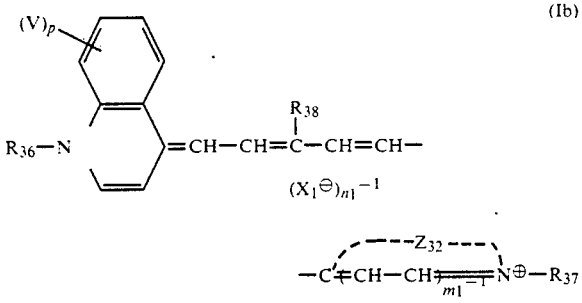

wherein $R_{36}$ and $R_{37}$ each has the same definition as $R_{21}$ and $R_{22}$; $R_{38}$ has the same definition as $R_{23}$; V represents hydrogen, a lower alkyl group, an alkoxy group, a halogen atom, or a substituted alkyl group; $Z_{32}$ has the same definition as $Z_{21}$ and $Z_{21}$; $X_1$ has the same definition as X; and $m_1$, $n_1$ and p is each 1 or 2 and (b) developing said exposed material in the presence of a nucleation accelerator to form a positive image.

DETAILED DESCRIPTION OF THE INVENTION

The invention is now explained in greater detail.

In the method of the present invention, the material may be subjected to a processing of fixing, bleaching and/or bleach-fixing in a conventional manner after development.

In formula (I), an alkyl group represented by R and $R_1$ has preferably from 1 to 30 carbon atoms and more preferably from 1 to 20 carbon atoms, an aryl groups represented by R and $R_1$ has preferably up to 30 carbon atoms and more preferably up to 20 carbon atoms.

As the substituent for the substituted alkyl or methine group represented by R and $R_1$, and L, $L_1$ and $L_2$, respectively, a straight, branched or cyclic alkyl group having preferably from 1 to 30 carbon atoms, and more preferably having from 1 to 20 carbon atoms, wherein the branched alkyl groups may have a cyclic structure to form a saturated heterocyclic ring containing one or more hetero atoms.

In formulas (Ia) and (Ia'), an alkyl group represented by R21 and R22 has preferably from 1 to 8 carbon atoms, a lower alkyl group and a lower alkoxy group represented by R25 each have preferably from 1 to 6 carbon atoms, and more preferably 1 to 4 carbon atoms.

In formula (Ib), the lower alkyl group represented by $R_{38}$ has preferably from 1 to 6 carbon atoms, more preferably from 1 to 4 carbon atoms, the lower alkyl group, the lower alkoxy group and the alkyl moiety of the substituted alkyl group represented by V each have preferably from 1 to 6 carbon atoms and more preferably from 1 to 4 carbon atoms. The substituent of the substituted alkyl group represented by V includes the same substituent as $R^{21}$ and $R^{22}$.

The term "nucleating agent" as used herein means a material functioning to form direct positive images by surface developing a previously unfogged internal latent image type silver halide emulsion.

The term "nucleation accelerator" means a material which has no substantial function as a nucleating agent but functions to reduce the development time necessary for increasing the maximum density of direct positive images and/or obtaining a constant density of direct positive images by accelerating the action of a nucleating agent.

The nucleating agents for use in this invention include all the compounds developed for nucleating of internal latent image type silver halides. The nucleating agents may be used singly or as a combination thereof.

Typical examples of the nucleating agent are described, e.g., in *Research Disclosure*, No. 22534, pages 50–54 (January, 1983) and they are largely classified into hydrazine series compounds, quaternary heterocyclic compounds, and other compounds.

Typical examples of hydrazine series compounds are described, e.g., in *Research Disclosure*, No. 15162, pages 76–77 (November, 1976) and ibid., No. 23510, pages 346–352 (November, 1983). More specifically, there are following compounds.

Examples of hydrazine series nucleating agent having an absorptive group to silver halide are described in U.S. Pat. Nos., 4,030,925, 4,080,207, 4,031,127, 3,718,470, 4,269,929, 4,276,364, 4,278,748, 4,385,108, 4,459,347, British Patent 2,011,391B, JP-A-54-74729, JP-A-55-163533, JP-A-55-74536, and JP-A-60-179734.

Examples of other hydrazine series nucleating agent are described in JP-A-57-86829 and U.S. Pat. No. 4,560,638.

Typical examples of quaternary heterocyclic series nucleating agents are described in *Research Disclosure*, No. 22534 (January, 1983), JP-B-49-38164, JP-B-52-19452, and JP-B-52-47326, JP-A-52-69613, JP-A-52-3426, JP-A-55-138742, and JP-A-60-11837, U.S. Pat. No. 4,306,016, and *Research Disclosure*, No. 23213, pages 267–270 (August, 1983).

The nucleating agents in this invention are preferably the compounds represented by formulae (N-I) and (N-II);

(N-I)

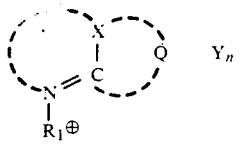

wherein $Z^1$ represents a non-metallic atomic group necessary for forming a substituted or unsubstituted 5-membered or 6-membered heterocyclic ring, alone or condensed with an aromatic ring or a heterocyclic ring; $R^1$ represents an aliphatic group; X represents =C— or =N—; Q represents a non-metallic atomic group necessary for forming a 4-membered to 12-membered non-aromatic hydrocarbon ring or non-aromatic heterocyclic ring, at least one of $R^1$, the substituent for $Z^1$ and the substituent for Q contains an alkynyl group and further at least one of $R^1$, $Z^1$, and Q may contain an adsorption accelerating group for silver halide; Y represents a counter ion; and n is the number of Y groups necessary for charge balance.

The nucleating agent represented by formula (N-I) described above are now explained more in detail.

Examples of the heterocyclic ring completed by $Z^1$ are a quinolinium nucleus, benzimidazolium nucleus, pyridinium nucleus, thiazolium nucleus, selenazolium nucleus, imidazolium nucleus, tetrazolium nucleus, indolenium nucleus, pyrrolidinium nucleus, phenanthridinium nucleus, isoquinolium nucleus, and naphthopyridinium nucleus. The heterocyclic ring formed by $Z^1$ may be substituted by a substituent such as an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxy group, an acyl group, a carbamoyl group, a sulfamoyl group, a sulfo group, a cyano group, a ureido group, a urethane group, a carbonic acid ester group, a hydrazine group, a hydrazone group or an imino group. When two or more substituents are present, they may be the same or different. Also, the substituent may be further substituted by another of these substituents.

Furthermore, $Z^1$ may have a heterocyclic quaternary ammonium group completed by $Z^1$ through a suitable linkage group $L^1$ as a SubStituent. In this case, the compound has a dimer structure.

As the preferred skeleton nucleus of the heterocyclic ring completed by $Z^1$, there are quinolinium nucleus, benzimidazolium nucleus, pyridinium nucleus, acrydinium nucleus, phenanthridinium nucleus, naphthopyridinium nucleus, and isoquinolinium nucleus. More preferred are. quinolinium nucleus, naphthopyridinium nucleus, and benzimidazolium nucleus; and a quinolinium nucleus is most preferred.

The aliphatic group represented by $R^1$ is preferably an unsubstituted alkyl group having from 1 to 18 carbon atoms or a substituted alkyl group the alkyl moiety of which has from 1 to 18 carbon atoms. The substituent for the substituted alkyl group includes those described above for $Z^1$.

$R^1$ is preferably an alkynyl group, and most preferably a propargyl group.

Q is a non-metallic atomic group necessary for forming a 4-membered to 12-membered non-aromatic hydrocarbon ring or non-aromatic heterocyclic ring.

The non-aromatic hydrocarbon ring is formed when X is a carbon atom and examples are cyclopentane, cyclohexane, cyclohexene, cycloheptane, indane, and tetralin.

The non-aromatic heterocyclic ring contains nitrogen, oxygen, sulfur or selenium, as a hetero atom. Examples when X is a carbon atom are tetrahydrofuran, tetrahydropyran, butyrolactone, pyrrolidone, and tetrahydrothiophene. Also, examples when X is a nitrogen atom are pyrolidine, piperidine, pyridone, piperazine, perhydrothiazine, tetrahydroquinoline, and indoline.

Preferably X is carbon atom in the ring formed by Q, and examples of the preferred ring are cyclopentane, cyclohexane, cycloheptane, cyclohexene, indane, tetrahydropyran, and tetrahydrothiophene.

At least one of $R^1$, the substituted for $Z^1$ and the substituted for Q contains an alkynyl group. The alkynyl group has preferably from 2 to 18 carbon atoms and examples are ethynyl, propargyl, 2-butynyl, 1-methylpropargyl, 1,1-dimethylpropargyl, 3-butynyl, and 4-pentynyl.

The alkynyl group may be substituted by the substituents for $Z^1$.

As the alkynyl group, a propargyl group is preferred and it is most preferred that $R^1$ is a propargyl group.

The adsorption accelerating group to silver halide as the substituent for $R^1$, $Z^1$, and Q is preferably a group represented by $Z^1$—$(L^1)_m$ (wherein $X^1$ is an adsorption accelerating group to silver halide; $L^1$ represents a divalent linkage group, and m represents 0 or 1). Preferred examples of the adsorption accelerating group to silver halide represented by $X^1$ are a thioamido group, a mercapto group, or a 5- or 6-membered nitrogen-containing heterocyclic group.

The adsorption accelerating group may be substituted. Also, as the thioamide group, an acyclic thioamido group (e.g., thiourethane and thioureido) is preferred.

As the mercapto group represented by $X^1$, a heterocyclic mercapto group (e.g., 5-mercaptotetrazole, 3-mercapto-1,2,4-triazole, 2-mercapto-1,3,4-thiadiazole, and 2-mercapto-1,3,4-oxadiazole) is preferred.

The 5- or 6-membered nitrogen-containing heterocyclic ring represented by $X^1$ is composed of a combination of nitrogen, oxygen, sulfur, and carbon and the heterocyclic ring forming imino silver is preferred. Examples thereof are benzotriazole and aminothiazole.

The divalent linkage group shown by $L^1$ is an atom or an atomic group containing at least one of C, N, S, andO. Examples are an alkylene group, an alkenylene group, an alkynylene group, an arylene group, —O—, —S—, —NH—, —N=, —CO—, and —$SO_2$— (they may have a substituent). They may be used sin91y or as a combination thereof.

Examples of the combination linkage groups are $$-\overset{O}{\overset{\|}{C}}O-,\ -\overset{O}{\overset{\|}{C}}NH-,\ -SO_2NH-,\ -O\overset{O}{\overset{\|}{C}}NH-,\ -NH\overset{O}{\overset{\|}{C}}NH-,$$

$$-NHSO_2NH-,\ -(\text{alkylene})\overset{O}{\overset{\|}{C}}NH-,\ -(\text{arylene})SO_2NH-.$$

-continued $$-(\text{arylene})-\overset{O}{\overset{\|}{N}}HCNH-,\ \text{and}\ -(\text{arylene})-\overset{O}{\overset{\|}{C}}NH-.$$

As a counter ion Y for balancing charge, there are, for example, bromide, chloride, iodide, p-toluenesulfonate, ethylsulfonate, perchlorate, trifluoromethanesulfonate, thiocyanate, $BR_4$—, and $PF_6$—.

The compound represented by formula (N-I) described above preferably has an adsorption accelerator to silver halide and, particularly preferably has a thioamide group, an azole group, or a heterocyclic mercapto group as the adsorption accelerating group $X^1$.

These compounds and the synthesis methods for these compounds are described in Japanese Patent Application No. 62-17984 and the patents and publications cited therein.

Specific examples of the compound shown by formula (N-I) are illustrated below, but the invention is not to be construed as being limited to these compounds.

(N-I-1)

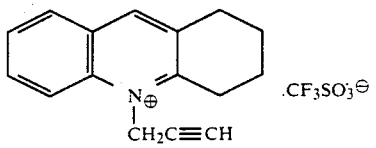

(N-I-2)

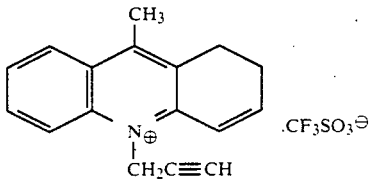

(N-I-3)

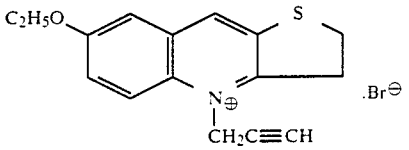

(N-I-4)

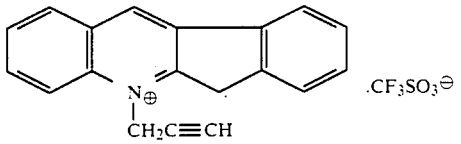

(N-I-5)

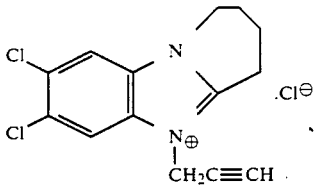

(N-I-6)

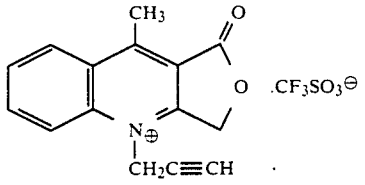

(N-I-7)

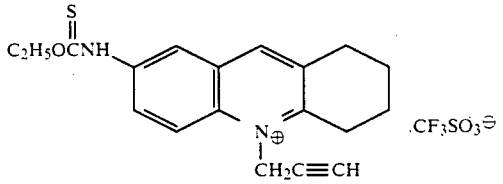

-continued
(N-I-8)
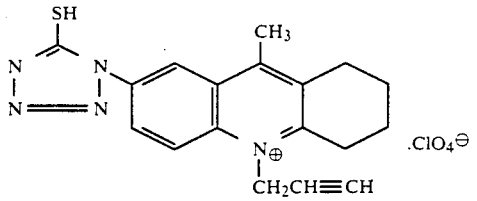
(N-I-9)
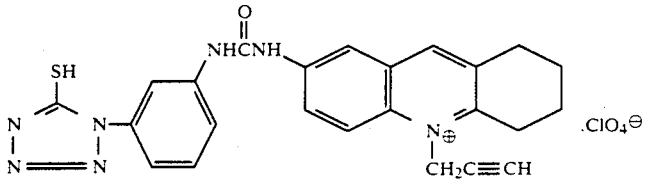
(N-I-10)
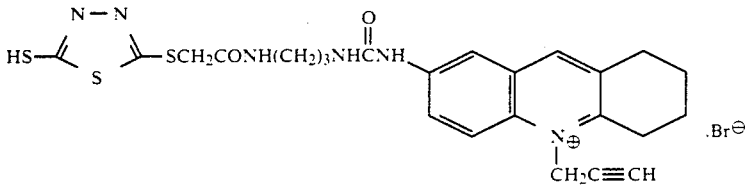
(N-I-11)
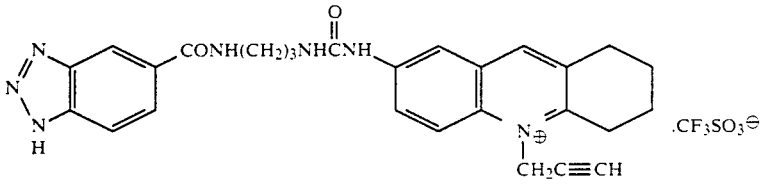
(N-I-12)
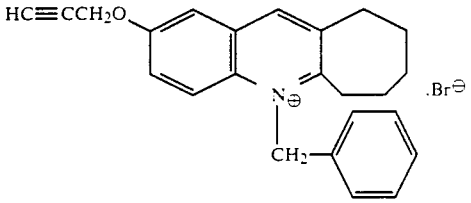
(N-I-13)
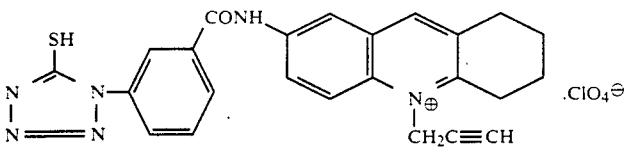
(N-I-14)
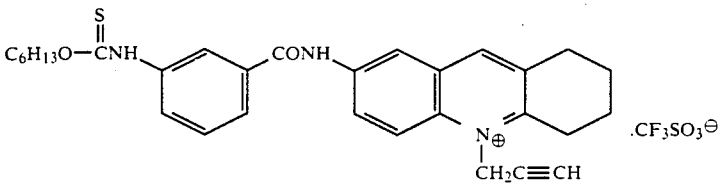
(N-I-15)
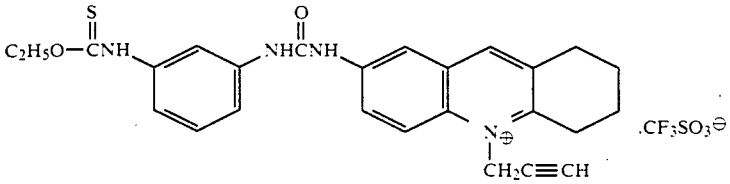

-continued
(N-I-16)
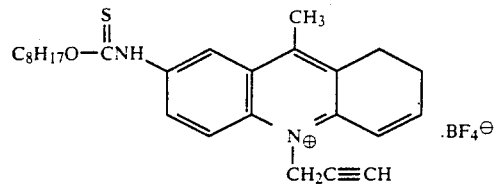
(N-I-17)
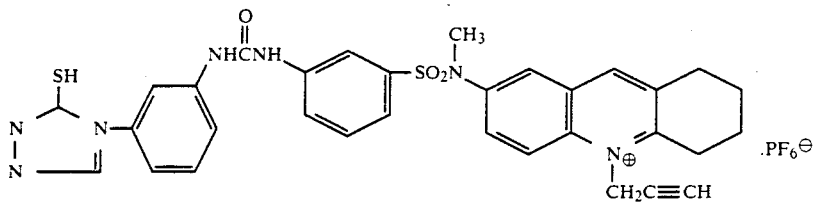
(N-I-18)
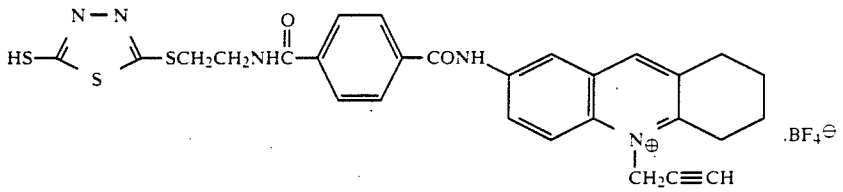
(N-I-19)
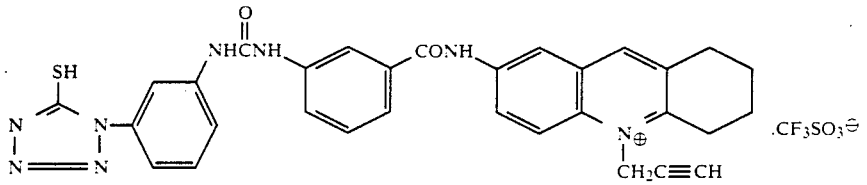
(N-I-20)
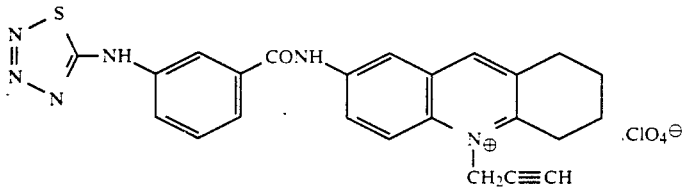
(N-I-21)
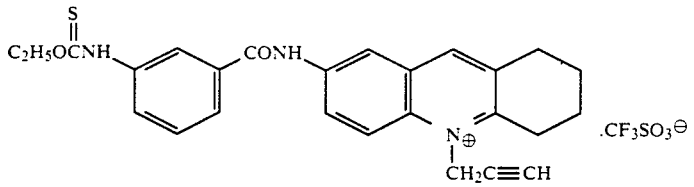
(N-I-22)
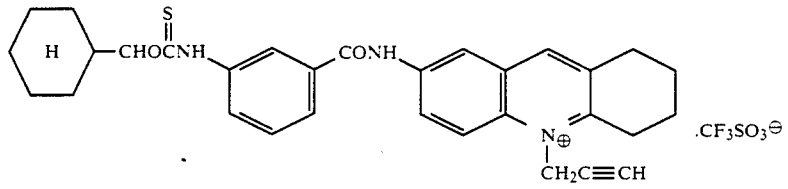
(N-I-23)
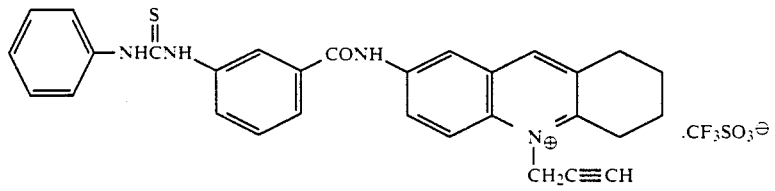

-continued (N-I-24)

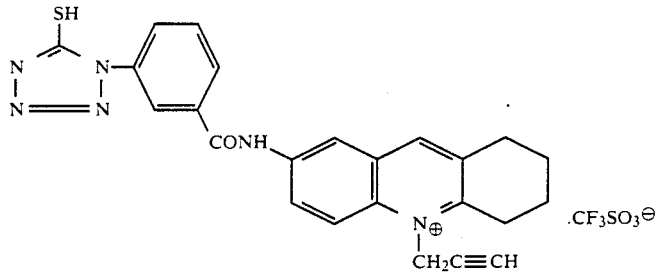

These compounds can be synthesized by the methods described in the patents cited in *Research Disclosure*, No. 22534, pages 50–54 (January, 1985) and U.S. Pat. No. 4,471,044 or similar methods to them.

$$R^{21}-\underset{\underset{R^{23}}{|}}{N}-\underset{\underset{R^{24}}{|}}{N}-G-R^{22} \qquad \text{(N-II)}$$

wherein $R^{21}$ represents an aliphatic group, an aromatic group, or a heterocyclic group; $R^{22}$ represents hydrogen, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group (HN=C<); and $R^{23}$ and $R^{24}$ both represent hydrogen or one of them represents hydrogen and the other represents an alkylsulfonyl group, an arylsulfonyl group, or an acyl group; G, $R^{23}$ and $R^{24}$ may form a hydrazone structure (>N—N=C<) including the hydrazine nitrogen. Also, if possible, the aforesaid group may be substituted by a substituent.

The aliphatic group represented by $R^{21}$ in formula (N-II) is a straight chain, branched, or cyclic alkyl group, alkenyl group, or alkynyl group.

The aromatic group represented by $R^{21}$ is a monocyclic or dicyclic aryl group such as, for example, a phenyl group and a naphthyl group.

The heterocyclic group represented by $R^{21}$ is a 3- to 10-membered saturated or unsaturated heterocyclic ring containing at least one of nitrogen, oxygen, and sulfur and the ring may be a monocyclic ring or may form a condensed ring with an aromatic ring or a heterocyclic ring. The heterocyclic ring is preferably a 5- or 6-membered aromatic heterocyclic group such as, e.g., a pyridyl group, a quinolinyl group, an imidazolyl group, and a benzimidazolyl group.

$R^{21}$ may be substituted with a substituent, such as an alkyl group, an aralkyl group, an alkoxy group, an alkyl- or aryl-substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group and a carboxyl group. These groups may be further substituted.

Also, these groups may, if possible, combine with each other to form a ring.

$R_{21}$ is preferably an aromatic group, an aromatic heterocyclic ring or an aryl-substituted methyl group, and more preferably an aryl group.

$R_{22}$ is preferably as follows. When G is a carbonyl group, $R_{22}$ is preferably hydrogen, an alkyl group (e.g., methyl, trifluoromethyl, 3-hydroxypropyl, and 3-methanesulfonamidopropyl), an aralkyl group (e.g., o-hydroxybenzyl), or an aryl group (e.g., phenyl, 3,5-dichlorophenyl, o-methanesulfonamidophenyl, and 4-methanesulfonylphenyl), and is particularly preferably a hydrogen atom. When G is a sulfonyl group, $R_{22}$ is preferably an alkyl group (e.g., methyl), an aralkyl group (e.g., o-hydroxyphenyl), an aryl group (e.g., phenyl) or a substituted amino group (e.g., dimethylamino).

The substituent of the substituted group represented by $R_{22}$ may include the same substituents as the substituted group represented by $R_{21}$ described above and other substituents, such as acyl, acyloxy, alkyloxycarbonyl, aryloxycarbonyl, alkenyl, alkynyl, and a nitro group.

These groups may be further substituted by the same group(s). Also, if possible, these groups may combine with each other to form a ring.

It is preferred that $R^{21}$ or $R^{22}$, in particular $R_{22}$ contains a ballast group. The ballast group has at least 8 carbon atoms and is composed of at least one of an alkyl group, a phenyl group, an ether group, an amido group, a ureido group, a urethane group, a sulfonamido group, and a thioether group.

Also, $R^{21}$ or $R^{22}$ may contain a group represented by $-(X^2L^2)_{m2}$ wherein $X^2$ has the same definition as $X^1$ of formula(N-I) and is preferably a thioamido group (except for thiosemicarbazide and the substituents thereof), a mercapto group or a 5- or 6-membered nitrogen-containing heterocyclic group, $L^2$ represents a divalent linkage group having the same definition as $L^1$ of formula (N-I), and $m_2$ represents 0 or 1, the group $-(X^2L^2)_{m2}$ accelerating the adsorption of the compound of formula [N-II] to the surface of silver halide grains.

More preferably, $X^2$ is a cyclic thioamido group (e.g., a mercapto-substituted nitrogen-containing heterocyclic ring such as 2-mercaptothiadiazole, 3-mercapto-1,2,4-triazole, 5-mercaptotetrazole, 2-mercapto-1,3,4-oxazole, 2-mercaptobenzoxazole) or a nitrogen-containing heterocyclic group (e.g., benzotriazole, benzimidazole, and indazole). The particularly preferred group represented by G in formula (N-II) is a carbonyl group.

$R_{23}$ and $R_{24}$ are most preferably each hydrogen.

Also, it is more preferred that the nucleating agent represented by formula (N-II) has an adsorptive group to silver halide. The particularly preferred absorptive group to silver halide is a mercapto group, a cyclic thioamido group and a nitrogen-containing heterocyclic group as described for formula (N-I).

Specific examples of the compound represented by formula (N-II) described above are illustrated below but the invention is not to be construed as being limited to these compounds.

(N-II-1)
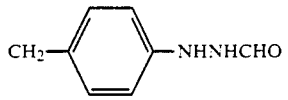
(N-II-2)
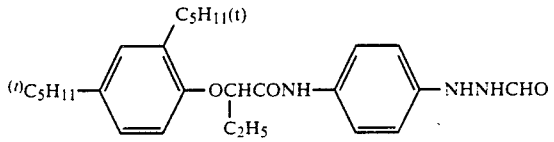
(N-II-3)
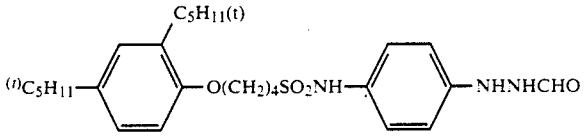
(N-II-4)
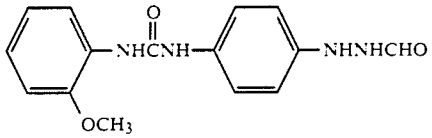
(N-II-5)
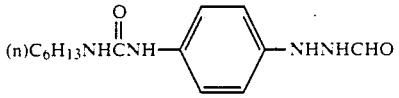
(N-II-6)
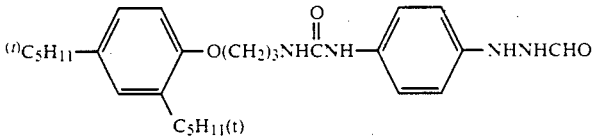
(N-II-7)
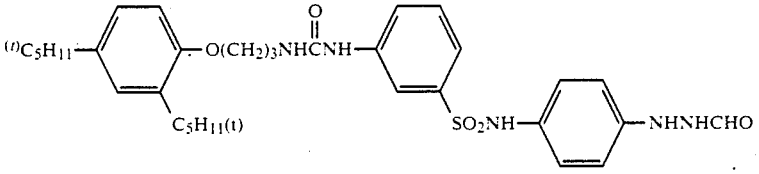
(N-II-8)
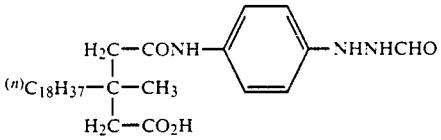
(N-II-9)
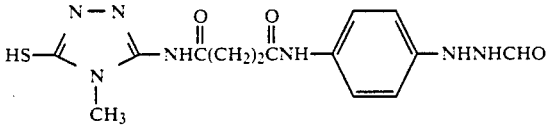
(N-II-10)
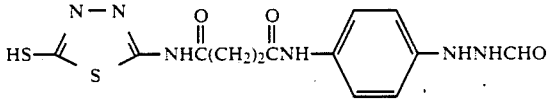
(N-II-11)
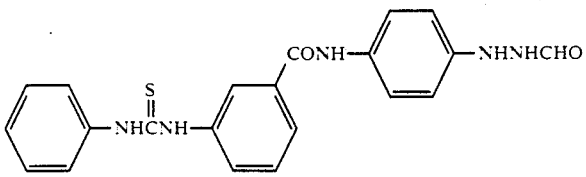

-continued
(N-II-12)
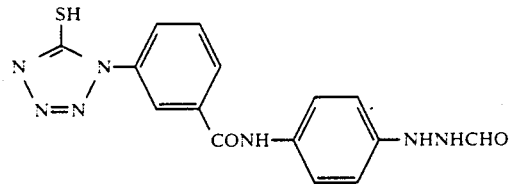
(N-II-13)
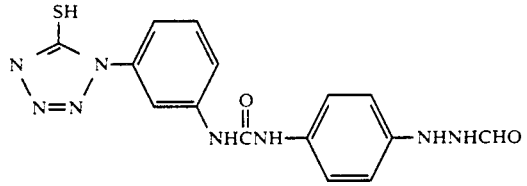
(N-II-14)
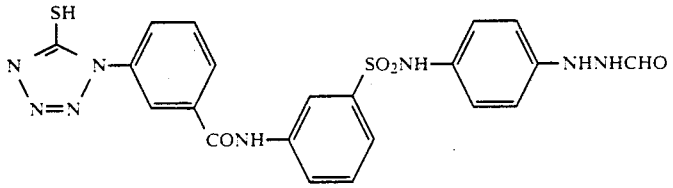
(N-II-15)
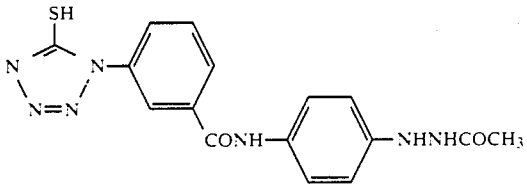
(N-II-16)
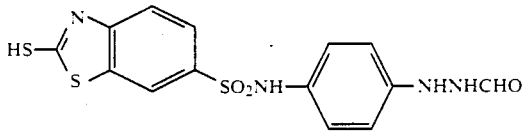
(N-II-17)
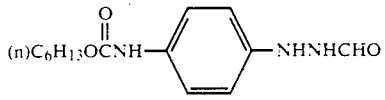
(N-II-18)
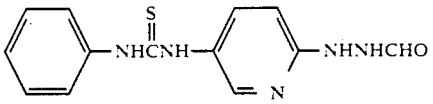
(N-II-19)
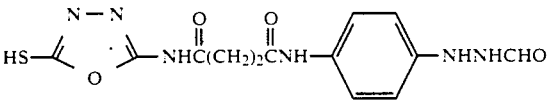
(N-II-20)
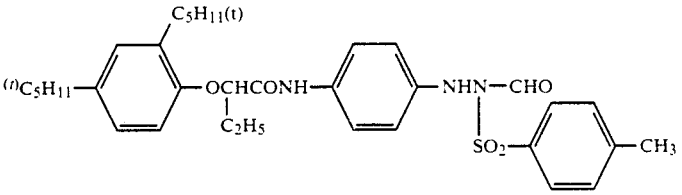
(N-II-21)
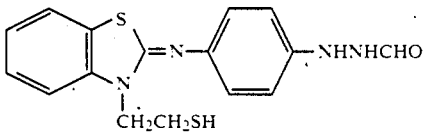

-continued (N-II-22)

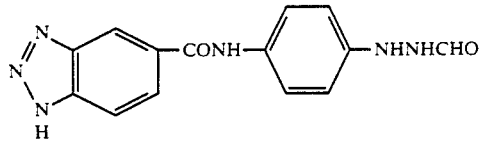

(N-II-23)

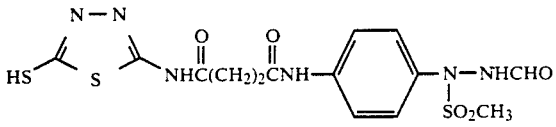

(N-II-24)

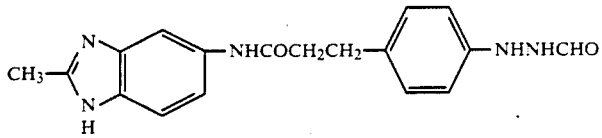

The compounds represented by formula (N-II) for use in this invention can be synthesized according to the methods described, e.g., in the patents cited in *Research Disclosure,* No. 15162, pages 76–77 (November, 1976), ibid., No. 22534, pages 50–54 (January, 1983), and ibid., No. 23510, pages 346–352 (November, 1983) and U.S. Pat. Nos. 4,269,924, 4,276,364, and 4,080,207.

The compound represented by formula (N-I) or (N-II) in this invention may be present in any layer(s) of the photographic light-sensitive material being processed in this invention, but preferably are in a silver halide emulsion layer thereof. There is no particular restriction on the amount of the compound, but the amount is usually in the range of from about $1\times10^{-8}$ mol to about $1\times10^{-2}$ mol, and preferably from $1\times10^{-7}$ mol to $1\times10^{-3}$ mol per mol of silver in the silver halide emulsion layer.

For further increasing the effect of the nucleating agent in this invention, it is preferred that the nucleating agent is used in combination with the hydroquinones described in U.S. Pat. Nos. 3,227,552 and 4,279,987, the chromans described in U.S. Pat. Nos. 4,268,621, JP-A-54-103031, and *Research Disclosure,* No. 18264 (1979), the quinones described in *Research Disclosure,* No. 21206 (1981), the amines described in U.S. Pat. No. 4,150,993, and JP-A-58-174757, the oxidizing agents described in JP-A-60-260039, and *Research Disclosure,* No. 16936 (1978), the catechols described in JP-A-55-21013, and JP-A-55-65944, the compound releasing a nucleating agent at development described in JP-A-60-107029, the thioureas described in JP-A-60-95533, and the spirobisindanes described in JP-A-55-65944.

In addition, in this invention, the use of the nucleating agent shown by formula (N-I) described above is preferred, and the following embodiments (1) to (8) are preferred:

(1) The nucleating agent has an adsorption accelerating group to silver halide represented by $X^1$ as a substituent.

(2) Case (1), wherein the absorption accelerating group to silver halide shown by $X^1$ is composed of a thioamido group, a heterocyclic mercapto group, or a nitrogen-containing heterocyclic ring forming imino silver.

(3) Case (2), wherein the heterocyclic ring completed by Z is quinolinium, isoquinolinium, naphthopyridinium or benzothiazolium.

(4) Case (3), wherein the heterocyclic ring completed by Z is quinolinium.

(5) Case (2), wherein $R^1$, $Z^1$, or Q has an alkynyl group as a substituent.

(6) Case (5), wherein $R^1$ is a propargyl group.

(7) Case (2), wherein $X^1$ is a thiourethane group as a thioamido group or $X^1$ is a mercaptotetrazole as a heterocyclic mercapto group.

(8) Case (6), wherein $R^1$ combines with the heterocyclic ring formed by Z to form a ring.

Also, when using the nucleating agent represented by formula (N-II), it is preferred to employ the following embodiments (1) to (6) in order, and embodiment (7) is particularly preferred:

(1) The nucleating agent has an adsorption accelerating group to silver halide represented by $X^2$ as a substituent.

(2) Case (1), wherein the adsorption accelerating group to silver halide represented by $X^2$ is a heterocyclic mercapto ring or a nitrogen-containing heterocyclic ring forming imino silver.

(3) Case (3), wherein the group shown by $G\text{-}R^{22}$ is a formyl group.

(4) Case (3), wherein $R^{23}$ and $R^{24}$ are each hydrogen.

(5) Case (3), wherein $R^{21}$ is an aromatic group.

(6) Case (2), wherein the heterocyclic mercapto group represented by $X^2$ is 5-mercaptotetrazole or 5-mercapto-1,2,4-triazole.

In this invention, the nucleating agent represented by formula (N-I) and the nucleating agent shown by formula (N-II) can be used together.

In the sensitizing dye for use in this invention represented by formula (I) described above, examples of the nitrogen-containing heterocyclic nucleus completed by Z or $Z_1$ are as follows.

These include thiazole nuclei (e.g., thiazole, 4-methylthiazole, 4-phenylthiazole, 4,5-dimethylthiazole, and 4,5-di-phenylthiazole), benzothiazole nuclei (e.g., benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6 -iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5-ethoxy-6-methylbenzothiazole, tetrahydrobenzothiazole), naphthothiazole nuclei (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]-thiazole, 5-methoxynaphtho[2,3-d]thiazole), selenazole nuclei (e.g., 4-methylselenazole and 4-phenylselenazole), benzoselenazole nuclei (e.g., benzoselenazole, 5-chlorobenzoselenazole, 5-phenylbenzoselenazole, 5-methoxybenzoselenazole, 5-methylbenzoselenazole, and 5-hydroxybenzoselenazole), naphthoselenazole nuclei (e.g., naphtho[2,1-d]selenazole, naphtho[1,2-d]selenazole), oxazole nuclei (e.g., oxazole, 4-methyloxazole, 5-methyloxazole, 4,5-dimethyloxazole), benzoxazole nuclei (e.g., benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5-dimethylbenzoxazole, 5 methoxybenzoxazole, 5,6 dimethoxybenzoxazole, 5-phenylbenzoxazole, 5-carboxybenzoxazole, 5-methoxycarbonylbenzoxazole, 5-acetylbenzoxazole, and 5-hydroxybenzoxazole), naphthoxazole nuclei (e.g., naphtho[2,1-d]oxazole naphtho[1,2-d]oxazole, and naphtho[2,3-d]oxazole), 2-quinoline nuclei, imidazole nuclei, benzimidazole nuclei, 3,3'-dialkylindolenine nuclei, 2-pyridine nuclei, and thiazoline nuclei. Most preferably, at least one of Z and $Z_1$ is thiazole nuclei, thiazoline nuclei, oxazole nuclei, and benzoxazole nuclei.

The alkyl group represented by R or $R_1$ is an alkyl group having not more than 5 carbon atoms (e.g., methyl, ethyl, n-propyl, and n-butyl).

The substituted alkyl group represented by R or $R_1$ is a substituted alkyl group, the alkyl moiety of which has not more than 5 carbon atoms, such as a hydroxyalkyl group (e.g., 2-hydroxyethyl, 3-hydroxypropyl, and 4-hydroxybutyl), a carboxyalkyl group (e.g., carboxymethyl, 2-carboxyethyl, 3-carboxypropyl, 4-carboxybutyl, 2-(2-carboxyethoxy)ethyl), a sulfoalkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 5-methoxy-2-(3-sulfopropoxy)-propyl, 2-[3-sulfopropoxy)ethoxy]ethyl, and 2-hydroxy-3-(3'-sulfopropoxy)propyl), an aralkyl group (the alkyl moiety having preferably from 1 to 5 carbon atoms and the aryl group preferably being a phenyl group, e.g., benzyl, phenethyl phenylpropyl, phenylbutyl, p-tolylpropyl, p-methoxyphenethyl, p-chlorophenethyl, p-carboxybenzyl, p-sulfophenethyl, and p-sulfobenzyl), an aryloxyalkyl group (the alkyl moiety thereof has preferably from 1 to 5 carbon atoms and the aryl group of the aryloxy group is preferably a phenyl group, e.g., phenoxyethyl, phenoxypropyl, phenoxybutyl, p-methylphenoxyethyl, and p-methoxyphenoxypropyl), a vinylmethyl group, an alkoxy alkyl group, a sulfon amido alkyl group and a carbonamido alkyl group.

The aryl group represented by R or $R_1$ includes a phenyl group. In formula (I) described above, $L_1$ and $L_2$ represents a methine group or a substituted methyl group

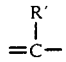

wherein R' represents an alkyl group (e.g., methyl and ethyl), a substituted alkyl group [such as an alkoxyalkyl group (e.g., 2-ethoxyethyl), a carboxyalkyl group (e.g., 2-carboxyethyl), an alkoxycarbonylalkyl (e.g., 2-methoxycarbonylethyl), an aralkyl group (e.g., benzyl and phenethyl), etc.], or an aryl group (e.g., phenyl, p-methoxyphenyl, p-chlorophenyl, and o-carboxyphenyl).

Also, L and R or $L_2$ and $R_1$ may be linked by methine to form a nitrogen-containing heterocyclic ring.

As the substituent bonded to the nitrogen atom at the 3-position of the thiazolinone nucleus or the imidazolinone nucleus formed by Q and $Q_1$, there are, for example, an alkyl group (preferably having from 1 to 8 carbon atoms, e.g., methyl, ethyl, and propyl), an allyl group, an aralkyl group (the alkyl moiety thereof has preferably from 1 to 5 carbon atoms, e.g., benzyl and p-carboxyphenylmethyl), an aryl group (having from 6 to 9 carbon atoms, e.g., phenyl and p-carboxyphenyl), a hydroxyalkyl group (the alkyl moiety has preferably from 1 to 5 carbon atoms, e.g., 2-hydroxyethyl), a carboxyalkyl group (the alkyl moiety thereof has preferably from 1 to 5 carbon atoms, e.g., carboxymethyl), an alkoxycarbonylalkyl group (the alkyl radical of the alkoxy moiety thereof has preferably from 1 to 3 carbon atoms and the alkyl moiety has preferably from 1 to 5 carbon atoms, e.g., methoxycarbonylethyl).

In formula (I), when the dye of formula (I) forms an intramolecular salt, m is 0.

In formula (I) described above, examples of the anion represented by X are halide ions (e.g., iodide, bromide, and chloride), perchlorate ions, thiocyanate ions, benzenesulfonate ions, p-toluenesulfonate ions, methylsulfate ions, and ethylsulfate ions.

Of the sensitizing dyes represented by formula (I) described above, the dyes represented by formula (I-A) are particularly preferred.

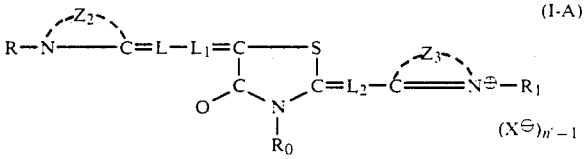

(I-A)

wherein $Z_2$ and $Z_3$, which may be the same or different, each represents a non-metallic atomic group necessary for forming a thiazole nucleus, a benzothiazole nucleus, or a benzoxazole nucleus; $R_0$ represents an alkyl group having from 1 to 6 carbon atoms (e.g., methyl, ethyl, and propyl), an allyl group, or an aralkyl group (the alkyl moiety has preferably from 1 to 5 carbon atoms, e.g., benzyl, p-carboxyphenylmethyl); X' represents an anion and n' represents 1 or 2 and R, $R_1$, L, $L_1$ and $L_2$ are the same as in Formula (I).

Specific examples of the sensitizing dyes for use in this invention are illustrated below but the invention is not to be construed as being limited to them.

I-1
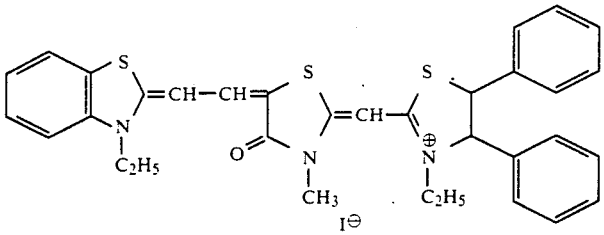
I-2
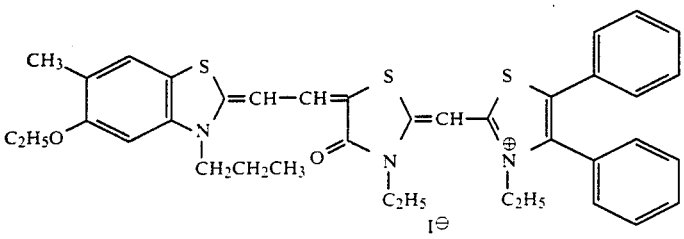
I-3
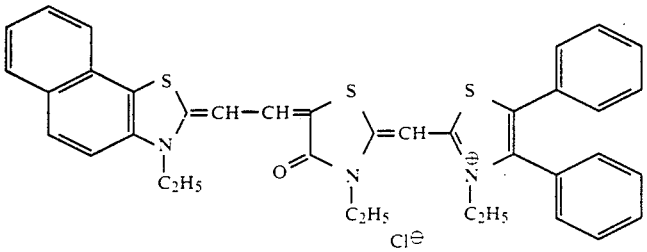
I-4
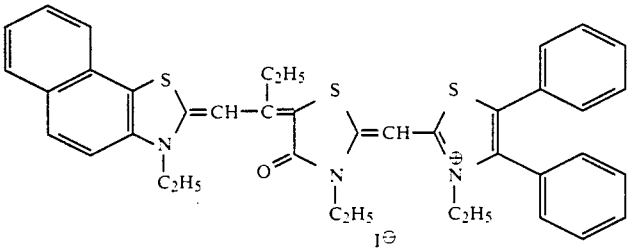
I-5
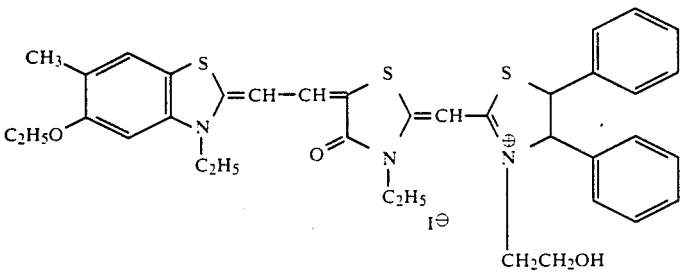
I-6
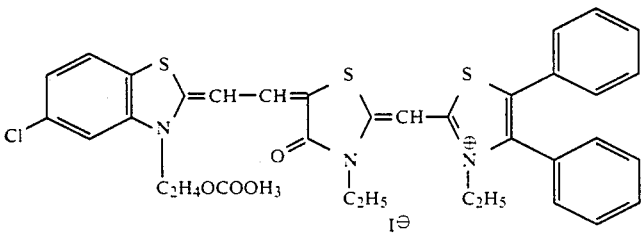

-continued
I-7
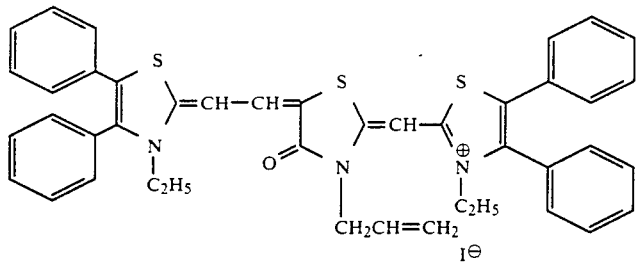
I-8
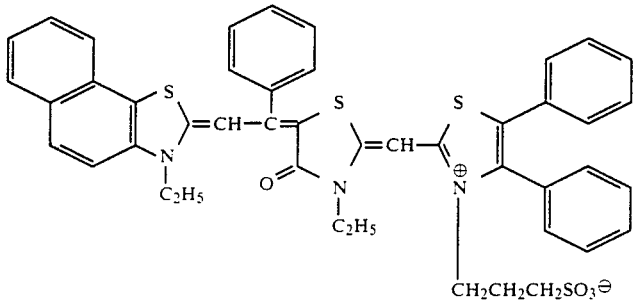
I-9
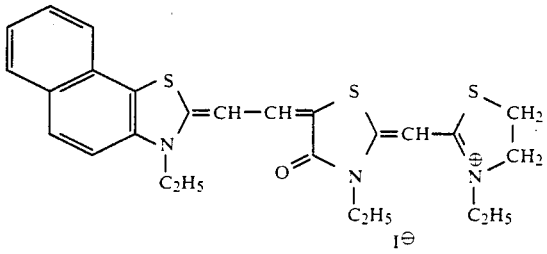
I-10
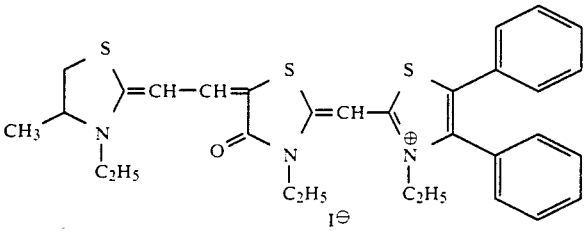
I-11
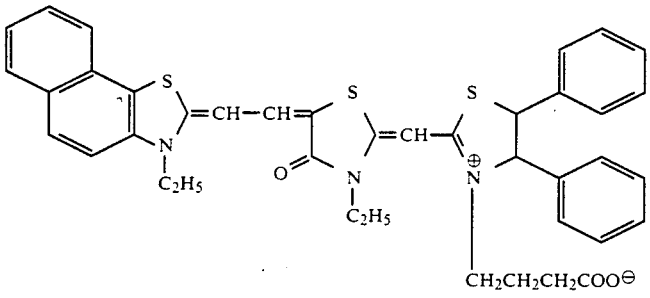
I-12
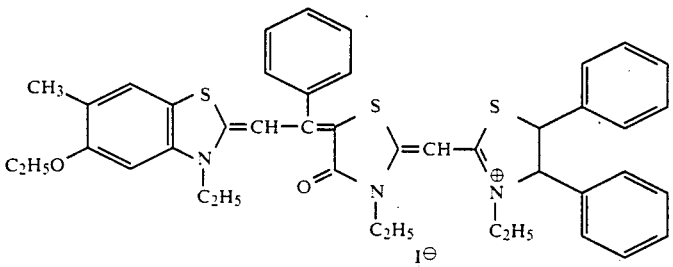

-continued
I-13
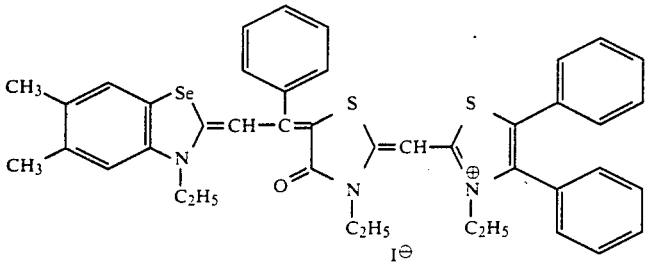
I-14
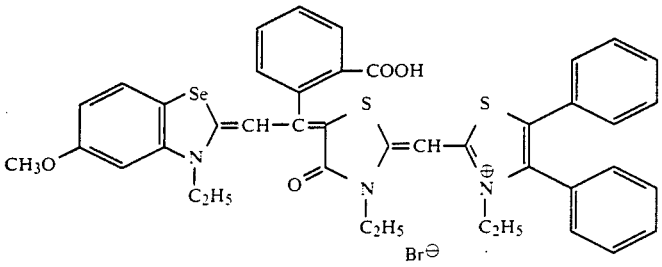
I-15
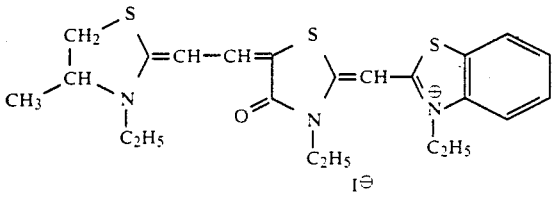
I-16
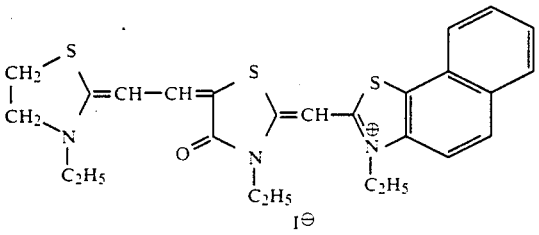
I-17
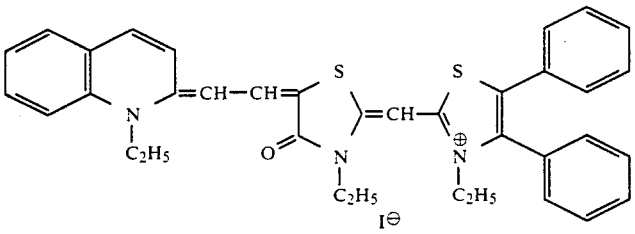
I-18
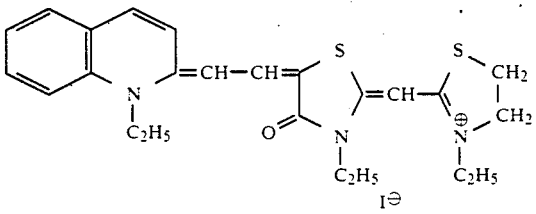

-continued
I-19
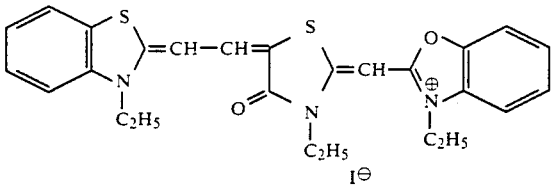
I-20
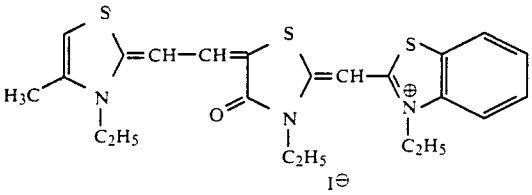
I-21
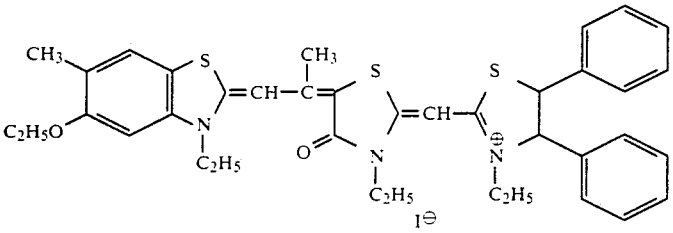
I-22
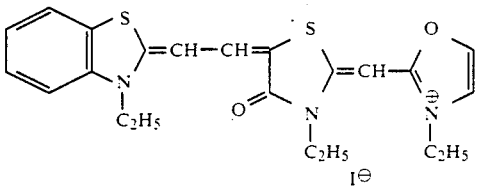
I-23
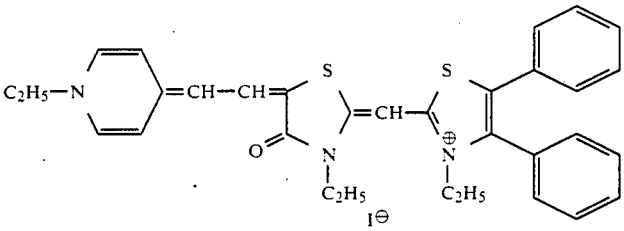
I-24
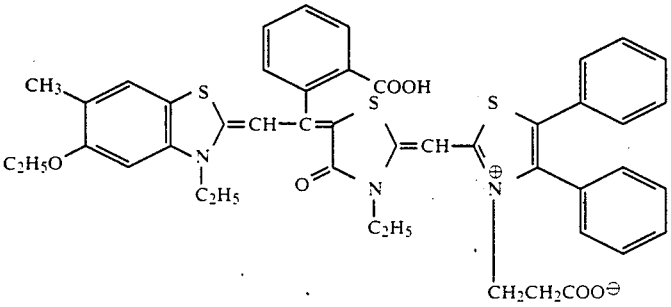

-continued
I-25
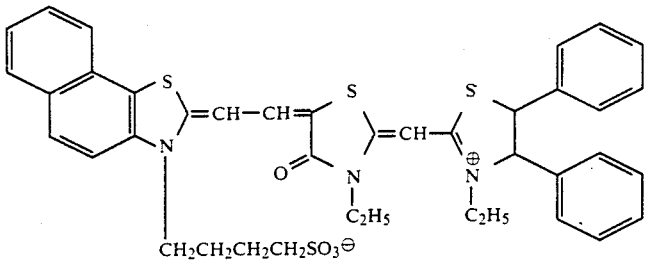
I-26
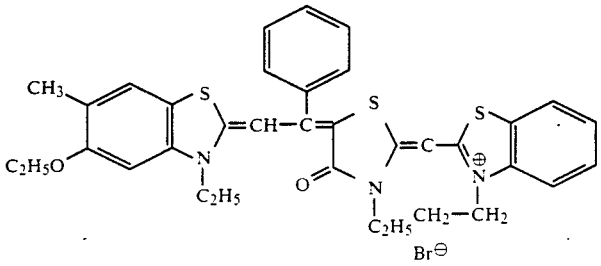
I-27
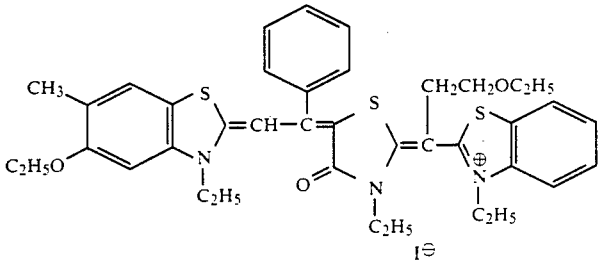
I-28
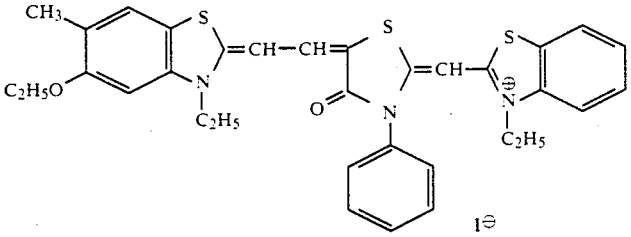
I-29
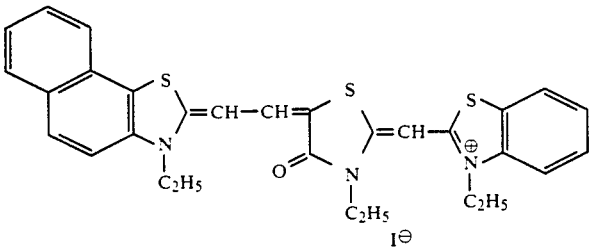
I-30
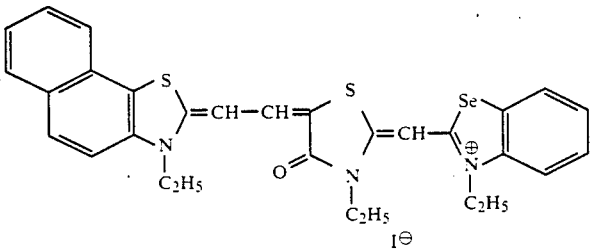

-continued
I-31
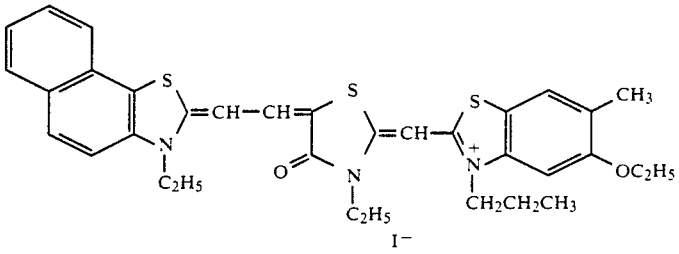
I-32
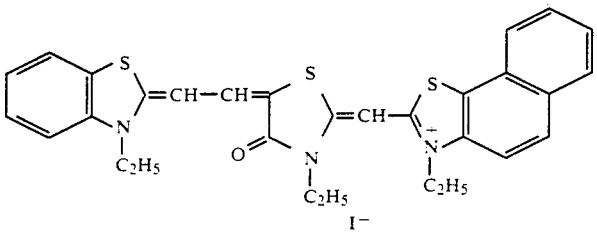
I-33
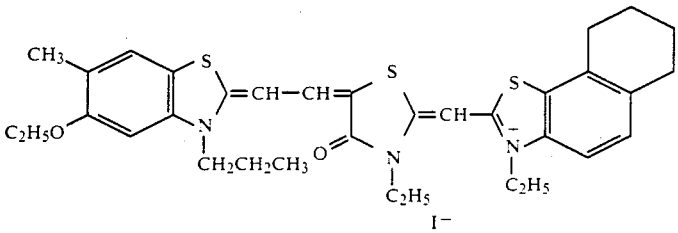
I-34
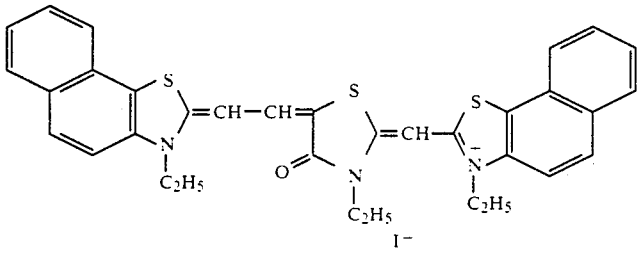
I-35
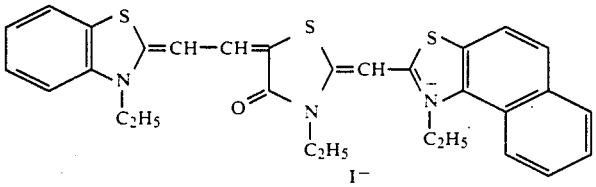
I-36
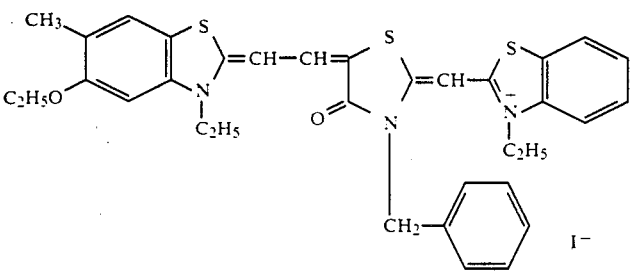

-continued

I-37

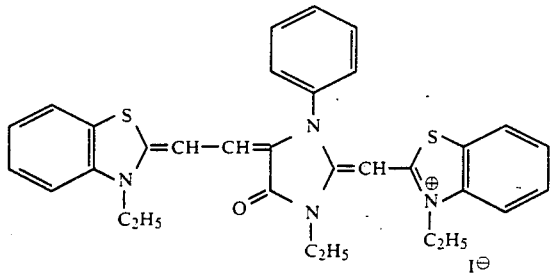

I-38

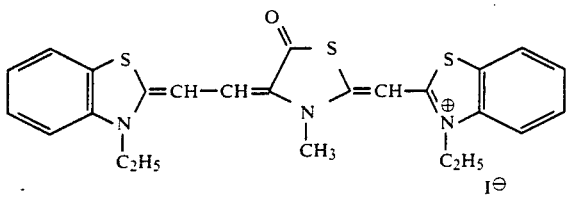

The sensitizing dyes shown by formula (I) or (I-A) described above are known compounds and can be easily synthesized by the methods described in F. M. Hamer, *Cyanine Dye and Related Compounds,* published by Interscience Publishers (1964).

The sensitizing dyes shown by formulae (Ia), (Ia') and (Ib) described above can be easily synthesized by the methods described in U.S. Pat. Nos. 3,482,978 and 2,756,227.

The sensitizing dyes represented by formulae (Ia), (Ia'), and (Ib) described above are now explained in detail.

In formulae (Ia) and (Ia'), $R_{21}$ and $R_{22}$, which may be the same or different, each represents an alkyl group (preferably having from 1 to 8 carbon atoms, e.g., methyl, ethyl, propyl, butyl, pentyl, and heptyl) or a substituted alkyl group [examples of the substituent area a carboxyl group, a sulfo group, a cyano group, a vinyl group, a halogen atom (e.g., fluorine, chlorine, and bromine), a hydroxyl group, an alkoxycarbonyl group (having 8 or less carbon atoms, e.g., methoxycarbonyl, ethoxycarbonyl, and benzyloxycarbonyl), an alkoxy group (having 7 or less carbon atoms, e.g., methoxy, ethoxy, propoxy, butoxy, and benzyloxy), an aryloxy group (e.g., phenoxy and p-tolyloxy), an acyloxy group (having 3 or less carbon atoms, e.g., acetyloxy and propionyloxy), an acyl group (having 8 or less carbon atoms, e.g., acetyl, propionyl, benzoyl, and mesyl), a carbamoyl group (e.g., carbamoyl, N,N-dimethylcarbamoyl, morpholinocarbamoyl, and piperidinocarbamoyl), a sulfamoyl group (e.g., sulfamoyl, N,N-dimethylsulfamoyl, and morpholinosulfonyl), an aryl group (e.g., phenyl, p-hydroxyphenyl, p-carboxyphenyl, p-sulfophenyl, and α-naphthyl). The alkyl moiety of the substituted alkyl group has 1 to 6 carbon atoms. The substituted alkyl group may have 2 or more such substituents.

$R_{20}$ represents hydrogen, methyl, methoxy, or ethoxy.

$R_{23}$ and $R_{24}$ each represents hydrogen, a lower alkyl group (e.g., methyl, ethyl, and propyl), a lower alkoxy group (e.g., methoxy, ethoxy, propoxy, and butoxy), a phenyl group, or a benzyl group.

$R_{25}$ represents hydrogen, a lower alkyl group (e.g., methyl, ethyl, and propyl), a lower alkoxy group (e.g., methoxy, ethoxy, propoxy, and butoxy), a phenyl group, a benzyl group, or

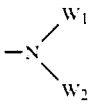

wherein $W_1$ and $W_2$ each represents a substituted or unsubstituted alkyl group (the alkyl moiety having from 1 to 18 carbon atoms, and preferably from 1 to 4 carbon atoms, e.g., methyl, ethyl, propyl, butyl, benzyl, and phenylethyl), or an aryl group (e.g., phenyl, naphthyl, tolyl, and p-chlorophenyl), and $W_1$ and $W_2$ may combine with each other to form a 5- or 6-membered nitrogen-containing heterocyclic ring.

$D_{20}$ represents an atomic group containing a divalent ethylene bond such as, for example, ethylene and triethylene. The ethylene bond may be substituted by one or more groups such as an alkyl group having from 1 to 4 carbon atoms (e.g., methyl, ethyl, propyl, iso-propyl, and butyl), a halogen atom (e.g., chlorine and bromine), and an alkoxy group (having from 1 to 4 carbon atoms, e.g., methoxy, ethoxy, propoxy, isopropoxy, and butoxy).

$D_{21}$ and $D_{22}$ each represents hydrogen and $D_{21}$ and $D_{22}$, however, may form together the divalent ethylene bond having the same significance as described above.

$Z_{20}$ and $Z_{21}$ each represents a non-metallic atomic group necessary for completing a 5- or 6-membered nitrogen-containing heterocyclic ring such as, for example, a thiazole nucleus, e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethyoxycarbonylbenzothiazole, 5-phenetylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole], a selenazole nucleus [e.g., benzoselenazole, 5-methylbenzodelenazole, 5-chlorobenzoselenazole, 5-methoxybenzoselenazole, 5-hydroxybenzoselenazole, naphtho[2,1 -d]selenazole, naphtho[1,2-d]selenazole], an oxazole nucleus [e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 4,6-dimethylbenzoxazole, 5-ethoxybenzoxazole, naphth[2,1-d]oxazole, naphth[1,2-d]oxazole, and naphth[2,3-d]oxazole], a quinoline nucleus [e.g., 2-quinoline, 3-methyl 2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, and 8-fluoro-4-quinoline], a 3,3-dialkylindolenine nucleus [e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, and 3,3-dimethyl-5-chloroindolenine], an imidazole nucleus [e.g., 1-methylbenzoimidazole, 1-ethylbenzimidazole, 1-methyl-5-chlorobenzimidazole, 1-ethyl-5-chlorobenzmidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, and 1-ethylnaphth[1,2-d]imidazole], a pyridine nucleus [e.g., pyridine, 5-methyl 2-pyridine, and 3-methyl-4-pyridine.

Of these nuclei, a thiazole nucleus and an oxazole nucleus are preferred. A benzothiazole nucleus, a naphthothiazole nucleus, a naphthoxazole nucleus, or a benzoxazole nucleus is more preferred.

In formula (Ia), X' represents an acid anion and n' represents 1 or 2.

Particularly useful 4-quinoline-containing dicarbocyanine dyes for use in this invention are represented by formula (Ib).

(IB)

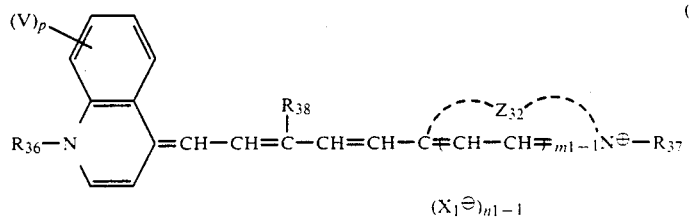

In formula (Ib), $R_{36}$ and $R_{37}$ have the same significance as $R_{21}$ and $R_{22}$, respectively.

$R_{38}$ has the same significance as $R_{23}$ and is preferably a lower alkyl group or a benzyl group.

V represents hydrogen, a lower alkyl group (e.g., methyl, ethyl, and propyl), an alkoxy group (e.g., methoxy, ethoxy, and butoxy), a halogen atom (e.g., fluorine and chlorine), or a substituted alkyl group (e.g., trifluoromethyl and carboxymethyl).

$Z_{32}$ has the same significance as $Z_{20}$ or $Z_{21}$.

$X_1$ has the same significance as X'.

Also, m, $n_1$, and p each represents 1 or 2.

Specific examples of the sensitizing dyes for use in this invention are illustrated below, but the invention is not to be construed as being limited to them.

(Ia-1)

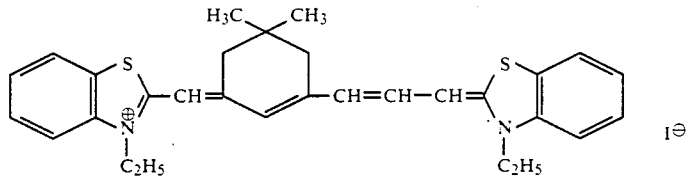

(Ia-2)

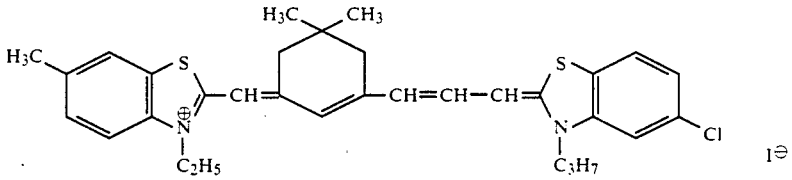

(Ia-3)

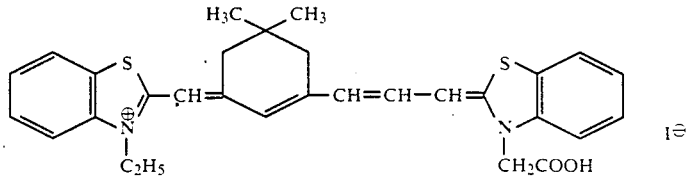

-continued
(Ia-4)
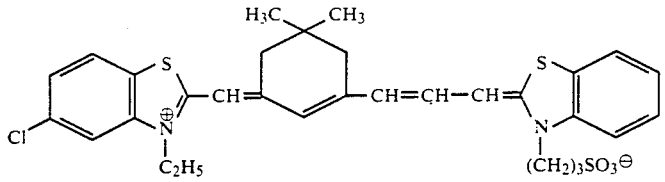
(Ia-5)
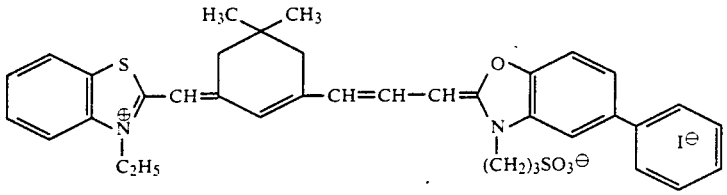
(Ia-6)
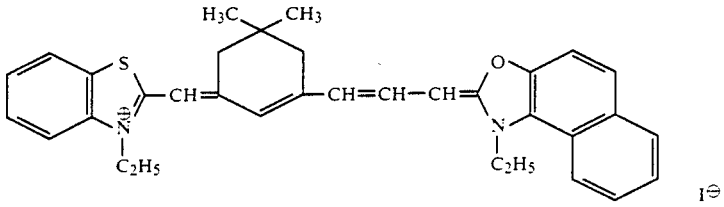
(Ia-7)
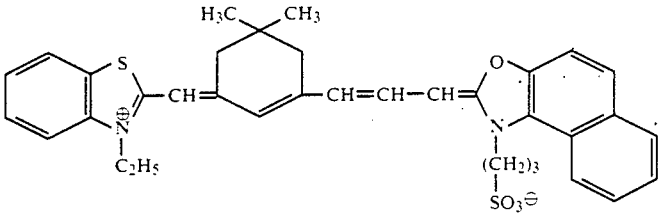
(Ia-8)
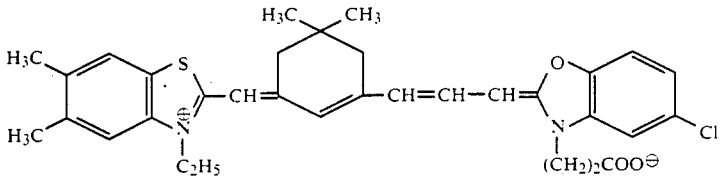
(Ia-9)
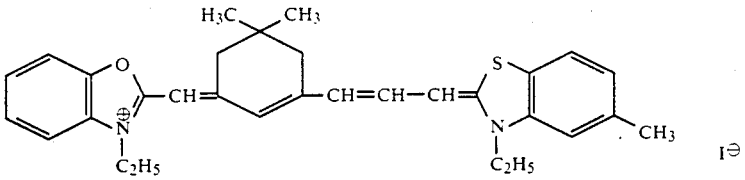
(Ia-10)
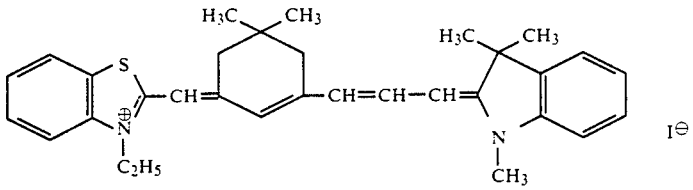
(Ia-11)
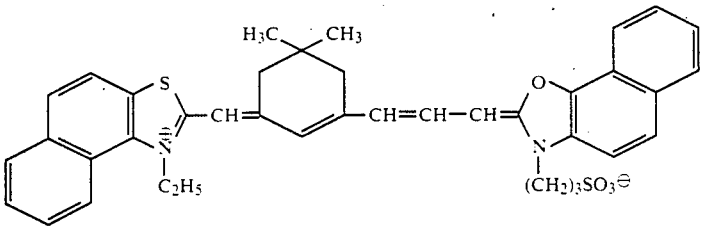

-continued
(Ia-12)
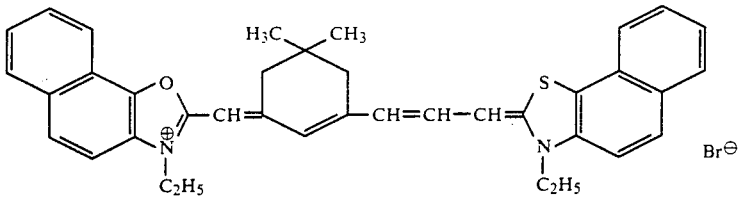
(Ia-13)
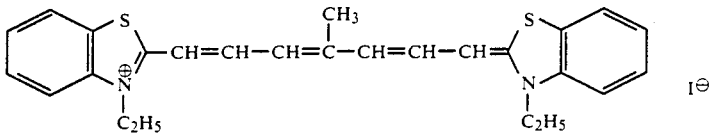
(Ia-14)
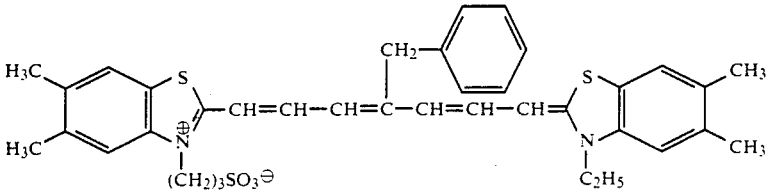
(Ia-15)
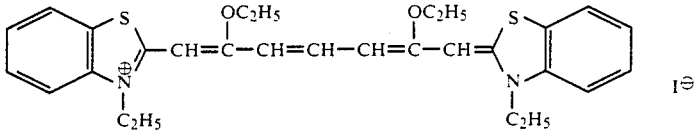
(Ia-16)
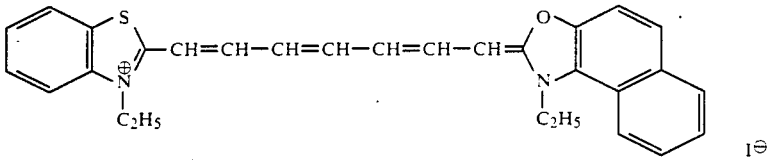
(Ia-17)
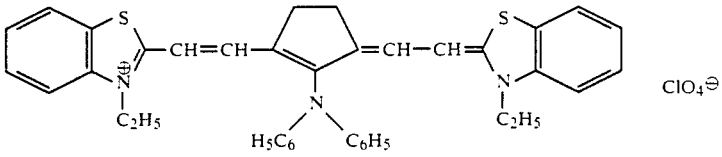
(Ia-18)
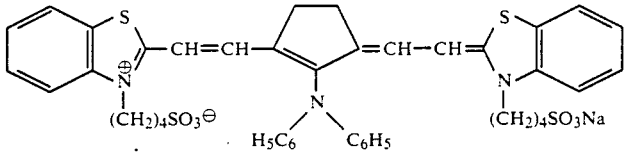
(Ia-19)
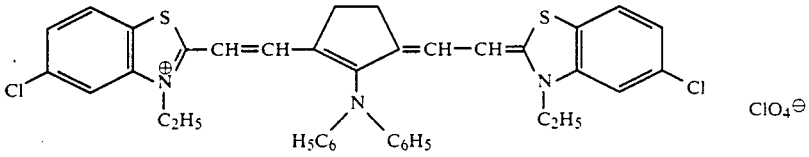
(Ia-20)
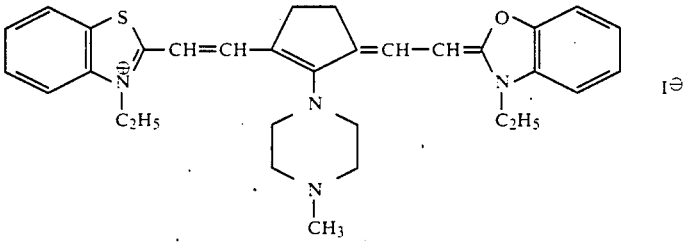

-continued
(Ia-21)
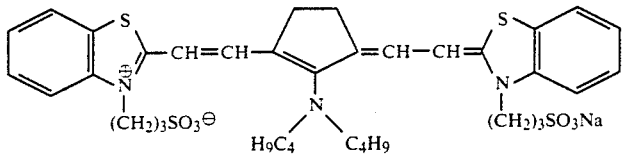
(Ia-22)
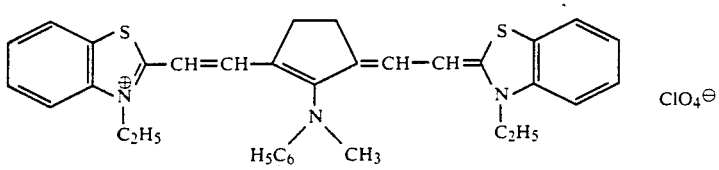
(Ib-1)
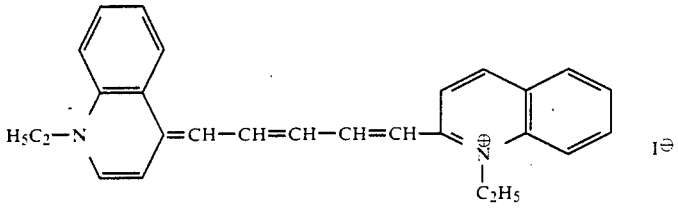
(Ib-2)
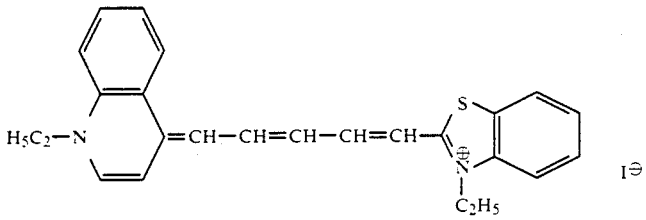
(Ib-3)
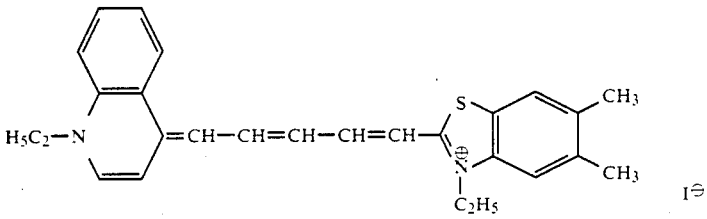
(Ib-4)
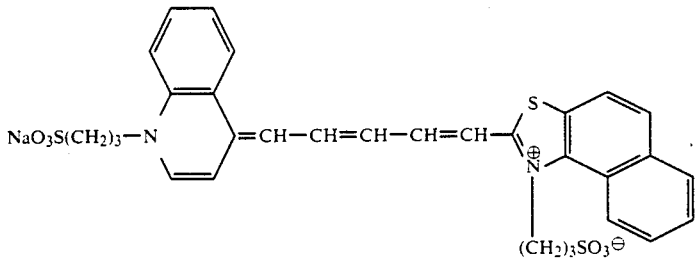
(Ib-5)
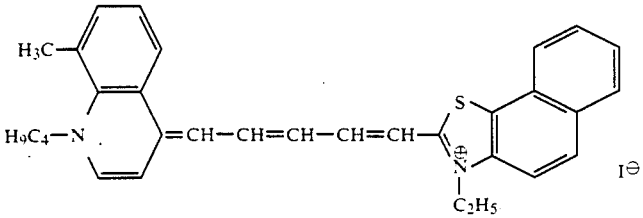

-continued
(Ib-6)
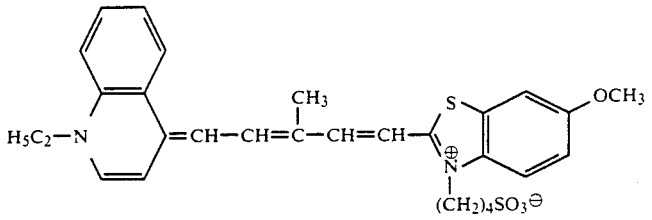
(Ib-7)
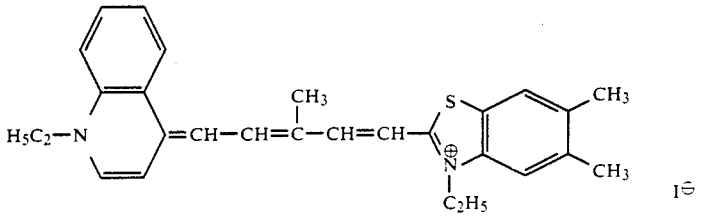
(Ib-8)
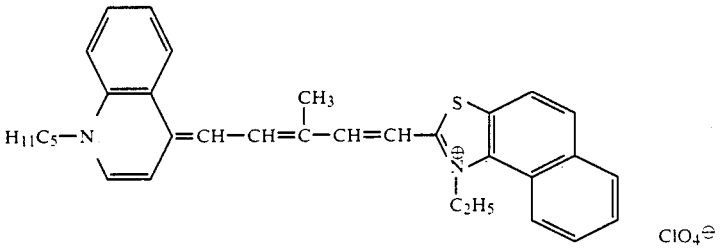
(Ib-9)
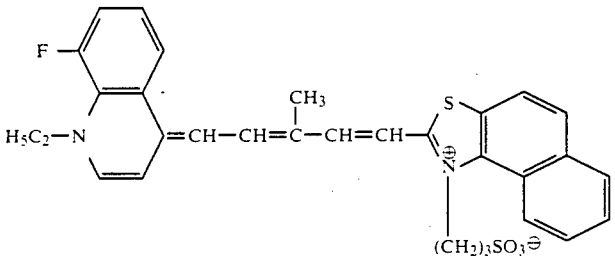
(Ib-10)
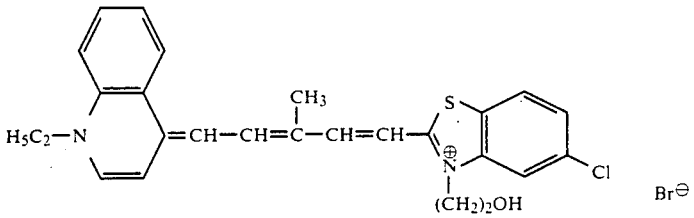
(Ib-11)
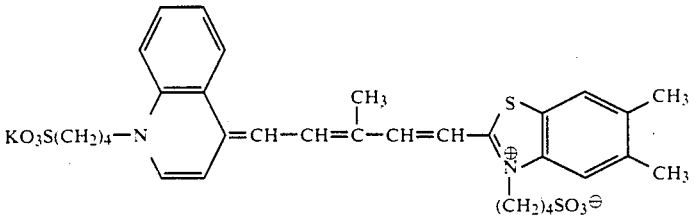

-continued
(Ib-12)
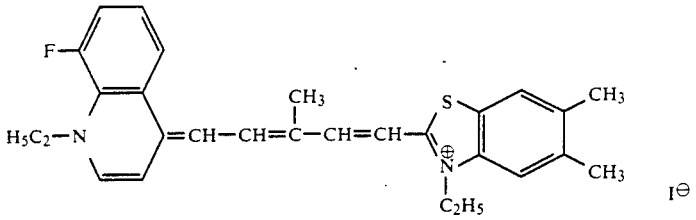
(Ib-13)
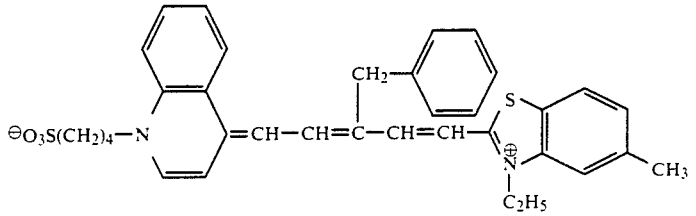
(Ib-14)
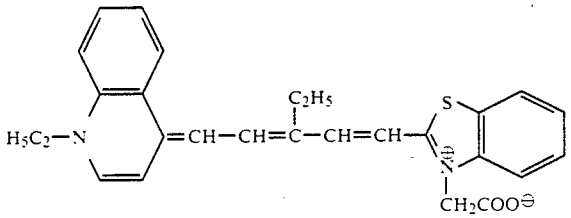
(Ib-15)
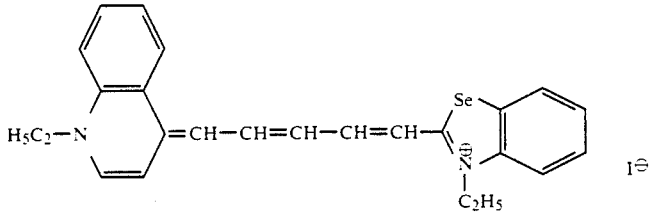
(Ib-16)
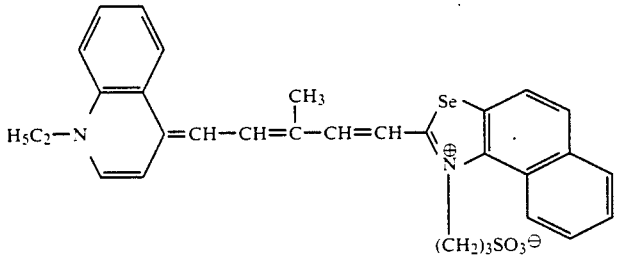
(Ib-17)
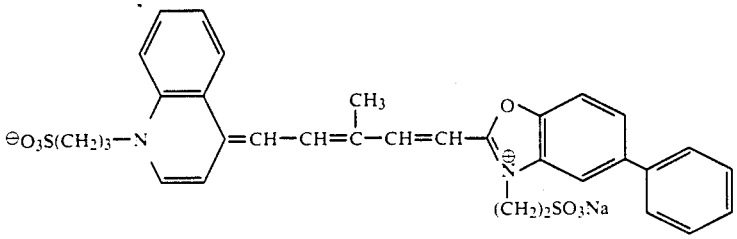

-continued (Ib-18)

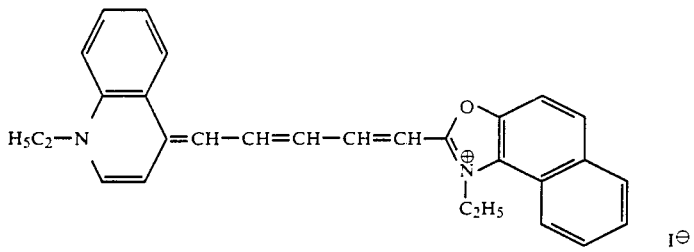

(Ib-19)

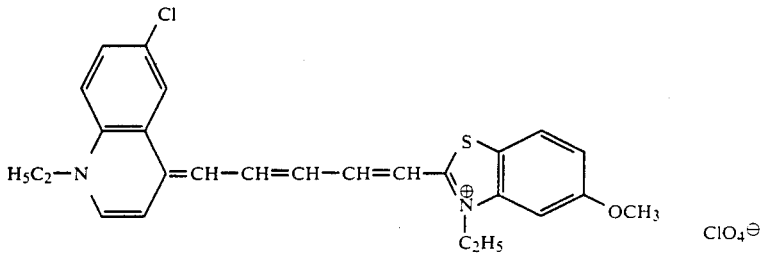

(Ib-20)

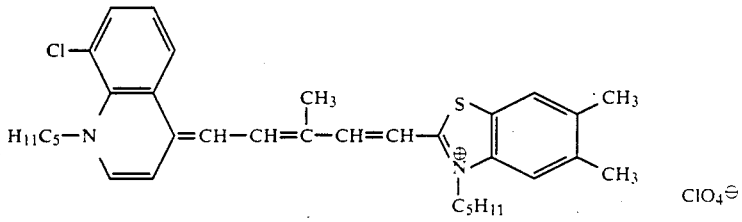

The nucleation accelerators which are advantageously used in this invention are represented by formula (II)

$$A\text{-}(Y)_{n2}\text{-}B]_{m2} \qquad \text{(II)}$$

wherein A represents an adsorption accelerating group for silver halide.

As the group adsorbing to silver halide, there are a compound having a mercapto group bonded to a heterocyclic ring, a heterocyclic compound capable of forming imino silver, and a hydrocarbon compound having a mercapto group.

Examples of the mercapto compound bonded to a heterocyclic ring are substituted or unsubstituted mercaptoazoles (e.g., 5-mercaptotetrazoles, 3-mercapto-1,2,4-triazoles, 2-mercaptoimidazoles, 2-mercapto-1,3,4-thiadiazoles, 5-mercapto-1,2,4-thiadiazoles, 2-mercapto-1,3,4-oxadiazoles, 2-mercapto-1,3,4-selenadiazoles, 2-mercaptoxazoles, 2-mercaptothiazoles, 2-mercaptobenzoxazoles, 2-mercaptobenzimidazoles, and 2-mercaptobenztriazoles) and substituted or unsubstituted mercaptopyrimidines (e.g., 2-mercaptopyrimidines).

Examples of the heterocyclic compound capable of forming imino silver are indazoles, benzimidazoles, benztriazoles, benzoxazoles, benzthiazoles, imidazoles, thiazoles, oxazoles, triazoles, tetrazoles, azaindenes, pyrazoles, and indoles. Each may be substituted.

As the hydrocarbon compounds having a mercapto group, there are, for example, alkylmercaptans, arylmercaptans, alkenylmercaptans, and aralkylmercaptans.

In formula (II), Y represents a divalent linkage group composed of an atom or an atomic group selected from hydrogen, carbon atom, nitrogen atom, oxygen atom, and sulfur atom. Examples of the divalent linkage group are

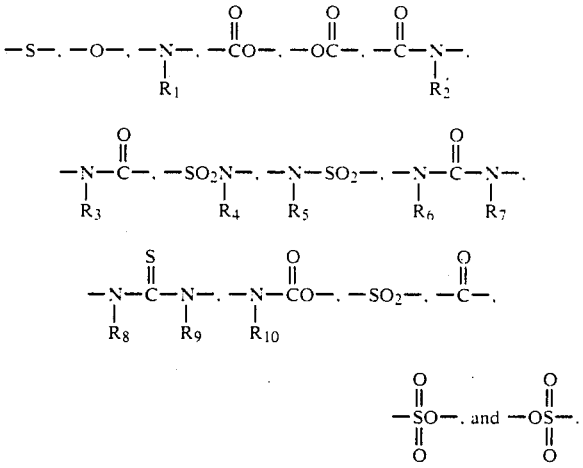

Each of these linkage groups may be bonded to a heterocyclic ring as described below through a straight chain or branched alkylene group (e.g., methylene, ethylene, propylene, butylene, hexylene, and 1-methylethylene) or a substituted or unsubstituted arylene group (e.g., phenylene and naphthylene).

In these formulae, $R_1$, $R_2$, $R_3$, $R_4$, $R_5$, $R_6$, $R_7$, $R_8$, $R_9$ and $R_{10}$ each represents hydrogen, a substituted or unsubstituted alkyl group (e.g., methyl, ethyl, propyl, and n-butyl), a substituted or unsubstituted aryl group (e.g., phenyl and 2-methylphenyl), a substituted or unsubstituted alkenyl group (e.g., propenyl and 1-methylvinyl), or a substituted or unsubstituted aralkyl group (e.g., benzyl and phenethyl).

In formula (II), B represents an organic group containing at least one of a thioether group, an amino group (including a salt thereof), an ammonium group, an ether group, and a heterocyclic group (including a salt thereof), these groups in combination with a group selected from a substituted or unsubstituted alkyl group, a substituted or unsubstituted alkenyl group, a substituted or unsubstituted aralkyl group and a substituted or unsubstituted aryl group.

Specific examples of the organic group are the hydrochlorides of dimethylaminoethyl, aminoethyl, diethylaminoethyl, dibutylaminoethyl, or dimethylaminopropyl; as well as dimethylaminoethylthioethyl, 4-dimethylaminophenyl, 4-dimethylaminobenzyl, methylthioethyl, ethylthiopropyl, 4-methylthio-3-cyanophenyl, methylthiomethyl, trimethylammonioethyl, methoxyethyl, methoxyethoxyethoxyethyl, methoxyethylthioethyl, 3,4-dimethoxyphenyl, 3-chloro-4-methoxyphenyl, morpholinoethyl, 1-imidazolylethyl, morpholinoethylthioethyl, pyrrolidinoethyl, piperidinopropyl, 2-pyridylmethyl, 2-(1-imidazolyl)ethylthioethyl, pyrazolylethyl, triazolylethyl, and methoxyethoxyethoxyethoxycarbonylaminoethyl.

In formula (II), $n_2$ represents 0 or 1 and $m_2$ represents 1 or 2.

Of the compounds represented by formula (II) described above, the compounds represented by formulae (III) to (VIII) are preferred.

(III)

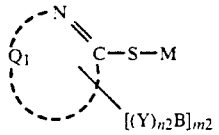

wherein $Q_1$ represents an atomic group necessary for forming a 5- or 6-membered heterocyclic ring containing at least one of carbon, nitrogen, oxygen, sulfur, and selenium.

Examples of the heterocyclic ring are tetrazoles, triazoles, imidazoles, thiadiazoles, oxadiazoles, selenadiazoles, oxazoles, thiazoles, benzoxazoles, benzothiazoles, benzimidazoles, and pyrimidines.

In formula (III), M represents hydrogen, an alkali metal atom (e.g., sodium and potassium), an ammonium group (e.g., trimethylammonium and dimethylbenzylammonium), or a group capable of forming hydrogen or an alkali metal atom under an alkaline condition (e.g., acetyl, cyanoethyl, and methanesulfonylethyl).

Each of the heterocyclic rings may be substituted by a nitro group, a halogen atom (e.g., chlorine and bromine), a mercapto group, a cyano group, a substituted or unsubstituted alkyl group (e.g., methyl, ethyl, propyl, t-butyl, and cyanoethyl), a substituted or unsubstituted aryl group (e.g., phenyl, 4-methanesulfonamidophenyl, 4-methylphenyl, 3,4-dichlorophenyl, and naphthyl), a substituted or unsubstituted alkenyl group (e.g., allyl), a substituted or unsubstituted aralkyl group (e.g., benzyl, 4-methylbenzyl, and phenethyl), a substituted or unsubstituted sulfonyl group (e.g., methanesulfonyl, ethanesulfonyl, and p-toluenesulfonyl), a substituted or unsubstituted carbamoyl group (e.g., carbamoyl, methylcarbamoyl, and phenylcarbamoyl), a substituted or unsubstituted sulfamoyl group (e.g., sulfamoyl, methylsulfamoyl, and phenylsulfamoyl), a substituted or unsubstituted carbonamido group (e.g., acetamido, benzamido), a substituted or unsubstituted sulfonamido group (e.g., methanesulfonamido, benzenesulfonamido, and p-toluenesulfonamido), a substituted or unsubstituted acyloxy group (e.g., acetyloxy and benzoyloxy), a substituted or unsubstituted sulfonyloxy group (e.g., methanesulfonyloxy), a substituted or unsubstituted ureido group (e.g., ureido, methylureido, ethylureido, and phenylureido), a substituted or unsubstituted thioureido group (e.g., thioureido and methylthioureido), a substituted or unsubstituted acyl group (e.g., acetyl and benzoyl), a substituted or unsubstituted oxycarbonyl group (e.g., methoxycarbonyl and phenoxycarbonyl), a substituted or unsubstituted oxycarbonylamino group (e.g., methoxycarbonylamino, phenoxycarbonylamino, and 2-ethylhexyloxycarbonylamino), carboxylic acids or the salts thereof, sulfonic acids or the salts thereof, or a hydroxyl group. In this case, however, it is preferred due to the nucleation accelerating effect that the heterocyclic ring is not substituted by the carboxylic acid or the salt thereof, sulfonic acid or the salt thereof, or the hydroxyl group.

The heterocyclic ring shown by $Q_1$ of formula (III) is preferably a tetrazole, triazole, imidazole, thiadiazole, and oxadiazole.

In formula (III) described above, Y, B, $m_2$ and $n_2$ have the same definition as in formula (II).

(IV)

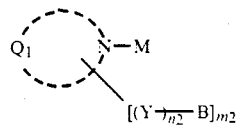

wherein Y, B, $m_2$, $n_2$, and M have the same definition as in formula (III) and Q'' represents an atomic group necessary for forming a 5- or 6-membered heterocyclic ring capable of forming imino silver, and preferably is an atomic group necessary for forming a 5- or 6-membered heterocyclic ring composed of atoms selected from carbon, nitrogen, oxygen, and selenium. Also, the heterocyclic ring may be condensed with a carbon aromatic ring or a heterocyclic aromatic ring. Examples of the heterocyclic ring formed by Q'' are indazoles, benzimidazoles, benzotriazoles, benzoxazoles, benzothiazoles, imidazoles, thiazoles, oxazoles, thiazoles, tetrazoles, tetraazaindenes, triazaindenes, diazaindenes, pyrazoles, and indoles.

(V)

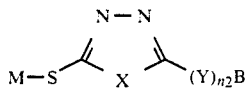

wherein M, B, Y, and $n_2$ have the same definition as in formula (III) and X represents oxygen, sulfur, or selenium, and is preferably sulfur.

(VI)

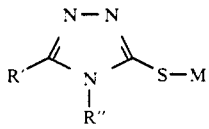

wherein R' represents hydrogen, a halogen atom (e.g., chlorine and bromine), a nitro group, a mercapto group, an unsubstituted amino group, a substituted or unsubstituted alkyl group (e.g., methyl and ethyl), a substituted or unsubstituted alkenyl group (e.g., propenyl and 1-methylvinyl), a substituted or unsubstituted aralkyl group (e.g., benzyl and phenethyl), a substituted or unsubstituted aryl group (e.g., phenyl and 2-methylphenyl), or $-(Y)_{n2}B$.

R'' represents hydrogen, an unsubstituted amino group or $-(Y)_{n2}B$ and when R' and R'' represent $-(Y)_{n2}B$, they may be the same or different. At least one of R'and R'', however, represents $-(Y)_{n2}B$.

M, B, Y, and $n_2$ have the same definition as in formula (III).

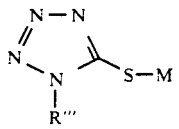

(VII)

wherein R'' represents $-(Y)_{n2}$ B and M, B, Y, and $n_2$ have the same definition as in formula (III).

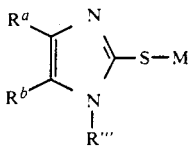

(VIII)

wherein $R^a$ and $R^b$, which may be the same or different, each represents hydrogen, a halogen atom (e.g., chlorine and bromine), a substituted or unsubstituted amino group (e.g., amino and methylamino), a nitro group, a substituted or unsubstituted alkyl group (e.g., methyl and ethyl), a substituted or unsubstituted alkenyl group (e.g., propenyl and 1-methylvinyl), a substituted or unsubstituted aralkyl group (e.g., benzyl and phenethyl), or a substituted or unsubstituted aryl group (e.g., phenyl and 2-methylphenyl).

M and R''', have the same significance as those in aforesaid formula (VII).

Specific examples of the compounds represented by formulae (II) to (VIII) used in this invention are illustrated below but the invention is not to be construed as being limited thereto.

II-1

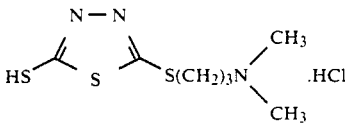

II-2

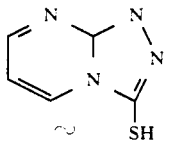

II-3

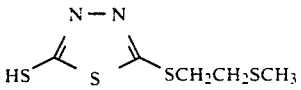

II-4

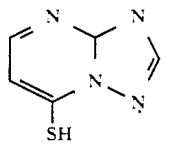

-continued

II-5

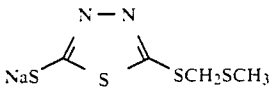

II-6

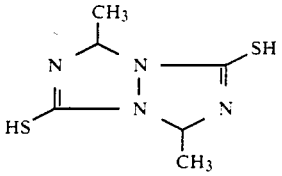

II-7

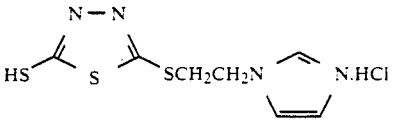

II-8

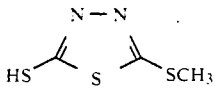

II-9

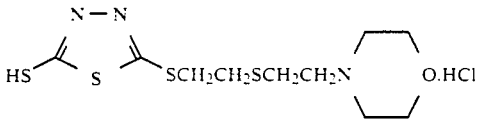

II-10

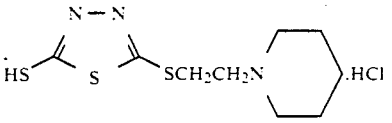

II-11

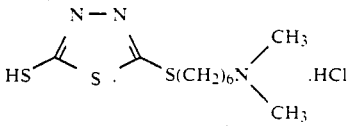

II-12

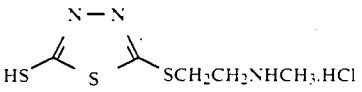

II-13

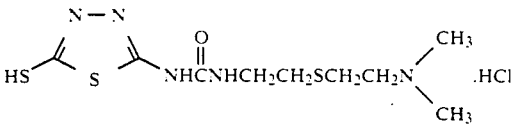

II-14

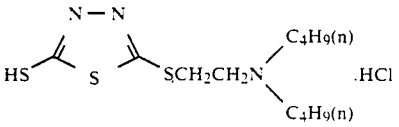

II-15

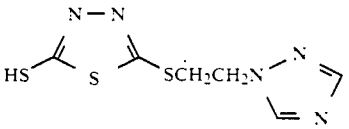

II-16

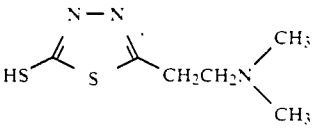

-continued
II-17
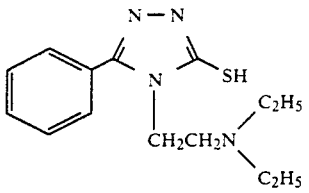
II-18
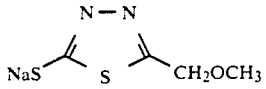
II-19
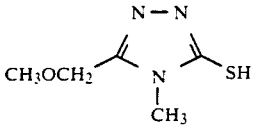
II-20
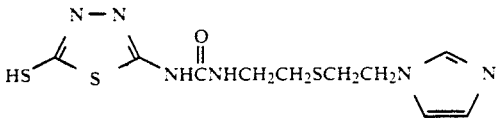
II-21
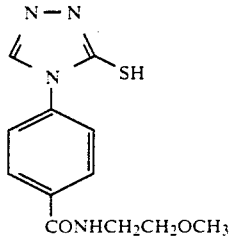
II-22
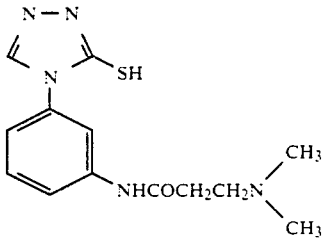
II-23
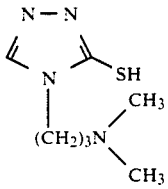
II-24
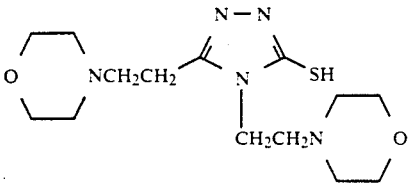
II-25
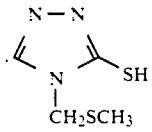
-continued
II-26
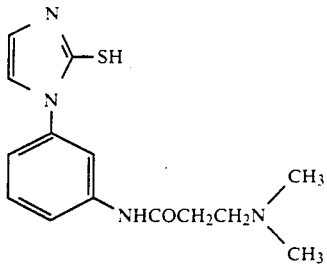
II-27
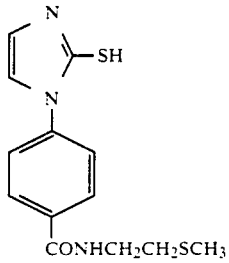
II-28
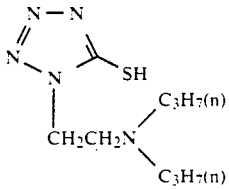
II-29
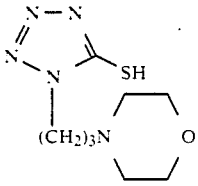
II-30
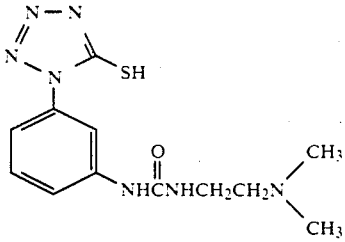
II-31
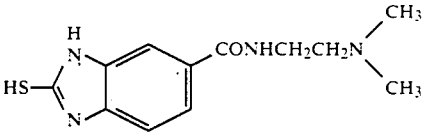
II-32
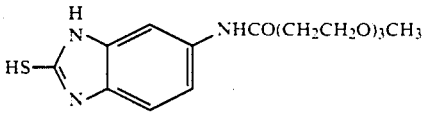
II-33
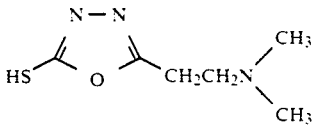

-continued

II-34

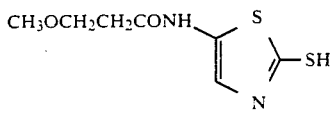

II-35

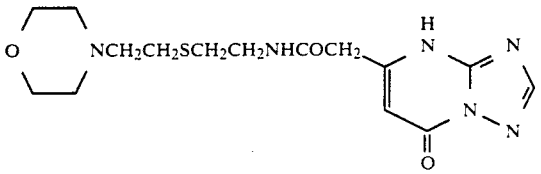

II-36

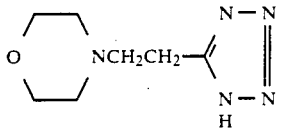

II-37

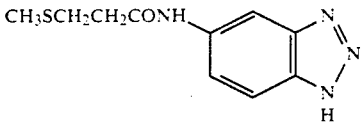

II-38

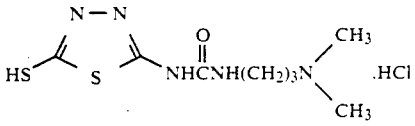

II-39

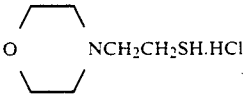

II-40

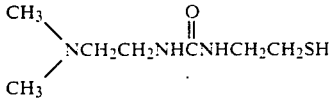

II-41

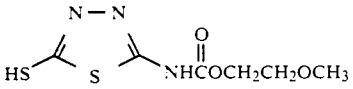

II-42

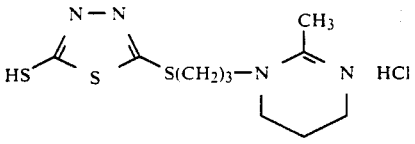

The nucleation accelerators for use in this invention can be synthesized by the methods described in *Berichte der Deutschen Chemischen Gesellschaft*, 28, 77 (1985), JP-A-50-37436 and JP-A-51-3231, U.S. Pat. Nos. 3,295,976 and 3,376,310, *Berichte der Deutschen Gesellschaft*, 22, 568 (1889), ibid., 29, 2483 (1896), *Journal of Chemical Society*, 1932 1806, *Journal of the American Chemical Society*, 71, 4000 (1949), U.S. Pat. Nos. 2,585,388 and 2,541,924, *Advance in Heterocyclic Chemistry*, 9, 165 (1968), *Organic Synthesis*, IV, 569 (1963), *Journal of the American Chemical Society*, 45, 2390 (1923), *Chemische Berichte*, 9, 465 (1876), JP-B-40-28496 and JP-B-43-4135, JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599, 3,148,066, 3,615,616, 3,420,664, 3,071,465, 2,444,605, 2,444,606, 2,555,607, and 2,935,404, and Japanese Patent Application No. 62-145932.

The nucleating accelerator can be incorporated in the photographic light-sensitive material or a processing solution, but is preferably incorporated in the internal latent image type silver halide emulsion or other hydrophilic colloid layers (interlayer and protective layer) of the photographic light sensitive material. It is particularly preferred that the nucleating accelerator is present in the silver halide emulsion layer or a layer adjacent thereto.

The addition amount of the nucleating accelerator is preferably from $10^{-6}$ to $10^{-2}$ mol, and more preferably from $10^{-5}$ to $10^{-2}$ mol per mol of silver halide in the layer or adjacent layer.

Also, when the nucleation accelerator is added to a processing solution, i.e., to a developer or a pre-bath thereof, the amount thereof is preferably from $10^{-8}$ to $10^{-3}$ mol, and more preferably from $10^{-7}$ to $10^{-4}$ mol per liter of the solution.

In this invention, it is particularly preferred that the sensitizing dye represented by formulae (I), (Ia), (Ia') or (Ib) described above is used together with a sensitizing dye shown by formula (IX)

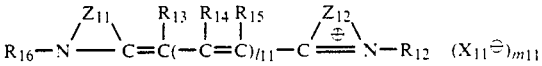

(IX)

The sensitizing dye of formula (IX) is a cyanine dye having the longest wavelength absorption maximum of silver halide of not longer than 590 nm.

In the formula, $Z_{11}$ and $Z_{12}$, which may be the same or different, each represents an atomic group forming a 5- or 6-membered nitrogen-containing heterocyclic ring and $l_{11}$ represents 0 or 1.

The heterocyclic nucleus is preferably as follows.

When $l_{11}$ is 0, $Z_{11}$ and $Z_{12}$, which may be the same or different, each is thiazole, benzothiazole, naphthothiazole, dihydronaphthothiazole, selenazole, benzoselenazole, naphthoelenazole, dihydronaphthoselenazole, oxazole, benzoxazole, naphthoxazole, benzimidazole, naphthimidazole, pyridine, quinoline, imidazo[4,5-b]quinozaline or 3,3-dialkylindolenine.

When $l_{11}$ is 1, $Z_{11}$ is thiazoline, thiazole, benzothiazole, selenazoline, selenazole, benzselenazole, oxazole, benzoxazole, naphthoxazole, imidazole, benzimidazole, naphthimidazole, or pyrroline; $Z_{12}$ is oxazoline, oxazole, benzoxazole, naphthoxazole, thiazoline, selenazoline, pyrroline, benzimidazole, or naphthimidazole.

The nitrogen-containing heterocyclic nucleus represented by $Z_{11}$ or $Z_{12}$ may have one or more substituents. Examples of the preferred substituent are a lower alkyl group which may be branched or further substituted by a substituent (e.g., a hydroxy group, a halogen atom, an aryl group, an aryloxy group, an arylthio group, a carboxy group, an alkoxy group, an alkylthio group, an alkoxycarbonyl group) and is more preferably an alkyl group having from 1 to 10 carbon atoms (e.g., methyl, ethyl, butyl, chloroethyl, 2,2,3,3-tetrafluoropropyl, hydroxyl, benzyl, tolylethyl, phenoxyethyl, phenylthioethyl, carboxypropyl, methoxyethyl, ethylthioethyl, and ethoxycarbonylethyl); a lower alkoxy group which may be substituted with a substituent described above for the alkyl group, and is more preferably an alkoxy group having not more than 8 carbon atoms (e.g., methoxy, ethoxy, pentyloxy, ethoxymethoxy, methylethoxy, phenoxyethoxy, hydroxyethoxy, and chloro-propoxy); a hydroxyl group, a halogen atom, a cyano group, an aryl group (e.g., phenyl, tolyl, anisyl, chlorophenyl, and carboxyphenyl); an aryloxy group (e.g., tolyloxy, anisyloxy, phenoxy, and chlorophenoxy); an arylthio group (e.g., tolylthio, chlorophenylthio, and phenylthio); a lower alkylthio group which may be further substituted by a substituent described above for the lower alkyl group.

Examples of preferred substituents are an alkylthio group having not more than 8 carbon atoms (e.g., methylthio, ethylthio, hydroxyethylthio, carboxyethylthio, chloroethylthio, and benzylthio), an acylamino group (more preferably an acylamino group having not more than 8 carbon atoms, e.g., acetylamino, benzoylamino, methanesulfonylamino, benzenesulfonylamino), a carboxy group, a lower alkoxycarbonyl group (more preferably an alkoxycarbonyl group having in total not more than 6 carbon atoms, e.g., ethoxycarbonyl and butoxycarbonyl), a perfluoroalkyl group (more preferably a perfluoroalkyl group having in total not more than 5 carbon atoms, e.g., trifluoromethyl and difluoromethyl), and an acyl group (more preferably an acyl group having in total not more than 8 carbon atoms, e.g., acetyl, propionyl, benzoyl, and benzenesulfonyl).

Specific examples of the nitrogen-containing heterocyclic nucleus represented by $Z_{11}$ and $Z_{12}$ are thiazoline, 4-methylthiazoline, thiazole, 4-methylthiazole, 4,5-dimethylthiazole, 4-phenylthiazole, benzothiazole, 5-methylbenzothiazole, 6-methylbenzothiazole, 5-ethylbenzothiazole, 5,6-dimethylbenzothiazole, 5-methoxybenzothiazole, 6-methoxybenzothiazole, 5-butoxybenzothiazole, 5,6-dimethoxybenzothiazole, 5-methoxy-6-methylbenzothiazole, 5-chlorobenzothiazole, 5-chloro-6-methylbenzothiazole, 5-phenylbenzothiazole, 5-acetylaminobenzothiazole, 6-propionylaminobenzothiazole, 5-hydroxybenzothiazole, 5-hydroxy-6-methylbenzothiazole, 5-ethoxycarbonylbenzothiazole, 5-carboxybenzothiazole, naphtho[1,2-d]thiazole, naphtho[2,1-d]thiazole, 5-methylnaphtho[1,2-d]thiazole, 8-methoxynaphtho[1,2-d]thiazole, 8,9-dihydronaphthothiazole, 3,3-diethylindolenine, 3,3-dipropylindolenine, 3,3-dimethylindolenine, 3,3,5-trimethylindolenine, selenazoline, selenazole, benzoselenazole, 5-methylbenzoselenazole, 6-methylbenzoselenazole, 5-methoxybenzoselenazole, 6 methoxybenzoselenazole, 5-chlorobenzoselenazole, 5,6-dimethylbenzoselenazole, 5-hydroxybenzoselenazole, 5-hydroxy-6-methylbenzoselenazole, 5,6-dimethoxybenzoselenazole, 5-ethoxycarbonylbenzoselenazole, 5-ethoxycarbonylbenzoselenazole, naphtho[1,2-d]selenazole, naphtho[2,1-d]selenazole, oxazole, 4-methyloxazole, 4,5-dimethyloxazole, 4-phenyloxazole, benzoxazole, 5-hydroxybenzoxazole, 5-methoxybenzoxazole, 5-phenylbenzoxazole, 5-phenethylbenzoxazole, 5-phenoxybenzoxazole, 5-chlorobenzoxazole, 5-chloro-6-methylbenzoxazole, 5-phenylthiobenzoxazole, 6-ethoxy-5-hydroxybenzoxazole, 6-methoxybenzoxazole, naphth[1,2-d]oxazole, naphth[2,1-d]oxazole, naphth[2,3-d]oxazole, 1-ethyl-5-cyanobenzimidazole, 1-ethyl-5-chlorobenzimidazole, 1-ethyl-5,6-dichlorobenzimidazole, 1-ethyl-6-chloro-5-cyanobenzimidazole, 1-ethyl-6-chloro-5 trifluoromethylbenzimidazole, 1-propyl-5-butoxycarbonylbenzimidazole, 1-benzyl-5-methylsulfonylbenzimidazole, 1-allyl-5-chloro-6-acetylbenzimidazole, 1-ethylnaphth[1,2-d]imidazole, 1-ethyl-6-chloronaphth[2,3-d]imidazole, 2-quinoline, 4-quinoline, 8-fluoro-4-quinoline, 6-methyl-2-quinoline, 6-hydroxy-2-quinoline, and 6-methoxy-2-quinoline.

In formula (IX), $R_{16}$ and $R_{12}$, which may be the same or different, each represents an alkyl group or an alkenyl group each having not more than 10 carbon atoms and may have a substituent. As the preferred substituent for the alkyl group or the alkenyl group, there are, for example, a sulfo group, a carboxyl group, a halogen atom, a hydroxyl group, an alkoxy group having not more than 6 carbon atoms, an aryl group having not more than 8 carbon atoms, which may be substituted (e.g., phenyl, tolyl, sulfophenyl, and carboxyphenyl), a heterocyclic group (e.g., furyl and thienyl), an aryloxy group having not more than 8 carbon atoms, which may be substituted (e.g., chlorophenoxy, phenoxy, sulfophenoxy, and hydroxyphenoxy), an acyl group having not more than 8 carbon atoms (e.g., benzenesulfonyl, methanesulfonyl, acetyl, and propionyl), an alkoxycarbonyl group having not more than 6 carbon atoms (e.g., ethoxycarbonyl and butoxycarbonyl), a cyano group, an alkylthio group having not more than 6 carbon atoms (e.g., methylthio and ethylthio), an arylthio group having not more than 8 carbon atoms, which may be substituted (e.g., phenylthio and tolylthio), a carbamoyl group having not more than 8 carbon atoms, which may be substituted (e.g., carbamoyl and N-ethylcarbamoyl), and an acylamino group having not more than 8 carbon atoms (e.g., acetylamino and methanesulfonylamino).

The alkyl group or the alkenyl group may have one or more substituents.

Specific examples of the alkyl group or alkenyl group represented by $R_{16}$ and $R_{12}$ are methyl, ethyl, propyl, allyl pentyl, hexyl, methoxyethyl, ethoxyethyl, phenethyl, tolylethyl, sulfophenethyl, 2,2,2-trifluoroethyl, 2,2,3,3-tetrafluoropropyl, carbamoylethyl, hydroxyethyl, 2-(2-hydroxyethoxy)ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropyloxy)ethyl, and 2-[2-(3-sulfopropyloxy)ethoxy]ethyl.

$R_{13}$ and $R_{15}$ represent hydrogen or a single bond when $R_{13}$ and $R_{16}$ or $R_{15}$ and $R_{12}$ are linked to form a 5- or 6-membered ring.

$R_{14}$ represents hydrogen or a lower alkyl group which may be substituted (e.g., methyl, ethyl, propyl, methoxyethyl, phenethyl, and more preferably an alkyl group having not more than 5 carbon atoms).

In formula (IX), $X_{11}$ represents an acid anion and $m_{11}$ represents 0 or 1, and when the dye shown by the formula forms an intramolecular salt, $m_{11}$ is 0.

In the preferred sensitizing dyes represented by formula (IX), $l_{11}$ is 1, $Z_{11}$ is an atomic group necessary for forming a heterocyclic nucleus such as oxazole, benzoxazole, or naphthoxazole; $Z_{12}$ is an atomic group necessary for forming a heterocyclic nucleus such as benzimidazole or naphthimidazole (the heterocyclic nucleus shown by $Z_{11}$ and $Z_{12}$ may have at least one substituent as described above, but when $Z_{12}$ represents a benzimidazole nucleus or a naphthimidazole nucleus, the substituent is preferably an electron attractive substituent), at least one of said $R_{16}$ and $R_{12}$ is a group having a sulfo group, a carboxyl group, or a hydroxyl group, and $R_{14}$ is hydrogen.

In the particularly preferred sensitizing dyes shown by formula (IX), $Z_{11}$ is an atomic group forming a benzoxazole nuCleus, $Z_{12}$ is an atomic group forming a benzimidazole nucleus, at least one of $R_{16}$ and $R_{12}$ is a group having a sulfo group or a carboxy group, $R_{14}$ is hydrogen, and $l_{11}$ is 1. The heterocyclic nucleus shown by $Z_{11}$ and $Z_{12}$ may have at least one substituent as described above. When $Z_{11}$ or $Z_{12}$ is a benzimidazole nucleus, the particularly preferred substituent is chlorine, fluorine, a cyano group, an alkoxycarbonyl group having a total of not more than 5 carbon atoms, an acyl group having a total of not more than 7 carbon atoms, or a perfluoroalkyl group having not more than 4 carbon atoms, such as a trifluoromethyl group, and when $Z_{11}$ or $Z_{12}$ represents another heterocyclic nucleus, the particularly preferred substituent is a phenyl group having not more than 8 carbon atoms, which may be substituted, an alkyl group having not more than 5 carbon atoms, an alkoxy group having not more than 5 carbon atoms, an acylamino group having a total of not more than 5 carbon atoms, a carboxyl group, an alkoxycarbonyl group having not more than 5 whole carbon atoms, a benzyl group, a phenethyl group, or chlorine.

The addition ratio of the sensizing dye of formula (IX) to the sensitizing dye of formula (I), (Ia), (Ia') or (Ib) is preferably from 1/5 to 5/1.

Specific examples of the sensitizing dye represented by formula (IX) are illustrated below, but the present invention is not to be construed as being limited thereto.

IX-1

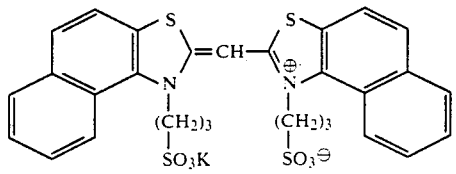

IX-2

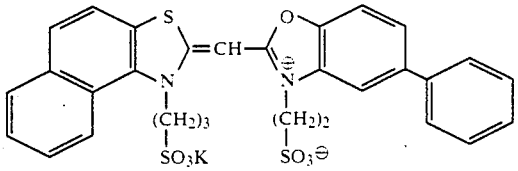

IX-3

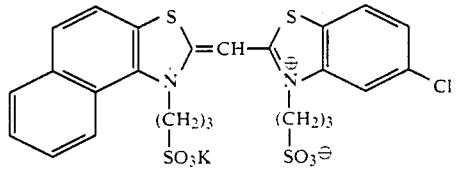

IX-4

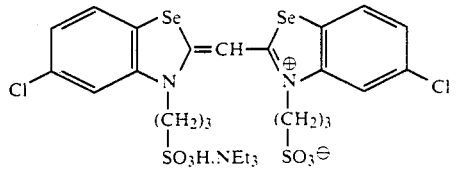

IX-5

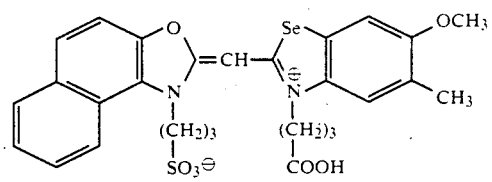

IX-6

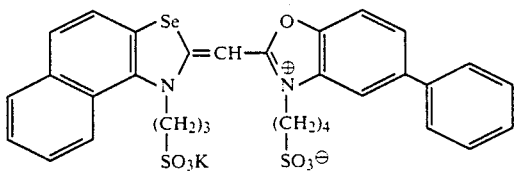

IX-7

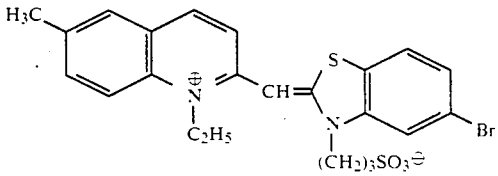

-continued
IX-8
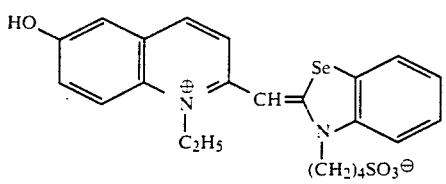
IX-9
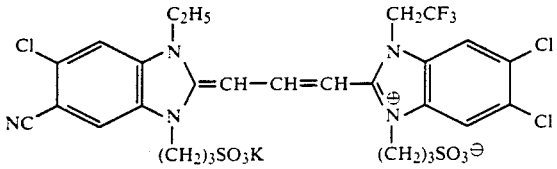
IX-10
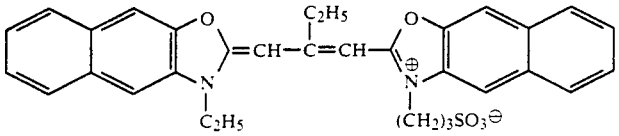
IX-11
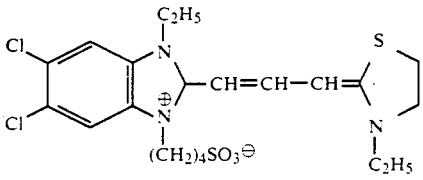
IX-12
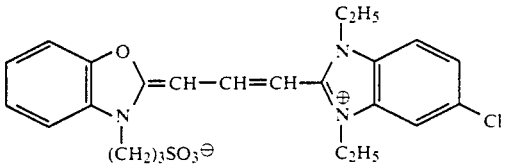
IX-13
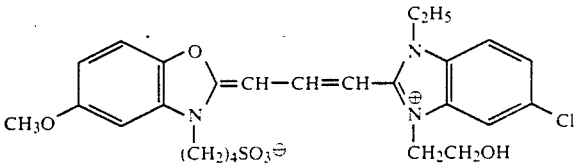
IX-14
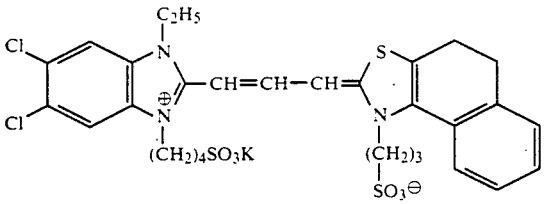
IX-15
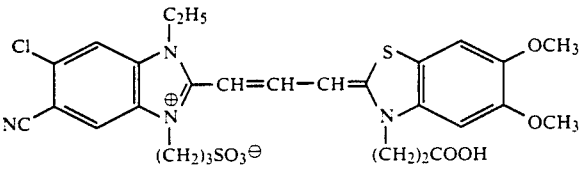
IX-16
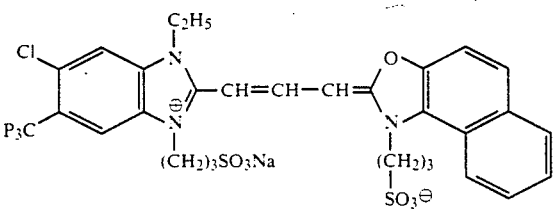

-continued
IX-17
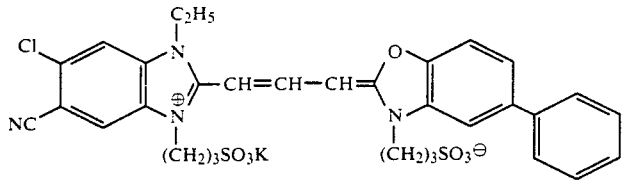
IX-18
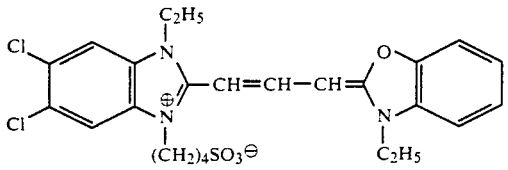
IX-19
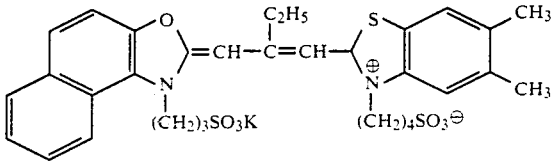
IX-20
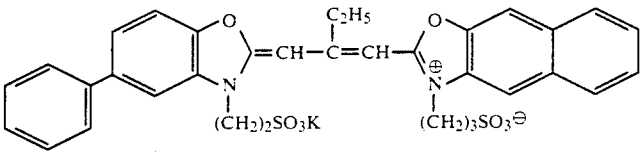
IX-21
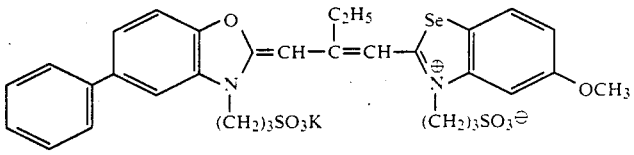
IX-22
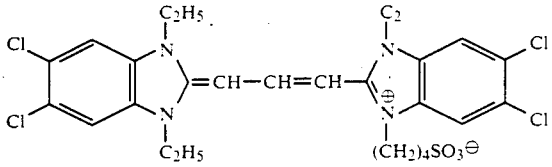
IX-23
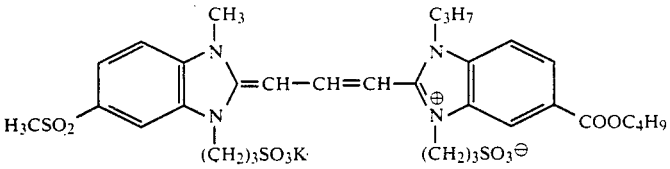
IX-24
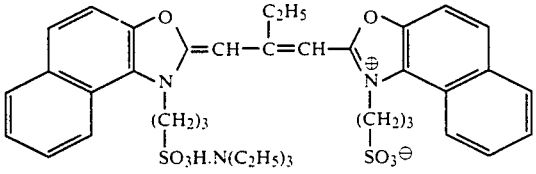
IX-25
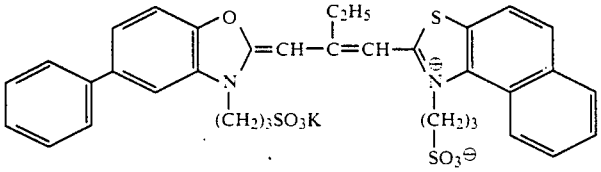

-continued

IX-26

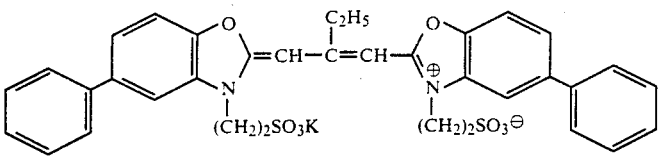

IX-27

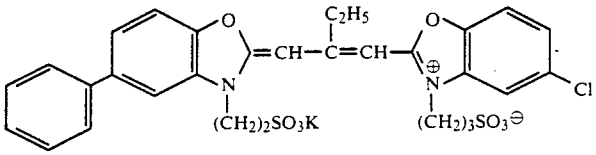

IX-28

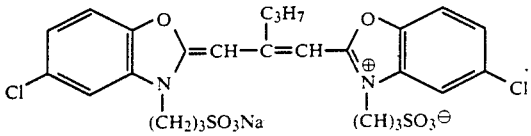

The compounds represented by formula (I) described above are known compounds and can be synthesized according to the method described in JP-A-52-104917, JP-B-48-25652 and JP-B-57-22368, F. M. Hamer, *The Chemistry of heterocyclic Compounds*, Vol. 18, A. Weissberger ed., *the Cyanine Dyes and Related Compounds*, published by Interscience, New York, (1964), D. M. Sturmer, *The Chemistry of Heterocyclic Compounds*, Vol. 30, page 441, edited by A. Weissberger and E. C. Taylor, published by John Willey and Sons, New York.

In this invention, the sensitizing agent shown by formula (I), (Ia), (Ia') or (Ib) described above can be used together with a compound shown by following formula (X) for further increasing the super color sensitization effect and/or for further increasing the storage stability.

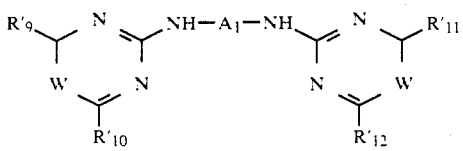

(X)

wherein —A'— represents a divalent aromatic residue which may contain —$SO_3M$ [wherein M represents hydrogen atom or a cation imparting water solubility (e.g., sodium and potassium)]; —A'— is advantageously selected from following groups of —$A'_1$— or the groups of —$A'_2$—. However, When $R'_9$, $R'_{10}$, $R'_{11}$ or $R'_{12}$ does not contain —$SO_3M$, —A'— is selected from the groups of —$A'_1$—.

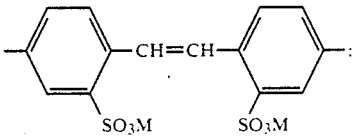

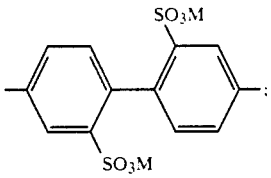

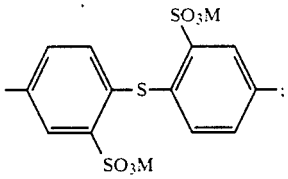

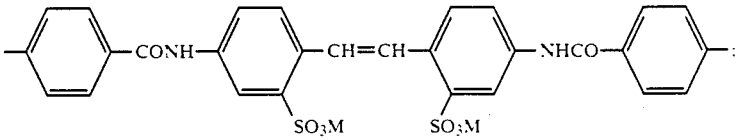

-continued

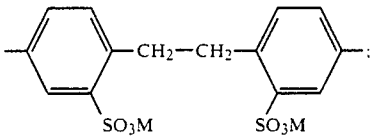

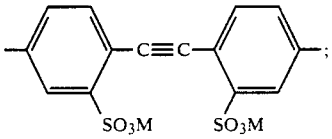

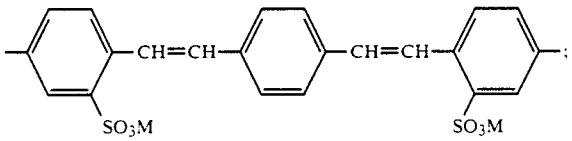

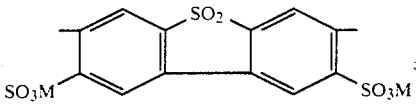

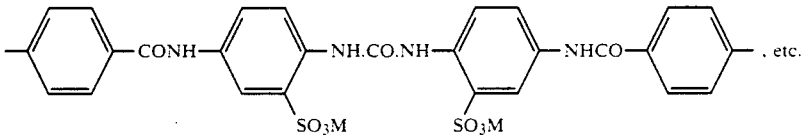

wherein M represents a hydrogen atom or a cation providing water soluble property.

—$A_2$—:

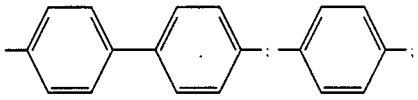

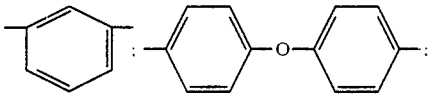

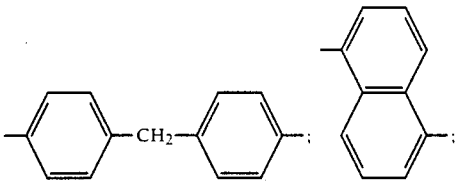

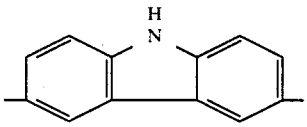

In formula (X), $R'_9$, $R'_{10}$, $R'_{11}$, and $R'_{12}$ each represents a hydrogen atom, a hydroxy group, a lower alkyl group (preferably having from 1 to 8 carbon atoms, e.g., methyl, ethyl, n-propyl, and n-butyl), an alkoxy group (preferably having from 1 to 8 carbon atoms, e.g., methoxy, ethoxy, propoxy, and butoxy), an aryloxy group (e.g., phenoxy, naphthoxy, o-tolyloxy, and p-sulfophenoxy), a halogen atom (e.g., chlorine and bromine), a heterocyclic nucleus (e.g., morpholinyl and piperidyl), an alkylthio group (e.g., methylthio and ethylthio), a heterocyclylthio group (e.g., benzothiazolyl, benzimidazolylthio, and phenyltetrazolylthio), an arylthio (e.g., phenylthio and tolylthio), an amino group, an alkylamino or substituted alkylamino group (e.g., methylamino, ethylamino, porpylamino, dimethylamino, diethylamino, dodecylamino, cyclohexylamino, β-hydroxyethylamino, di-(β-hydroxyethyl)amino, and β-sulfoethylamino), an arylamino or substituted arylamino group (e.g., anilino, o-sulfoanilino, m-sulfoanilino, p-sulfoanilino, o-soluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclylamino group (e.g., 2-benzothiazolylamino and 2-pyrazyl-amino), a substituted or unsubstituted aralkylamino group (e.g., benzylamino, o-anisylamino, m-anisylamino, and p-anisylamino), or an aryl group (e.g., phenyl).

$R'_9$, $R'_{10}$, $R'_{11}$, and $R'_{12}$ may be the same or different. When —A'— is selected from the groups of —$A'_2$—, at least one of $R'_9$, $R'_{10}$, $R'_{11}$, and $R'_{12}$ is required to have at least one sulfo group (which may be a free acid group or may form a salt).

In formula (X), W represents —CH= or —N=, and is preferably —CH=.

Then, specific examples of the compound shown by formula (X) for use in this invention are illustrated below but the invention is not limited to them.

(X-1): Doisodium 4,4'-bis[4,6-di(benzothiazolyl-2-thio)-pyrimidin-2-ylamino]stilbene-2,2'-disulfonate (X-2): Disodium 4,4'-bis[4,6-di(benzothiazolyl-2-amino)pyrimidin-2-ylamino)]stilbene-2,2'-disulfonate (X-3): Disodium 4,4'-bis[4,6-di(naphthyl-2-oxy)-pyrimidin-2-ylamino]stilbene-2,2'-disulfonate (X-4): Disodium 4,4'-bis(4,6-dianilinopyrimidin-2-ylamino)stilbene-2,2'-disulfonate (x-6): Disodium 4,4'-bis[4-chloro-6-(2-naphthyloxy)-pyrimidin-2-ylamino]biphenyl-2,2'-disulfonate (X-7): Disodium 4,4'-bis[4,6-di(1-phenyltetrazolyl-5-thio)pyimidin-2-ylamino]stilbene-2,2'-disulfonate (X-8): Disodium 4,4'-bis[4,6-di(benzimidazolyl-2-thio)-pyrimidon-2-ylamino]stilbene-2,2'-disulfonate (X-9): Disodium 4,4'-bis(4,6-diphenoxypyrimidin-2,2'-ylamino)stilbene-2,2'-disulfonate (X-10): Disodium 4,4'-bis(4,6-diphenylthiopyrimidin-2-ylamino)stilbene-2,2'-disulfonate (X-11): Disodium 4,4'-bis(4,6-dimercaptopyrimidin-2-ylamino)biphenyl-2,2'-disulfonate (X-12): Disodium 4,4'-bis(4,6-dianilino-triazin-2-ylamino)stilbene-2,2'-disulfonate (X-13): Disodium 4,4'-bis(4-anilino-6-hydroxytriazin-2-ylamino)stilbene-2,2'-disulfonate (X-14): Disodium 4,4'-bis[4-naphthylamino-6-anilino-triazin-2-ylamino)stilbene-2,2'-disulfonate In the aforesaid specific examples, the compounds (X-1) to (X-12) are preferred and the compounds (X-1), (X-2), (X-3), (X-4), (X-5), and (X-7) are particularly preferred.

The compound shown by formula (X) described above is advantageously used in an amount of from about 0.01 g to 5 g per mol of the silver halide in the silver halide emulsion.

The ratio of the infrared sensitizing dye for use in this invention to the compound shown by formula (X) (dye/compound) is advantageously in the range of from 1/1 to 1/100, and particularly from 1/2 to 1/50 by weight ratio.

The compound shown by formula (X) can be directly dispersed in an emulsion or may be added to an emulsion as a solution in a proper solvent (e.g., methanol, ethanol, methylcellosolce, and water) or a mixed solvent. Furthermore, the compound can be added to a solution or a colloid as a dispersion thereof according to an addition method for a sensitizing dye. Also, the compound can be added to an emulsion according to the method described in JP-A-50-80119.

The aforesaid sensitizing dye or the sensitizing dye for use in this invention is incorporated in the silver halide photographic emulsion in an amount of from $5\times10^{-7}$ mol to $5\times10^{-3}$ mol, preferably from $1\times10^{-6}$ mol to $1\times10^{-3}$ mol, and particularly preferably from $2\times10^{-6}$ mol to $5\times10^{-4}$ mol, per mol of silver halide.

The sensitizing dye for use in this invention can be directly dispersed in an emulsion. Also, the sensitizing dye can be added to an emulsion as a solution in a proper solvent such as methanol, ethanol, methyl-cellosolve, acetone, water, pyridine or a mixture thereof. Also, for the dissolution of the aforesaid dye, ultrasonic wave can be used. Also, as a method of adding the aforesaid infrared sensitizing dye, a method of dissolving the dye in a volatile organic solvent, dispersing the solution in an aqueous hydrophilic colloid solution, and adding the dispersion to an emulsion as described in U.S. Pat. No. 3,469,987, a method of dispersing the water-insoluble dye in a water-soluble solvent without dissolving in an organic solvent and adding the dispersion to an emulsion as described in JP-B-46-24185, a method of dissolving the dye in a surface active agent and adding the solution to an emulsion as described in U.S. Pat. No. 3,822,135, a method of dissolving the dye in a solvent using a compound red-shifting the dye and adding the solution to an emulsion as described in JP-A-51-74624, or a method of dissolving the dye in an acid containing substantially no water and adding the solution to an emulsion as described in JP-A-50-80826 can be used. Furthermore, for the addition of the dyes to emulsions, the methods described in U.S. Pat. Nos. 2,912,343, 3,342,605, 2,996,287, and 3,429,835 can be also used. Also, the infrared sensitizing dye of formulae (I), (Ia), and (Ib) may be uniformly dispersed in a silver halide emulsion at any step before coating the emulsion or may be added thereto at any step of preparing the emulsion.

The sensitizing dye for use in this invention can be used as a combination with other sensitizing dye(s). Exampels of such sensitizing dyes are described in U.S. Pat. Nos. 3,703,377, 2,688,545, 3,397,060, 3,615,635, 3,628,964, 3,416,927, 3,615,613, 3,615,632, 3,617,295, and 3,635,721, British Patents 1,242,588 and 1,293,862, JP-B-43-4936, 44-14030, 43-10773, and 43-4930.

The "non-prefogged" internal latent image silver halide emulsion for use in this invention is a silver halide emulsion containing silver halide grains having previously unfogged surfaces and forming latent images mainly in the inside thereof. More specifically, the maximum density of the silver halide emulsion in the case of coating a definite amount of the emulsion on a transparent support, light-exposing the emulsion layer for a definite time of from 0.01 second to 10 seconds, developing it using developer A shown below (internal type developer) for 6 minutes at 20° C., and measuring the density by an ordinary photographic density measuring method is preferably at least 5 times, and more preferably at least 10 times, higher than the maximum density thereof obtained by coating and light-exposing the emulsion in the same manner as above and developing the emulsion layer using developer B shown below (surface developer) for 5 minutes at 18° C.

| | | |
|---|---|---|
| Surface Developer B: | | |
| Metol | 2.5 | g |
| l-Ascorbic Acid | 10 | g |
| $NaBO_2 \cdot 4H_2O$ | 35 | g |
| KBr | 1 | g |
| Water to make | 1 | liter |
| Internal Developer A | | |
| Metol | 2 | g |
| Sodium Sulfite (anhydrous) | 90 | g |
| Hydroquinone | 8 | g |
| Sodium Carbonate (mono-hydrate) | 52.5 | g |
| KBr | 5 | g |
| KI | 0.5 | g |
| Water to make | 1 | liter |

Examples of the internal latent image type silver halide emulsions are conversion type silver halide emulsions described in British Patent 1,011,062 and U.S. Pat. Nos. 2,592,250 and 2,456,943 and core/shell type silver halide emulsions described in JP-A-47-32813, JP-A-47-32814, JP-A-134721, JP-A-52-156614, JP-A-53-60222, JP-A-53-66218, JP-A-53-66727, JP-A-55-127549, JP-A-57-136641, JP-A-58-70221, JP-A-59-208540, JP-A-59-216136, JP-A-60-107641, JP-A-60-247237, JP-A-61-2148, JP-A-61-3137, and JP-A-62-194248, JP-B-56-18939, JP-B-58-1412, JP-B-58-1415, JP-B-58-6935, and JP-B-58-108528, U.S. Pat. Nos. 3,206,313, 3,317,322, 3,761,266, 3,761,276, 3,850,637, 3,923,513, 4,035,185, 4,395,478, and 4,504,570, European Patent 17148, *Re-*

*search Disclosure,* No. 16345 (November, 1977), and Japanese patent application No. 61-36424.

The typical composition of the silver halide for the silver halide emulsion for use in this invention is silver chloride, silver bromide or a mixed silver halide such as silver chlorobromide, silver chloroiodobromide, and silver iodobromide. The silver halide emulsion which is preferably used in this invention is silver chloro(iodo)-bromide, silver (iodo)chloride, or silver (iodo)bromide containing from 0 to 3 mol % silver iodide.

The mean grain size (the diameter of the grains when the grain is spherical or similar to spherical; and the mean value based on the projected area using, in the case of cubic grains, the long side length as the grain size) of the silver halide grains is preferably from 0.1 μm to 2 μm, and particularly preferably from 0.15 μm to 1 μm.

The grain size distribution of the silver halide grains may be narrow or broad, but for improving the graininess and sharpness of images formed, a mono-dispersed emulsion wherein at least 90%, in particular at least 95% by grain number or weight of the whole silver halide grains are within ±40% (more preferably within ±30%, and most preferably within ±20%) of the mean grain size is preferably used in this invention. Also, for satisfying the desired gradation for the photographic light-sensitive material, two or more kinds of mono-dispersed silver halide emulsions each having different grain size can be used for emulsion layers having substantially same color sensitivity or plural silver halide grains each having a same mean grain size but having different sensitivity may be used for one emulsion layer or separate layers. Furthermore, a combination of two or more poly-dispersed silver halide emulsions or a combination of a mono-dispersed emulsion and a poly-dispersed emulsion can be used as a mixture for one emulsion layer or for double or multi layers. The silver halide grains for use in this invention may have a regular crystal form such as cubic, octahedral, dodecahedral, tetradecahedral; an irregular crystal form such as spherical; or a composite form of these crystal forms. Also, the silver halide grains may be tabular grains and in this case, a tabular grain silver halide emulsion wherein tabular grains having an aspect ratio (length/-thickness) of at least 5, in particular at least 8 account for at least 50% of the total projected area of the silver halide grains can be used in this invention. An emulsion composed of silver halide emulsions having these different crystal forms can be used.

The silver halide emulsion for use in this invention can be prepared in the presence of a silver halide solvent. As the silver halide solvent, there are organic thio ethers described in U.S. Pat. Nos. 3,271,157, 3,531,289, and 3,574,628, JP-A-54-1019 and JP-A 54-158917 and thiourea derivatives described in JP-A-53-82408, JP-A-55-77737, and JP-A-55-2982.

The silver halide emulsion for use in this invention can be chemically sensitized in the inside of the grains or at the surface of the grains by sulfur sensitization, selenium sensitization, reduction sensitization, and noble metal sensitization, alone or in combination.

To the silver halide emulsion for use in this invention can be added sensitizing dyes (e.g., cyanine dyes and merocyanine dyes) described in JP-A-55 52050, pages 45 to 53 in addition to the sensitizing dyes specified in this invention for increasing the sensitivity. These sensitizing dyes may be used singly or in combination, and a combination of sensitizing dyes is frequently used for super color sensitization.

The silver halide emulsion may further contain a dye which does not have a spectral sensitization action by itself or a material which does not substantially absorb visible light but has a super color sensitization effect together with the sensitizing dyes.

Useful sensitizing dyes, combinations of dyes for super color sensitization, and materials with super color sensitization are described in *Research Disclosure,* Vol. 176, No. 17643, page 23, IV, A-J (December, 1978).

The sensitizing dye can be added in any step of producing a silver halide photographic emulsion or in any step from the production of the emulsion to coating. For example, the sensitizing dye may be added to a silver halide emulsion at the formation of silver halide grains, at physical ripening, or at chemical ripening.

The silver halide emulsion layer or other hydrophilic colloid layer in this invention may also contain water-soluble dyes as filter dyes, for irradiation prevention, or other various purposes. As a filter dye, there are dyes for further reducing the photographic sensitivity and dyes having light absorption in the region of mainly from 350 nm to 600 nm for increasing the safety for safelight.

These dyes are incorporated in a silver halide emulsion layer or added together with a mordant to a light-insensitive hydrophilic colloid layer disposed on a silver halide emulsion layer followed by fixing.

The amount of the dye differs according to mol extinction coefficient but is usually from $10^{-2}$ g/m$^2$ to 1 g/m$^2$, and preferably from 50 mg/m$^2$ to 500 mg/m$^2$.

Specific examples of the dye are described in JP-A-63-64039.

The photographic light-sensitive materials for use in this invention can further contain various compounds for preventing the formation of fog during the production, storage and/or photographic processing of the photographic materials or stabilizing the photographic performance thereof. There are many compounds known as antifoggants or stabilizers. For example, there are azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines, mercaptotriaszines; thioketo compounds such as oxazolinethione; azaindenes such as triazaindenes, tetraazaindenes (in particular, 4-hydroxy-substituted (1,3,3a,7)tetraazaindenes), pentaazaindenes; benzenethiosulfonic acid, benzenesulfinic acid, and benzenesulfonic acid amide.

The photographic light-sensitive materials for use in this invention may contain in the photographic emulsion layers a developing agent such as a polyalkylene oxide or derivatives thereof (such as ethers, esters, amines), thioether compounds, thiomorpholines, quaternary ammonium salt compounds, urethane derivatives, urea derivatives, imidazole derivatives, dihydroxybenzenes, 3-pyrazolidines, for increasing the sensitivity and contrast and for the purpose of development acceleration. In these compounds, dihydroxybenzenes (hydroquinone, 2-methylhydroquinone, catechol) and 3-pyrazolidones (1-phenyl-3-pyrazolidone, 1-phenyl-4-methyl-4-hydroxymethyl-3-pyrazolidone) are preferred. They are usually used in an amount of not more than 5 g/m$^2$. A dihydroxybenzene is more preferably used in an amount of from 0.01 to 1 g/m$^2$ and a 3-pyrazolidone is used more preferably in an amount of from 0.01 to 0.2 g/m$^2$.

Also, as preferred sensitizers being used for the silver halide emulsions for use in this invention, there are polyoxyethylene derivatives (described in British Patent 981,470, JP-B-31-6475, and U.S. Pat. No. 2,716,062), polyoxypropylene derivatives, and derivatives having a quaternary ammonium group.

In this invention, polyalkylene oxide compounds are particularly preferably used as sensitizers, and examples thereof are the condensation products of a polyalkylene oxide composed of at least 10 units of an alkylene oxide having from 2 to 4 carbon atoms, e.g., ethylene oxide, propylene oxide, and preferably ethylene oxide and a compound having at least one active hydrogen atom, such as water, an aliphatic alcohol, an aromatic alcohol, fatty acid, an organic amine, a hexytol derivative and block copolymers of two or more kinds of polyalkylene oxides.

Specific examples of the polyalkylene oxide compound for use in this invention are as follows, but the present invention is not to be construed as being limited thereto.

polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol block copolymers, and The molecular weight of the polyalkylene oxide is required to be at least 600.

The compound may contain one or more polyalkylene oxide chains in the molecule. In this case, each polyalkylene oxide chain may be composed of less than 10 alkylene oxide units but the sum of alkylene oxide units in the molecule must be at least 10. When the compound has two or more polyalkylene oxide chains in the molecule, each chain may be composed of alkylene oxide units which differ from each other, e.g., ethylene oxide and propylene oxide.

The polyalkylene oxide compound for use in this invention contains preferably from 14 to 100 alkylene oxide units.

Specific examples of the polyalkylene oxide compound for use in this invention are described in JP-A-50-156423, JP-A-2-108130, and JP-A-53-3217.

These polyalkylene oxide compounds may be used singly or as a mixture thereof.

When the polyalkylene oxide compound is added to a silver halide emulsion, the compound can be added thereto as an aqueous solution of a proper concentration or a solution of a low-boiling organic solution miscible with water in a proper step before coating, and preferably after chemical ripening. The polyalkylene compound is used in the range of preferably from $1\times10^{-5}$ mol to $1\times10^{-2}$ mol per mol of silver.

The photographic light-sensitive materials for use in this invention may contain an inorganic or organic hardening agent in the silver halide photographic emulsion layers and light-insensitive hydrophilic colloid layers. Examples of the hardening agent are active vinyl compounds (e.g., 1,3,5-triacryloyl-hexahydro-s-triazine, bis(vinylsulfonyl)methyl ether, and N,N'-methylenebis-[$\beta$-(vinylsulfonyl)propionamide], active halogen compounds (e.g., 2,4-dichloro-6-hydroxy-s-triazine), mucohalogenic acids (e.g., mucochloric acid), N-carbamoylpyridinium salts (e.g., [(1-morpholinocarbonyl-3-pyridinio)methanesulfonate)], and haloamidinium salts [e.g., 2-(1-chloro-1-pyridinomethylene)pyrrolidinium and 2-naphthalenesulfonate)]. They can be used singly or as a combination thereof. In these compounds, the active vinyl compounds described in JP-A-53-41220, JP-A-53-57257, JP-A-59-162546, and JP-A-60-80846 and the active halogen compounds described in U.S. Pat. No. 3,325,287 are preferred.

The photographic light-sensitive materials for use in this invention may further contain various kinds of surface active agents in the photographic emulsion layers or other hydrophilic colloid layers as coating aid, for static prevention, friction reduction, sticking prevention, and the improvement of photographic characteristics (e.g., development acceleration, contrast increase and sensitization).

Examples of the surface active agent are nonionic surface active agents such as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride and alkylphenol polyglyceride), fatty acid esters of polyhydric alcohol, alkyl esters of saccharides; anionic surface active agents having an acid group (e.g., a carboxy group, a sulfo group, a phospho group, a sulfuric acid ester group, and a phosphoric acid ester), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylpohosphoric acid esters; amphoteric surface active agents such as amino acids, aminoalkylsulfonic acids, aminoalkylsulfuric acid esters, aminoalkyl phosphoric acid esters, alkylbetaines, amine oxides; and cationic surface active agents such as alkylamine salts, aliphatic quaternary ammonium salts, aromatic quaternary ammonium salts, heterocyclic ammonium salts (e.g., pyridinium and imidazolium), phosphonium or sulfonium salts containing an aliphatic ring or heterocyclic ring.

Also, for static prevention, the nitrogen-containing surface active agents described in JP-A-60-80849 can be preferably used.

The photographic light-sensitive materials for use in this invention can further contain in the photographic emulsion layers and/or other hydrophilic colloid layers a matting agent such as silica, magnesium oxide, barium stronthium sulfate, or polymethyl methacrylate particles, for the purpose of adhesion prevention.

Also, the photographic light-sensitive materials for use in this invention may contain a dispersion of a water-insoluble or water sparingly soluble synthetic polymer for improving the properties of the photographic layers. Examples of the polymer are the polymers or copolymers of alkyl (meth)acrylate, alkoxyacryl (meth)acrylate, glycidyl (meth)acrylate, solely or in combination or as a combination of the monomer and acrylic acid, or methacrylic acid.

As the binder or protective colloid for the photographic emulsion layers and other layer of the photographic light-sensitive materials, gelatin is advantageously used but other hydrophilic colloid can be used.

Examples of such hydrophilic colloid are proteins such as gelatin derivatives, graft polymers of gelatin and other polymers, albumin, casein; cellulose derivatives such as hydroxyethyl cellulose, carboxymethyl cellulose, cellulose sulfuric acid esters; saccharide derivatives such as sodium alginate, starch derivatives; and various synthetic polymers or copolymers such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

As gelatin, limed gelatin as well as acid-treated gelatin may be used. Furthermore, gelatin hydrolyzed products and gelatin enzyme decomposition products can be also used.

For the silver halide emulsion layer in this invention can be used a polymer latex, such as a latex of an alkyl acrylate.

As the support for the photographic light-sensitive material for use in this invention, films of cellulose triacetate, cellulose diacetate, nitrocellulose, polystyhrene, or polyethylene terephthalate can be used.

In particular, for COM films, it is important that the film has excellent antistatic properties and a support having high electric conductivity is preferably used.

For developing the photographic light-sensitive materials in this invention, various developing agents can be used. For example, there are polyhydroxybenzenes such as hydroquinone, 2-chlorohydroquinone, 2-methylhydroquinone, catechol, pyrogallol; aminophenols such as p-aminophenol, N-methyl-p-aminophenol, 2,4-diaminophenol; 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone, 5,5-dimethyl-1-phenyl 3-pyrazolidone, and ascorbic acids. They can be used singly or as a combination thereof.

Specific examples of the developers for use in this invention are described in JP-A-58-55928.

For obtaining dye images using dye-forming coupler(s) in this invention, an aromatic primary amine developing agent, preferably a p-phenylenediamine series developing agent can be used. Specific examples of the developing agent are 4-amino-3-methyl-N,N-dimethylaniline hydrochloride, N,N-diethyl-p-phenylenediamine, 3-methyl-4-amino-N-ethyl-N-β-(methanesulfo amido)ethylaniline, 3-methyl-4-amino-N-ethyl-N-(β-sulfo ethyl)aniline, 3-ethoxy-4-amino-N-ethyl-N-(β-sulfo ethyl)aniline, and 4-amino-N-ethyl-N-(β-hydroxyethyl)aniline.

The developing agent described above may be in an alkaline processing composition (processing element) or in a proper layer of the photographic light-sensitive material.

When a DRR (dye-releasing redox) compound is used in this invention, a silver halide developing agent which can cross-oxidize the DRR compound can be used in this invention.

The developer for use in this invention may contain sodium sulfite, potassium sulfite, ascorbic acid, or reductants (e.g., piperidinohexose reductant) as a preservative.

In this invention, direct positive images can be obtained by developing the photographic light-sensitive material using a surface developer.

The development by a surface developer is induced by the latent image or fogging nucleus existing at the surface of silver halide grains.

In this invention, it is preferred that the developer contains no silver halide solvent, but the developer may contain a silver halide solvent if the internal latent images do not substantially contribute to the development until the development by the surface development center of the silver halide grains is completed.

The developer may further contain sodium hydroxide, potassium hydroxide, sodium carbonate, potassium carbonate, sodium tertiary phosphate, or sodium metaborate as an alkali agent or a buffer. The content of the agent is selected such that the pH of the developer is from 10.0 to 12.0, preferably not more than 11.5, and more preferably not more than 11.0.

The developer may contain a color development accelerator such as benzyl alcohol.

It is also advantageous for reducing the minimum density of direct positive images formed that the developer contains a compound which is conventionally used as an antifoggant, such as benzimidazoles (e.g., 5-nitrobenzimidazole) and benzotriazoles (e.g., benzotriazole and 5-methyl-benzotriazole).

The invention is explained in greater detail with reference to the following specific examples, but the present invention is not to be construed as being limited thereto. Unless otherwise indicated, all parts, percents and ratios are by weight.

EXAMPLE 1

Emulsion A was prepared by the following method.

Emulsion A

An aqueous solution of potassium bromide and an aqueous solution of silver nitrate were simultaneously added to an aqueous gelatin solution in the presence of 1,8-dihydroxy-3,6-dithiaoctane solvent with vigorous stirring at 75° C. over a period of 5 minutes to provide an octahedral silver bromide emulsion having a mean grain size of 0.15 μm. After adjusting the pAg of the emulsion to 8.20, 115 mg of sodium thiosulfate and 115 mg of chloroauric acid (tetra-hydrate) per mol of silver were added to the emulsion followed by heating for 50 minutes at 75° C. to perform chemical sensitization treatment.

Using the silver bromide grains as cores, the same treatment as above was followed for 40 minutes under the same precipitation conditions as above while controlling the pAg of the system to 7.50 to grow crystals, whereby a cubic mono-dispersed core/shell silver bromide emulsion having a mean grain size of 0.25 μm was finally obtained. After washing with water and desalting, 3.4 mg of sodium thiosulfate and 3.4 mg of chloroauric acid (tetra-hydrate) per mol of silver were added to the emulsion and the mixture was heated to 75° C. for 60 minutes to perform chemical sensitizing treatment, whereby an internal latent image type silver halide emulsion (Emulsion A) was obtained.

Emulsion A was divided into several portions and after adding to each portion the sensitizing dye, the nucleating agent, and the nucleation accelerator as shown in Table 1 below, 4-hydroxy-6 methyl-1,3,3,3a-tetraazaindene as a stabilizer and 1,3-divinylsulfonyl-2-propanol as a hardening agent were further added to each portion.

On the other hand, to an aqueous gelatin solution for forming a surface protective layer were added barium strontium sulfate having a mean particle size of 1.0 μm as a matting agent, 100 mg/m$^2$ of the dye of structure (1) shown below, 100 mg/m$^2$ of the dye of structure (2)

shown below, sodium p-dodecylbenzenesulfonate as a coating aid, 50 mg/m² of hydroquinone, 20 mg/m² of the surface active t- agent of structure (3) shown below, and 20 mg/m² of the compound of structure (4) shown below.

The silver halide emulsion described above and the surface layer mixture were simultaneously coated on a polyethylene terephthalate film at a silver coverage of 1.6 mg/m². Thus, Samples 1 to 7 were prepared.

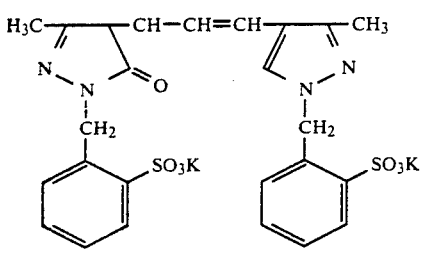

①

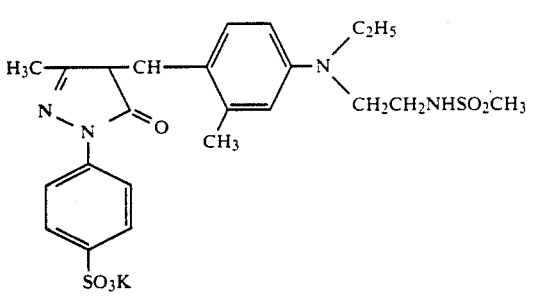

②

$C_8F_{17}SO_2N(C_3H_7)CH_2COOK$ ③

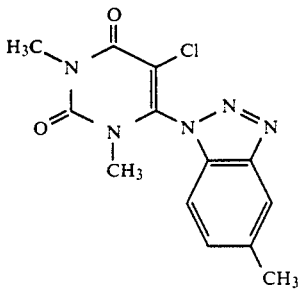

④

Each of the samples was exposed to a xenon flash lamp through a continuous wedge for $10^{-4}$ second using an interference filter transparent for red light having a wavelength of 633 nm.

Each sample was then developed by developer made by Eastman Kodak Corporation for 30 seconds at 35° C. and stopped, fixed, and washed by ordinary methods to provide positive images. The results obtained are shown in Table 2.

In Table 2, Dmax means the maximum density of the reversal image, Dmin the minimum density, and Sp-df an intermediate sensitivity. The intermediate sensitivity is defined as the value of logE from a standard value giving a density of (Dmax+Dmin/2). The standard value was selected such that the sensitivity became higher with the increase of the value of logE. Also, $\Delta\log E_{0.2}$ is defined as the difference between the reversal sensitivity giving a density of Dmin+0.2 and the re-reversal negative sensitivity giving the density of Dmin+0.2 in logE values and is called "sensitivity width". As is clear from the definition, a larger sensitivity width indicates that the re-reversal negative image is less likely to form.

TABLE 1

| Sample No. | | Nucleating Agent Kind | Nucleating Agent Amount* | Nucleating Accelerator Kind | Nucleating Accelerator Amount* | Sensitizing Dye Kind | Sensitizing Dye Amount* |
|---|---|---|---|---|---|---|---|
| 1 | Comparison Sample | — | — | — | — | I-20 | $1.1 \times 10^{-5}$ |
| 2 | Comparison Sample | N-1-7 | $3.4 \times 10^{-6}$ | — | — | " | " |
| 3 | Comparison Sample | N-1-21 | $2.5 \times 10^{-6}$ | — | — | " | " |
| 4 | Comparison Sample | N-1-15 | $2.5 \times 10^{-6}$ | — | — | " | " |
| 5 | Invention | N-1-7 | $3.4 \times 10^{-6}$ | II-1 | $8.8 \times 10^{-4}$ | " | " |
| 6 | " | N-1-21 | $2.5 \times 10^{-6}$ | " | " | " | " |
| 7 | " | N-1-15 | $2.5 \times 10^{-6}$ | " | " | " | " |

*Mol/Mol-Ag

TABLE 2

| Sample No. | | Dmin | Dmax | Sp-df | $\Delta\log E_{0.2}$ |
|---|---|---|---|---|---|
| 1 | Comparison Sample | ← Showing no Reversal Characteristics → | | | |
| 2 | Comparison Sample | 0.15 | 1.05 | 1.27 | 0.83 |
| 3 | Comparison Sample | 0.15 | 0.98 | 1.25 | 0.79 |
| 4 | Comparison Sample | 0.15 | 1.07 | 1.28 | 0.82 |
| 5 | Invention | 0.08 | 3.10 | 1.30 | 1.00 |
| 6 | " | 0.08 | 3.00 | 1.32 | 1.05 |
| 7 | " | 0.08 | 2.98 | 1.33 | 1.06 |

As is clear from the results shown in Table 2, Comparison Sample No. 1 did not show reversal characteristics. In Comparison Samples No. 2 to No. 4, Dmax was low, Dmin was high, and $\Delta\log E_{0.2}$ was small. When in Sample Nos. 1 to 4, the addition amount of each additive was changed, no remarkable improvement was observed. On the other hand, in Sample Nos. 5 to 7, which are embodiments of this invention, all of Dmax, Dmin, Sp-df, and $\log E_{0.2}$ were superior to the results of Comparison Sample Nos. 1 to 4.

Example 2

The same procedure as in Example 1 except that the nucleating agent, nucleation accelerator, and sensitizing dye were changed as shown in Table 3 and a polyethylene terephthalate film having a subbing layer containing tin oxide ($SnO_2$) (electric conductivity under relative humidity of 10% was $10^8$ Ω/□) was used as the support.

The results obtained are shown in Table 4, wherein the evaluation symbols are same as in Table 2.

TABLE 3

| Sample No. | | Nucleating Agent Kind | Nucleating Agent Amount* | Nucleating Accelerator Kind | Nucleating Accelerator Amount* | Sensitizing Dye Kind | Sensitizing Dye Amount* | Sensitizing Dye Kind | Sensitizing Dye Amount* |
|---|---|---|---|---|---|---|---|---|---|
| 1 | Comparison Sample | N-1-7 | $3.4 \times 10^{-6}$ | II-1 | $8.8 \times 10^{-4}$ | I-20 | $1.1 \times 10^{-8}$ | — | — |
| 2 | Comparison Sample | N-1-21 | $2.5 \times 10^{-6}$ | " | " | " | " | — | — |
| 3 | Comparison Sample | N-1-15 | $2.5 \times 10^{-6}$ | " | " | " | " | — | — |
| 4 | Invention | N-1-7 | $3.4 \times 10^{-6}$ | " | " | " | " | IX-12 | $1.2 \times 10^{-3}$ |
| 5 | " | N-1-21 | $2.5 \times 10^{-6}$ | " | " | " | " | " | " |
| 6 | " | N-1-15 | $2.5 \times 10^{-6}$ | " | " | " | " | " | " |

*Mol/Mol-Ag

TABLE 4

| Sample No. | | Dmin | Dmax | Sp-df | $\Delta \log E_{0.2}$ |
|---|---|---|---|---|---|
| 1 | Comparison Sample | 0.08 | 3.10 | 1.30 | 1.00 |
| 2 | Comparison Sample | 0.08 | 3.00 | 1.32 | 1.05 |
| 3 | Comparison Sample | 0.08 | 2.98 | 1.33 | 1.06 |
| 4 | Invention | 0.04 | 3.00 | 1.45 | 1.15 |
| 5 | " | 0.04 | 2.98 | 1.43 | 1.17 |
| 6 | " | 0.04 | 3.02 | 1.47 | 1.21 |

As is clear from the results shown in Table 4, it can be seen that Comparison Sample Nos. 1 to 3, Dmin was high, Sp-df was low, and $\Delta \log E_{0.2}$ was small, while Sample Nos. 4 to 6, which are embodiments of this invention, were excellent in all the photographic properties Dmin, Dmax, Sp-df, and $\Delta \log E_{0.2}$.

EXAMPLE 3

Emulsion B was prepared as follows.

Emulsion B

An aqueous solution of potassium bromide and an aqueous solution of silver nitrate were simultaneously added to an aqueous gelatin solution in the existence of thio ether with vigorous stirring at 75° C. over a period of 5 minutes to provide an octahedral silver bromide emulsion having a mean grain size of 0.15 μm. After adjusting the pAg of the emulsion to 8.20, 38 mg of sodium thiosulfate and 38 mg of chloroauric acid (tetra-hydrate) per mol of silver were added to the emulsion followed by heating to 75° C. for 50 minutes, whereby a chemical sensitizing treatment was performed.

Using the silver bromide grains as core, the same treatment as above was followed for 40 minutes while controlling the pAg of the system to 8.20 or 7.70, to further grow crystals, whereby an octahedral or tetradecahedral mono-dispersed core/shell silver bromide emulsion having a mean grain size of 0.25 μm was obtained. After washing with water and desalting, 6.0 mg of sodium thiosulfate and 6.0 mg of chloroauric acid (tetra-hydrate) per mol of silver were added to the emulsion and the mixture was heated to 75° C. for 60 minutes to perform chemical sensitizing treatment, whereby internal latent image type silver halide emulsions (Emulsions B-1 and B-2) were obtained.

The ratio of (100) plane area in the surfaces of the whole silver halide grains contained in each emulsion was measured by the method described in *Journal of Imaging Science*, 29, 165 (1985). The other plane was a (111) plane. The results are shown in the following table.

| Emulsion | Ratio of (100) plane |
|---|---|
| B-1 | 85% |
| B-2 | 15% |

By following the same procedures as in Example 1 and Example 2 except that Emulsions B-1 and B-2, respectively, were used in place of Emulsion A, almost the same results as in Examples 1 and 2 were obtained. Samples containing the nucleating agent, the nucleating accelerator, and the sensitizing dye of this invention were excellent in Dmax, Dmin, Sp-df, and $\Delta \log E_{0.2}$ as compared to comparison samples, using both octahedral grains and tetradecahedral grains.

EXAMPLE 4

After light-exposing each of the samples used in Examples 1 to 3 in the same manner as in Example 1, each sample was developed by the developer shown below for 30 seconds at 35° C. and stopped, fixed and washed conventionally to provide excellent positive characteristics as in Examples 1 to 3. From the results, it can be seen that the direct positive silver halide photographic light-sensitive materials of this invention had excellent processing aptitude.

Developer

FR Data Com-Pak Negative made by FR Co.
Chem Kit made by ALTA Co.

EXAMPLE 5

By following the same procedure as Example 1, an internal latent image type silver halide emulsion (Emulsion A) was prepared.

Emulsion A was divided into several portions and after adding to each portion the sensitizing dye, the nucleating agent, and the nucleation accelerator as shown in Table 5, $1 \times 10^{-3}$ mol of 4-hydroxy-6-methyl-1,3,3,3a-tetraazaindene as a stabilizer was added to the emulsion per mol of silver and then $5 \times 10^{-4}$ mol of Compound (IX-1), $1 \times 10^{-4}$ mole of Compound (X-3), 5 mg/m$^2$ of the dye of structure (1) shown below, and 1,3-divinylsulfonyl-2-propanol as a hardening agent were added to the emulsion.

On the other hand, to an aqueous gelatin solution for surface protective layer were added barium strontium sulfate having a mean grain size of 1.0 μm as a matting agent, 50 mg/m$^2$ of hydroquinone, sodium p-dodecylbenzenesulfonate as coating aid, and a fluorine-series surface active agent having structure (2) shown below.

Then, the emulsion and the surface layer mixture were simultaneously coated on a polyethylene terephthalate film at a silver coverage of 1.6 g/m$^2$. Thus, Samples 1 to 7 were prepared.

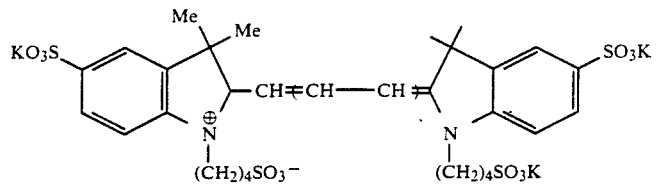

(1)

$C_8F_{17}SO_2N(C_3H_7)CH_2COOK$ (2)

Each of the sample was exposed to a xenon flash lamp through a continuous wedge for $10^{-5}$ seconds using an interference filter of 780 nm. Each sample was then developed by a Proster Plus developer, may be Eastman Kodak Co. for 30 seconds at 35° C. and stopped, fixed, and washed according to ordinary methods to provide positive images.

The results obtained are shown in Table 6.

TABLE 5

| Sample No. | | Nucleating Agent Kind | Nucleating Agent Amount* | Nucleating Accelerator Kind | Nucleating Accelerator Amount* | Sensitizing Dye Kind | Sensitizing Dye Amount* |
|---|---|---|---|---|---|---|---|
| 1 | Comparison Sample | — | 0 | — | — | Ia-1 | $7.5 \times 10^{-5}$ |
| 2 | Comparison Sample | N-1-7 | $3.4 \times 10^{-6}$ | — | — | " | |
| 3 | Comparison Sample | N-1-21 | $2.5 \times 10^{-6}$ | — | — | " | |
| 4 | Comparison Sample | N-1-15 | $2.5 \times 10^{-6}$ | — | — | " | |
| 5 | Invention | N-1-7 | $3.4 \times 10^{-6}$ | II-1 | $8.8 \times 10^{-4}$ | " | |
| 6 | " | N-1-21 | $2.5 \times 10^{-6}$ | " | " | " | |
| 7 | " | N-1-15 | $2.5 \times 10^{-6}$ | " | " | " | |

*Mol/Mol-Ag

TABLE 6

| Sample No. | | Dmin | Dmax | Sp-df | $\Delta\log E_{0.2}$ |
|---|---|---|---|---|---|
| 1 | Comparison Sample | ← No Reversal Characteristics → | | | |
| 2 | Comparison Sample | 0.17 | 0.99 | 1.18 | 0.80 |
| 3 | Comparison Sample | 0.17 | 1.05 | 1.20 | 0.77 |
| 4 | Comparison Sample | 0.17 | 1.10 | 1.22 | 0.81 |
| 5 | Invention | 0.06 | 2.47 | 1.29 | 1.08 |
| 6 | " | 0.06 | 2.54 | 1.31 | 1.11 |
| 7 | " | 0.06 | 2.50 | 1.33 | 1.10 |

As is clear from the results shown in Table 6, it can be seen that Comparison Sample No. 1 did not show reversal characteristics; and in Comparison Sample Nos. to 4, Dmax was low, Dmin was high, and $\Delta\log E_{0.2}$ was small. When the amount of each additive in Comparison Sample Nos. 1 to 4 was changed, no remarkable improvement was observed. Also, it can be seen that Sample Nos. 5 to 7, which are embodiments of this invention, the photographic performance, Dmax, Dmin, Sp-df, and $\Delta\log E_{0.2}$ were excellent as compared to Comparison Sample Nos. 1 to 4.

EXAMPLE 6

Emulsion B was prepared as follows.

Emulsion B

An aqueous solution of potassium bromide and an aqueous solution of silver nitrate were simultaneously added to an aqueous gelatin solution in the presence of 1,8-dihydroxy-3,6 dithiaoctane solvent with vigorous stirring at 75° C. over a period of 5 minutes to provide an octahedral silver bromide emulsion having a mean grain size of 0.15 μm. After adjusting the pAg of the emulsion to 8.20, 38 mg of sodium thiosulfate and 38 mg of chloroauric acid per mol of silver were added to the emulsion followed by heating to 75° C. for 50 minutes to perform chemical sensitizing treatment.

Using the silver bromide grains as core, the same treatment as above was followed for 40 minutes while controlling the pAg of the emulsion to 8.20 or 7.70 to grow crystals, to provide an octahedral or tetradecahedral mono-dispersed core/shell silver bromide emulsion having a mean grain size of 0.25 μm.

After washing with water and desalting, 6.0 mg of sodium thiosulfate and 6.0 mg of chloroauric acid (tetrahydrate) per mol of silver were added to the emulsion and the emulsion was heated to 75° C. for 60 minutes to perform chemical sensitizing treatment, whereby internal latent image type silver halide emulsions (B-1) and (B-2) were obtained.

Then, the ratio of (100) plane area in the surface of all silver halide grains in each emulsion was measured as in Example 3. The other plane was a (111)

The results are shown below.

| Emulsion | Ratio of (100) Plane |
|---|---|
| B-1 | 85% |
| B-2 | 15% |

By following the same experiment as in Example 5 except that emulsion B-1 or B-2 was used in place of Emulsion A and the dye of structure (3) shown below in place of the dye of structure (1), the results shown in Table 7 were obtained.

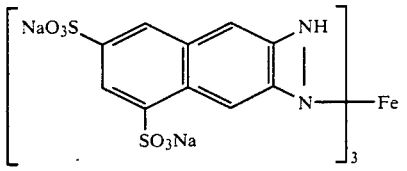

TABLE 7

| Sample No. | | Dmin | Dmax | Sp-df | $\Delta\log E_{0.2}$ |
|---|---|---|---|---|---|
| 1 | Comparison Sample | ← No Reversal Characteristics → | | | |
| 2 | Comparison Sample | 0.16 | 0.97 | 1.13 | 0.81 |
| 3 | Comparison Sample | 0.16 | 1.08 | 1.18 | 0.80 |
| 4 | Comparison Sample | 0.16 | 1.05 | 1.20 | 0.83 |
| 5 | Invention | 0.05 | 2.50 | 1.27 | 1.10 |
| 6 | " | 0.05 | 2.53 | 1.33 | 1.12 |
| 7 | " | 0.06 | 2.48 | 1.33 | 1.09 |

As is clear from the results shown in Table 7, it can be seen that the samples containing the nucleating agent, the nucleation accelerator, and the sensitizing dye of this invention had excellent Dmax, Dmin, Sp-df, and $\Delta\log E_{0.2}$ as compared to the comparison samples, using both octahedral grains and tetradecahedral grains.

EXAMPLES 7

When the same procedure, as Example 5 was followed using Sensitizing dyes Ia-6, Ia-12, Ib-3, and Ib-12 in place of Sensitizing dye Ia-1 used in Example 5, almost the same results as in Example 5 were obtained.

EXAMPLE 8

When after exposing each of the samples used in Example 5 as in Example 5, each sample was developed by the developer shown below for 30 seconds at 35° C. and stopped, fixed and washed with water in an ordinary manner, excellent positive characteristics as in Examples 5 to 7 were obtained.

Developer

FR Data Com-Pak negative made by FR Co.

Detagraphix Auto Pos Chem Kit made by ALTA Co.

From the above results, it can be seen that the direct positive silver halide photographic materials in this invention had excellent development aptitude.

While the invention has been described in detail and with reference to specific embodiments thereof, it will be apparent to one skilled in the art that various changes and modifications can be made therein without departing from the spirit and scope thereof.

What is claimed is:

1. A method for forming a direct positive image comprising:

(a) imagewise exposing a direct positive silver halide photographic material comprising a support having thereon at least one light-sensitive silver halide emulsion layer containing non-prefogged internal latent image silver halide grains, at least one hydrophilic colloidal layer of the material containing a nucleating agent, and at least one sensitizing dye represented by formula (I), (Ia), (Ia'), or (Ib):

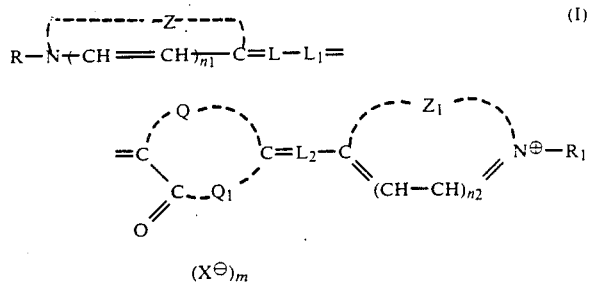

(I)

wherein Z and $Z_1$ each represents a non-metallic atomic group necessary for forming a 5-membered or 6-membered nitrogen-containing heterocyclic ring; R and $R_1$ each represents a substituted or unsubstituted alkyl group or an aryl group; Q and $Q_1$ represent a non-metallic atomic group necessary for forming together a 4-thiazolidinone group, a 5-thiazolidinone group or a 4-imidazolidinone group; L, $L_1$ and $L_2$ each represents a methine group or a substituted methine group; $n_1$ and $n_2$ each is 0 or 1; X represents an anion; and m is 0 or 1;

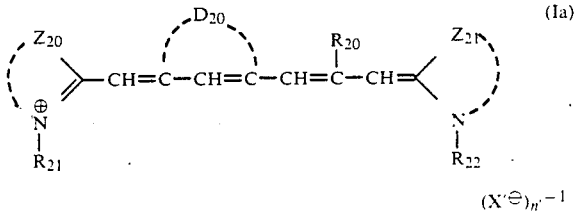

(Ia)

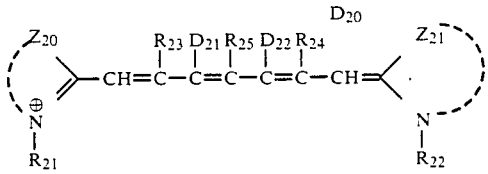

(Ia')

wherein $R_{21}$ and $R_{22}$ each represents a substituted or unsubstituted alkyl group; $R_{20}$ represents hydrogen, a methyl group, a methoxy group or an ethoxy group; $R_{23}$ and $R_{24}$ each represents hydrogen, a lower alkyl group, a phenyl group or a benzyl group; $R_{25}$ represents hydrogen, a lower alkyl group, a lower alkoxy group, a phenyl group, a benzyl group or

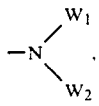

wherein $W_1$ and $W_2$ each represents a substituted or unsubstituted alkyl group or a substituted or unsubstituted aryl group, and $W_1$ and $W_2$ may be linked to form a 5-membered or 6-membered nitrogen-containing heterocyclic ring; $D_{20}$ represents a substituted or unsubstituted group containing at least one ethylene bond; $D_{21}$ and $D_{22}$ each represents hydrogen, or a group containing an ethylene bond when $D_{21}$ and $D_{22}$ are linked to form a ring; $Z_{20}$ and $Z_{21}$ each represents a non-metallic atomic group necessary for forming a 5-membered or 6-membered nitrogen-containing heterocyclic ring; X' represents an acid anion; and n' is 1 or 2;

(Ib)

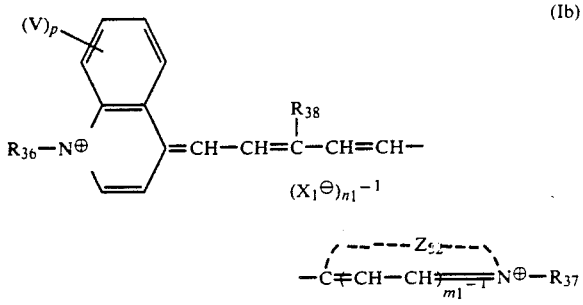

wherein $R_{36}$ and $R_{37}$ each has the same definition as $R_{21}$ and $R_{22}$; $R_{38}$ has the same definition as $R_{23}$; V represents hydrogen, a lower alkyl group, an alkoxy group, a halogen atom, or a substituted alkyl group; $Z_{32}$ has the same definition as $Z_{20}$ and $Z_{21}$; $X_1$ has the same definition as X; and $m_1$, $n_1$ and p is each 1 or 2; and (b) developing said exposed material in the presence of a nucleation accelerator to form a positive image; wherein the nucleating agent is represented by formulae (N-I) or (N-II):

(N-I)

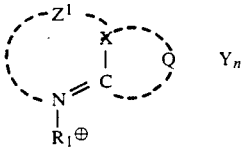

wherein $Z^1$ represents a non-metallic atomic group necessary for forming a 5-membered or 6-membered heterocyclic ring, alone or condensed with an aromatic ring or a heterocyclic ring; $R^1$ represents an aliphatic group; X represents =C— or =N—; Q represents a non-metallic atomic group necessary for forming a 4-membered to 12-membered non-aromatic hydrocarbon ring or 4-membered to 12-membered non-aromatic heterocyclic ring; provided that at least one of $R^1$, a substituent for $Z^1$ and a substituent for Q comprises an alkynyl group; Y represents a counter ion; and n is the number of Y groups necessary for charge balance;

(N-II)

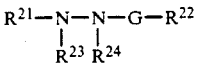

wherein $R^{21}$ represents an aliphatic group, an aromatic group or a heterocyclic group; $R^{22}$ represents hydrogen, an alkyl group, an aralkyl group, an aryl group, an alkoxy group, an aryloxy group or an amino group; G represents a carbonyl group, a sulfonyl group, a sulfoxy group, a phosphoryl group, or an iminomethylene group; one of $R^{23}$ and $R^{24}$ represents hydrogen, and the other represents hydrogen or an alkylsulfonyl group, an arylsulfonyl group, or an acyl group; provided that G, $R^{23}$ and $R^{24}$ may be linked to form a hydrazone structure; and wherein the nucleation accelerator is represented by formula (II)

$$A\text{-}[(Y)_{n_2}\text{-}B]_{m_2} \qquad \text{(II)}$$

wherein A represents an adsorption accelerating group for silver halide; Y represents a divalent linking group; B represents an organic group comprising at least one thioether group, amino group, ammonium group, ether group, or heterocyclic group; $n_2$ is 0 or 1; and $m_2$ is 1 or 2.

2. The method as claimed in claim 1, wherein in formula (Ia), the group represented by $D_{20}$ is substituted with at least one alkyl group containing from 1 to 4 carbon atoms, halogen atom, or alkoxy group; and in formula (Ib) $R_{38}$ represents a lower alkyl group or a benzyl group.

3. The method as claimed in claim 1, wherein said material contains said sensitizing dye represented by formula (Ia).

4. The method as claimed in claim 1, wherein said material contains said sensitizing dye represented by formula (Ia').

5. The method as claimed in claim 1, wherein said material contains said sensitizing dye represented by formula (Ib).

6. The method as claimed in claim 1, wherein said sensitizing dye represented by formula (I) is present in an amount of from $5\times10^{-7}$ mol to $5\times10^{-3}$ mol per mol of silver halide.

7. The method as claimed in claim 1, wherein said nucleating agent is represented by formula (N-I); said heterocyclic ring formed by $Z^1$ is quinolinium, benzimidazolium, pyridinium, acridinium phenanthridinium, naphthopyridinium, or isoquinolinium; $R^1$ is an alkynyl group; said ring formed by Q is a hydrocarbon ring selected from cyclopentane, cyclohexane, cycloheptane, cyclohexene, indane, tetrahydropyran and tetrahydrothiophene; and at least one of $R^1$, $Z^1$ and Q is substituted with an adsorption accelerating group for silver halide.

8. The method as claimed in claim 7, wherein said adsorption accelerating group for silver halide is represented by $Z^1$-$(L^1)_m$, wherein $L^1$ represents a divalent linking group; m is 0 or 1; $X^1$ is an adsorption accelerating group for silver halide selected from a thioamido group, a mercapto group, a 5-membered nitrogen-containing heterocyclic ring, and a 6-membered nitrogen-containing heterocyclic ring.

9. The method as claimed in claim 7, wherein said heterocyclic ring formed by $Z^1$ is quinolinium and $R^1$ represents a propargyl group.

10. The method as claimed in claim 1, wherein said nucleating agent is represented by formula (N-II); $R^{21}$ represents an aromatic group, an aromatic heterocyclic ring or an aryl-substituted methyl group; when G represents a carbonyl group, $R_{22}$ represents hydrogen, an alkyl group, an aralkyl group or an aryl group; when G represents a sulfonyl group, $R_{22}$ represents an alkyl group, an aralkyl group, or a substituted amino group; at least one of $R_{21}$ and $R_{22}$ comprises a ballast group; $R_{23}$ and $R_{24}$ each represents hydrogen; and said nucleating agent is substituted with at least one adsorption accelerator group for silver halide.

11. The method as claimed in claim 10, wherein $R_{21}$ represents an aryl group; and at least one of $R_{21}$ and $R_{22}$ is substituted with an adsorption accelerating group for silver halide represented by $X^2$-$(L^2)_{m_2}$, wherein $L^2$ represents a divalent linking group; $m_2$ is 0 or 1; and $X^2$ represents a mercapto group, a 5-membered nitrogen-containing heterocyclic group, a 6-membered nitrogen-containing heterocyclic group, or a thioamido group with the exception of a thiosemicarbazide group; and —G—$R^{22}$ represents a formyl group.

12. The method as claimed in claim 1, wherein said nucleating agent is contained in a silver halide emulsion layer in an amount of from about $1\times10^{-8}$ mol to about $1\times10^{-2}$ mol per mol of silver in said layer.

13. The method as claimed in claim 7, wherein $R^1$ is a propargyl group linked to said heterocyclic ring formed by $Z^1$ to form a ring.

14. The method as claimed in claim 1, wherein said sensitizing dye represented by formula (I) is represented by formula (I-A):

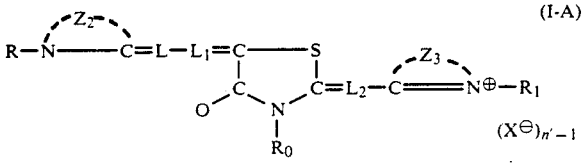

(I-A)

wherein $Z_2$ and $Z_3$ each represents a non-metallic atomic group necessary for forming a thiazole nucleus, a benzothiazole nucleus or a benzoxazole nucleus; $R_0$ represents an alkyl group containing from 1 to 6 carbon atoms, an allyl group or an aralkyl group; X' represents an anion and n' represents 1 or 2 and R, $R_1$, L, $L_1$ and $L_2$ each has the same definition as in formula (I).

15. The method as claimed in claim 1, wherein in formulae (Ia), and (Ia'), the heterocyclic ring formed by $Z_{20}$ and $Z_{21}$ is benzothiazole, naphthothiazole, naphthoxazole, or benzoxazole.

16. The method as claimed in claim 1, wherein said nucleation accelerator is contained in said silver halide emulsion layer or a layer adjacent thereto in an amount of from $10^{-6}$ to $10^{-2}$ mol per mol of silver halide in said silver halide emulsion layer.

17. The method as claimed in claim 1, wherein said sensitizing dye represented by formula (I) is used in combination with a sensitizing dye represented by formula (IX):

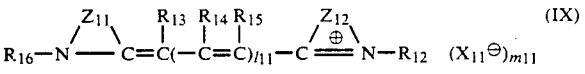

(IX)

wherein $Z_{11}$ and $Z_{12}$ each represents an atomic group necessary for forming a 5-membered or 6-membered nitrogen-containing heterocyclic ring; $l_{11}$ is 0 or 1; $R_{16}$ and $R_{12}$ each represents an alkyl group containing at most 10 carbon atoms or an alkenyl group containing at most 10 carbon atoms; $R_{13}$ and $R_{15}$ each represents hydrogen or a single bond when $R_{13}$ and $R_{15}$, or $R_{15}$ and $R_{12}$ are linked to form a ring; $R_{14}$ represents hydrogen or a substituted or an unsubstituted lower alkyl group; $X_{11}$ represents an acid anion; and $M_{11}$ is 0 or 1.

18. A method for forming a direct positive image comprising:

(a) imagewise exposing a direct positive silver halide photographic material comprising a support having thereon at least one light-sensitive silver halide emulsion layer containing non-prefogged internal latent image silver halide grains, at least one hydrophilic colloidal layer of the material containing a nucleating agent, and at least one sensitizing dye represented by formula (I), (Ia), (Ia'), or (Ib):

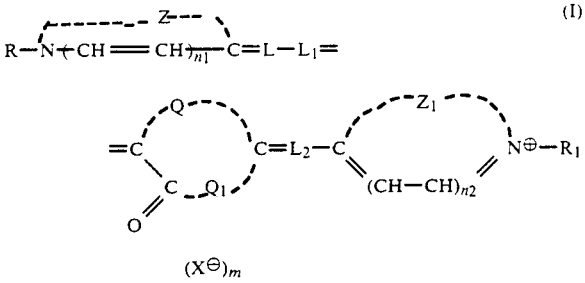

(I)

wherein Z and $Z_1$ each represents a non-metallic atomic group necessary for forming a 5-membered or 6-membered nitrogen-containing heterocyclic ring; R and $R_1$ each represents a substituted or unsubstituted alkyl group or an aryl group; Q and $Q_1$ represent a non-metallic atomic group necessary for forming together a 4-thiazolidinone group, a 5-thiazolidinone group or a 4-imidazolidinone group; L, $L_1$ and $L_2$ each represents a methine group or a substituted methine group; $n_1$ and $n_2$ each is 0 or 1; X represented an anion; and m is 0 or 1;

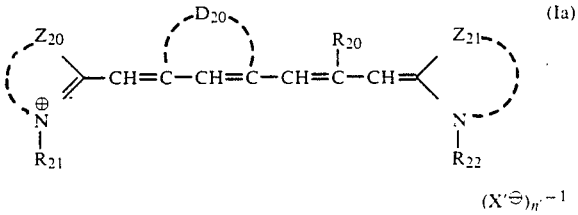

(Ia)

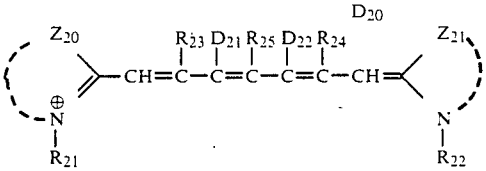

(Ia')

wherein $R_{21}$ and $R_{22}$ each represents a substituted or unsubstituted alkyl group; $R_{20}$ represents hydrogen, a methyl group, a methoxy group or an ethoxy group; $R_{23}$ and $R_{24}$ each represents hydrogen, a lower alkyl group, a phenyl group or a benzyl group; $R_{25}$ represents hydrogen, a lower alkyl group, a lower alkoxy group, a phenyl group, a benzyl group or

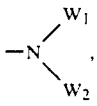

wherein $W_1$ and $W_2$ each represents a substituted or unsubstituted alkyl group or a substituted or unsubstituted aryl group, and $W_1$ and $W_2$ may be linked to form a 5-membered or 6-membered nitrogen-containing heterocyclic ring; $D_{20}$ represents a substituted or unsubstituted group containing at least one ethylene bond; $D_{21}$ and $D_{22}$ each represents hydrogen, or a group containing an ethylene bond when $D_{21}$ and $D_{22}$ are linked to form a ring;

$Z_{20}$ and $Z_{21}$ each represents a non-metallic atomic group necessary for forming a 5-membered or 6-membered nitrogen-containing heterocyclic ring; X' represents an acid anion; and n' is 1 or 2;

(Ib)

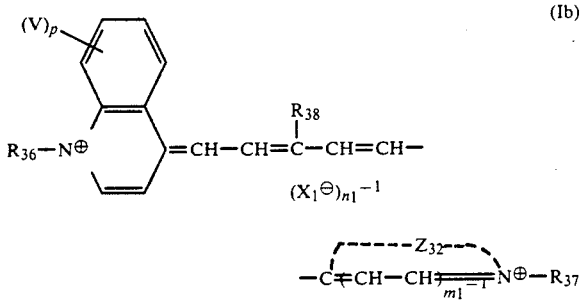

wherein $R_{36}$ and $R_{37}$ each has the same definition as $R_{21}$ and $R_{22}$; $R_{38}$ has the same definition as $R_{23}$; V represents hydrogen, a lower alkyl group, an alkoxy group, a halogen atom, or a substituted alkyl group; $Z_{32}$ has the same definition as $Z_{20}$ and $Z_{21}$; $X_1$ has the same definition as X; and $m_1$, $n_1$ and p is each 1 or 2; and (b) developing said exposed material in the presence of a nucleation accelerator to form a positive image; wherein the nucleating agent is represented by formulae (N-I) or (N-II):

(N-I)

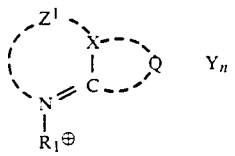

wherein $Z^1$ represents a non-metallic atomic group necessary for forming a 5-membered or 6-membered heterocyclic ring, alone or condensed with an aromatic ring or a heterocyclic ring; $R^1$ represents an aliphatic group; X represents =C— or =N—; Q represents a non-metallic atomic group necessary for forming a 4-membered to 12-membered non-aromatic hydrocarbon ring or 4-membered to 12-membered non-aromatic heterocyclic ring; provided that at least one of $R^1$, a substituent for $Z^1$ and a substituent for Q comprises an alkynyl group; Y represents a counter ion; and n is the number of Y groups necessary for charge balance;

(N-II)

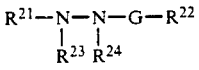

wherein $R^{21}$ represents an aliphatic group, an aromatic group or a heterocyclic group; $R^{22}$ represents hydrogen, an alkyl group, an aralkyl group, an aryl group, an alkoxy group, an aryloxy group or an amino group; G represents a carbonyl group, a sulfonyl group, a sulfoxy group, a phosphoryl group, or an iminomethylene group; one of $R^{23}$ and $R^{24}$ represents hydrogen, and the other represents hydrogen or an alkylsulfonyl group, an arylsulfonyl group, or an acyl group; provided that G, $R^{23}$ and $R^{24}$ may be linked to form a hydrazone structure; and wherein the nucleation accelerator is represented by formulae (III) to (VIII):

(III)

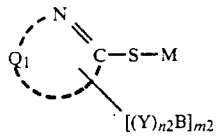

wherein $Q_1$ represents an atomic group necessary for forming a 5-membered or 6-membered heterocyclic ring; M represents hydrogen, an alkali metal atom, an ammonium group or a group capable of forming hydrogen or an alkali metal atom under alkaline conditions; and Y, B, $m_2$ and $n_2$ each has the same definition as in formula (II);

(IV)

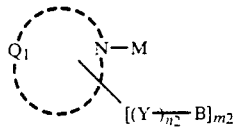

wherein Q'' represents an atomic group necessary for forming a 5-membered or 6-membered heterocyclic ring capable of forming imino silver; and Y, B, $m_2$, $n_2$ and M each has the same definition as in formula (III):

(V)

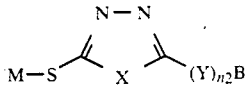

wherein X represents oxygen, sulfur or selenium; and M, B, Y, and $n_2$ each has the same definition as in formula (III);

(VI)

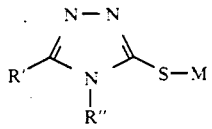

wherein R' represents hydrogen, a halogen atom, a nitro group, a mercapto group, an unsubstituted amino group, a substituted or unsubstituted alkyl group, a substituted or unsubstituted alkenyl group, a substituted or unsubstituted aralkyl group, a substituted or unsubstituted aryl group, or $(Y)_n2B$; R'' represents hydrogen, an unsubstituted amino group or $(Y)_n2B$; provided that at least one of R' and R'' represents $(Y)_n2B$; and M, B, Y, and $n_2$ each has the same definition as in formula (III);

(VII)

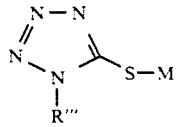

wherein R''' represents $(Y)_n2$ B and M, B, Y, and $n_2$ have the same definition as in formula (III);

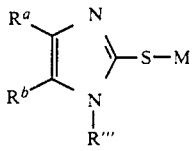

(VIII)

wherein $R^a$ and $R^b$ each represents hydrogen, a halogen atom, a substituted or unsubstituted amino group, a nitro group, a substituted or unsubstituted alkyl group, a substituted or unsubstituted alkenyl group, a substituted or unsubstituted aralkyl group or a substituted or unsubstituted aryl group; and M and R''' each has the same definition as in formula (VII).

* * * * *

UNITED STATES PATENT AND TRADEMARK OFFICE
CERTIFICATE OF CORRECTION

PATENT NO. : 5,015,561

DATED : May 14, 1991

INVENTOR(S) : Kazunori Hayashi, Nobuaki Inoue, Shingo Nishiyama.

It is certified that error appears in the above-identified patent and that said Letters Patent is hereby corrected as shown below:

Column 96, line 10, after claim 18, add the following claims:

19. The method as claimed in claim 18, wherein in formula (Ia), the group represented by $D_{20}$ is substituted with at least one alkyl group containing from 1 to 4 carbon atoms, halogen atom, or alkoxy group; and in formula (Ib) $R_{38}$ represents a lower alkyl group or a benzyl group.

20. The method as claimed in claim 18, wherein said sensitizing dye represented by formula (I) is present in an amount of from $5 \times 10^{-7}$ mol to $5 \times 10^{-3}$ mol per mol of silver halide.

21. The method as claimed in claim 18, wherein said nucleating agent is represented by formula (N-I); said heterocyclic ring formed by $Z^1$ is quinolinium, benzimidazolium, pyridinium, acridinium phenanthridinium, naphthopyridinium, or isoquinolinium; $R^1$ is an alkynyl group; said ring formed by Q is a hydrocarbon ring selected from cyclopentane, cyclohexane, cycloheptane, cyclohexene, indane, tetrahydropyran and tetrahydrothiophene; and at least one of $R^1$, $Z^1$ and Q is substituted with an adsorption accelerating group for silver halide.

It is certified that error appears in the above-identified patent and that said Letters Patent is hereby corrected as shown below:

22. The method as claimed in claim 21, wherein said adsorption accelerating group for silver halide is represented by $X^1(L^1)_m$, wherein $L^1$ represents a divalent linking group; m is 0 or 1; $X^1$ is an adsorption accelerating group for silver halide selected from a thioamido group, a mercapto group, a 5-membered nitrogen-containing heterocyclic ring, and a 6-membered nitrogen-containing heterocyclic ring.

23. The method as claimed in claim 21, wherein said heterocyclic ring formed by $Z^1$ is quinolinium and $R^1$ represents a propargyl group.

It is certified that error appears in the above-identified patent and that said Letters Patent is hereby corrected as shown below:

24. The method as claimed in claim 18, wherein said nucleating agent is represented by formula (N-II); $R^{21}$ represents an aromatic group, an aromatic heterocyclic ring or an aryl-substituted methyl group; when G represents a carbonyl group, $R_{22}$ represents hydrogen, an alkyl group, an aralkyl group or an aryl group; when G represents a sulfonyl group, $R_{22}$ represents an alkyl group, an aralkyl group, or a substituted amino group; at least one of $R_{21}$ and $R_{22}$ comprises a ballast group; $R_{23}$ and $R_{24}$ each represents hydrogen; and said nucleating agent is substituted with at least one adsorption accelerator group for silver halide.

UNITED STATES PATENT AND TRADEMARK OFFICE

CERTIFICATE OF CORRECTION

PATENT NO. : 5,015,561

DATED : May 14, 1991

INVENTOR(S) : Kazunori Hayashi, et al

It is certified that error appears in the above-identified patent and that said Letters Patent is hereby corrected as shown below:

25. The method as claimed in claim 24, wherein $R_{21}$ represents an aryl group; and at least one of $R_{21}$ and $R_{22}$ is substituted with an adsorption accelerating group for silver halide represented by $X^2(L^2)_{m2}$, wherein $L^2$ represents a divalent linking group; $m_2$ is 0 or 1; and $X^2$ represents a mercapto group, a 5-membered nitrogen-containing heterocyclic group, a 6-membered nitrogen-containing heterocyclic group, or a thioamido group with the exception of a thiosemicarbazide group; and $-G-R^{22}$ represents a formyl group.

Signed and Sealed this

Sixth Day of April, 1993

*Attest:*

*Attesting Officer*

STEPHEN G. KUNIN

*Acting Commissioner of Patents and Trademarks*